US005417417A

United States Patent [19]

Takehara et al.

[11] Patent Number: 5,417,417

[45] Date of Patent: May 23, 1995

[54] SHEET MATERIAL SORTING APPARATUS HAVING MEANS FOR HOLDING AND CONVEYING THE SHEET MATERIAL

[75] Inventors: Yoshifumi Takehara, Yokohama; Yuji Takahashi, Tokyo; Noriyoshi Ueda, Yokohama; Norifumi Miyake, Kawasaki, all of Japan

[73] Assignee: Canon Kabushiki Kaisha, Tokyo, Japan

[21] Appl. No.: 124,697

[22] Filed: Sep. 22, 1993

[30] Foreign Application Priority Data

Sep. 24, 1992 [JP] Japan ..... 4-254765

[51] Int. Cl.[6] ..... B65H 39/00

[52] U.S. Cl. ..... 271/296; 271/303; 271/288

[58] Field of Search ..... 271/287, 288, 289, 290, 271/292, 296, 302, 303, 304

[56] References Cited

U.S. PATENT DOCUMENTS

| | | | |
|---|---|---|---|
| 4,881,730 | 11/1989 | Kaneko | 271/296 |
| 4,900,009 | 2/1990 | Kitahara et al. . | |
| 5,172,908 | 12/1992 | Steinhilber | 271/288 |

FOREIGN PATENT DOCUMENTS

| | | | |
|---|---|---|---|
| 0127556 | 5/1989 | Japan | 271/290 |
| 0197279 | 8/1989 | Japan | 271/288 |
| 4059563 | 2/1992 | Japan | 271/287 |
| 4243768 | 8/1992 | Japan | 271/287 |

*Primary Examiner*—H. Grant Skaggs

*Attorney, Agent, or Firm*—Fitzpatrick, Cella, Harper & Scinto

[57] ABSTRACT

A sorting apparatus includes a plurality of bin trays arranged in a direction with clearances between adjacent ones to accommodate sheet materials; a plurality of sheet introducing devices disposed at a plurality of positions along the direction; a first sheet holder, movable in the direction, for receiving the sheet materials from the sheet introducing device and holding the sheet materials; second sheet holder, movable in the direction, for receiving sheet from the first sheet holder and for discharging the sheet material to the bin trays; a deflector for deflecting the sheet material to one of the sheet holder; wherein the first sheet holder selects one of the sheet introducing device from which the first sheet holder receive the sheet material.

7 Claims, 45 Drawing Sheets

SHEET MATERIAL SORTING APPARATUS HAVING MEANS FOR HOLDING AND CONVEYING THE SHEET MATERIAL

FIELD OF INVENTION AND RELATED ART

The present invention relates to a sheet material sorting apparatus having a means for holding and conveying the sheet material, in particular, a sheet material sorting apparatus (generally, referred to as "sorter," "gatherer," "separator," or the like) for sorting the sheet materials discharged sequentially, one by one, from a sheet material discharging apparatus, and accumulating them into two or more sheet receiving plates (hereinafter, referred to as "bin"). Practically speaking, the above mentioned sheet material discharging apparatus refers to various types of image forming apparatus such as a copying machine, printing apparatus, printing machine, or other apparatuses, which discharge, one by one, the sheet material (cut sheet material, card, or paper-like material such as thin plate material). Incidentally, the name "image forming apparatus" may strictly refers to a copying machine itself, or may refer to a combination apparatus comprising the copying apparatus and the sheet material sorting apparatus.

The conventional sheet sorting apparatus (hereinafter, referred to as "sorter") may be roughly classified into two groups: sorters having moving bins, and sorter having fixed bins.

(1) In the moving bin sorter, a set of vertically arranged bins is moved in front of a sheet material discharge opening of the sheet material discharging apparatus the sheet material receiving opening of each bin sequentially faces the sheet material discharge opening, whereby the sheet materials are sorted into individual bins.

When a post processing operation such as binding is performed, the bin interval is widened after the sorted sheets in the bin are jogged by an jogging apparatus, so that the bins do not interfere with a binding apparatus. Then, the set of sheets accumulated in each bin is sequentially bound by the binding apparatus inserted from the lateral side of the bin or the side where a sheet Stopper is disposed.

(2) In the fixed bin sorter, the set of vertically arranged bins is immobile, and instead, a sheet passing mechanism is provided, which selectively connects the sheet material discharging opening to the sheet material receiving opening of each of the set of vertically arranged bins, with use of plates, deflector plates, or the like, wherein each sheet material discharged from the sheet material discharging opening of this machine is passed through the sheet passing mechanism, in which the sheet is guided by the guide plates, and when it arrives at the location corresponding to a specific bin, the deflector plate 800 disposed at this location is activated to guide it into this specific bin. Thus, the sheet materials are sequentially sorted into the specific bins (refer to FIG. 45).

(3) FIG. 46 shows another type of fixed bin sorter, which comprises a belt member 802 for conveying the sheet material, a discharge roller 804 having a deflector plate 803 and being fixed on a belt member 805, wherein the belt member 802 is disposed adjacent to the bins, and the sheet conveyed by the belt member 802 is deflected into one of the bins by the discharge roller 804 which is moved by the vertical movement of the belt member 805.

Referring to FIG. 47, in the fixed bin sorter (3), it would be considered a stapler 810 is disposed in a moving path of a deflector plate which is movable up and down, and is moved up and down along a stopper Bt of a bin B, and the bin is moved toward the stapler upon the stapling operation.

However, the prior moving bin sorter such as those described above has the following faults.

In the case of the moving bin sorter, the bins themselves vertically move; therefore, it is liable to generate vibrations or noises. In particular, if a sorter comprising the bins having two or more cutouts to allow the sheets in the bins to be bound at multiple locations is combined with a high speed copying machine or the like, the bins which must be moved.

Also at a high speed are more liable to vibrate because of the above mentioned cutouts. Therefore, the bins must be reinforced.

However, in the fixed bin sorter (2) and (3), there arises problems such as frequent sheet jam and longer time required for the sheet sorting.

To solve these problems, U.S. Pat. No. 4,900,009 discloses a sheet sorter having a plurality of sheet receiving trays (bins) for accommodating the sorted sheets and a sheet material holding means (sheet dispenser) movable to dispense the sheets to the bins.

The sheet sorter a relay device, a dispenser device and a plurality of bins. In this case, the topmost bin is a non-sort bin addicted for the sheets not sorted. In the sorting mode, all of the lower bins are used.

The sheet material fed to the sheet sorter by a sheet discharger is guided along an S-guide by a pair of relaying rollers in the relay device to the dispenser device. The dispenser device comprises first and second dispenser units, which are movable up and down and are independently stoppable at positions for sheet dispensing. The first dispenser device is stoppable also at a position opposed to the most downstream roller pair of the relaying device.

The motion of the dispenser device is such that the second dispenser unit is at rest at a position opposing to the bin to receive the sheet now, and the first dispenser unit rises to a position opposing to the second dispenser unit while holding by the roller pair the leading edge portion of the sheet received from the relaying portion. It transfer the sheet to the second dispenser unit, and thereafter, lowers to the outlet portion of the relaying portion. The second dispenser unit discharges the sheet to the proper bin, and moves to the position opposing the next bin. By repeating these operations, the sheets are dispensed to the bins.

As to the positional relations of various portions in the normal rest state, the discharging roller pair of the relaying portion is disposed adjacent a center of the plurality of the bins, and the first dispenser unit is at a position opposed to it. The second dispenser unit is at rest at the position opposed to the topmost bin which is the non-sort bin.

The home position is placed at the center to shorten the maximum moving range of the first dispenser unit.

The conventional structure described above involves the following problems.

(1) In the non-sorting mode operation, the first dispenser unit is required to reciprocate for every sheet through a long distance between a position opposing to the discharging roller pair in the relaying portion and a position faced to the second dispenser unit at rest at the topmost bin which is the non-sort bin. This problem is more significant if the number of the bins increases.

Therefore, if there is no time margin between the sheet materials sequentially discharged from the sheet discharger, the operation of the first dispenser unit is not quick enough, with the result of improper matching with a high speed output device.

(2) The long distance reciprocation in the frequently used mode adversely influences the durability of the moving mechanism of the first dispensing unit.

SUMMARY OF THE INVENTION

Accordingly, it is a principal object of the present invention to provide a sheet sorter having a high durability without disturbing a high speed sheet discharge of the sheet discharging apparatus.

According to an aspect of the present invention, there is provided a sorting apparatus comprising a plurality of bin trays arranged in a direction with clearances between adjacent ones to accommodate sheet materials; a plurality of sheet introducing means disposed at a plurality of positions along the direction; first sheet holding means, movable in the direction, for receiving the sheet materials from the sheet introducing means and holding the sheet materials; second sheet holding means, movable in the direction, for receiving sheet from the first sheet holding means and for discharging the sheet material to the bin trays; a deflector for deflecting the sheet material to one of the sheet holding means; wherein the first sheet holding means selects one of the sheet introducing means from which the first sheet holding means receive the sheet material. Then, since the moving distance of the sheet holding means can be reduced, so that the operation speed can be increased and the durability of the apparatus can be improved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
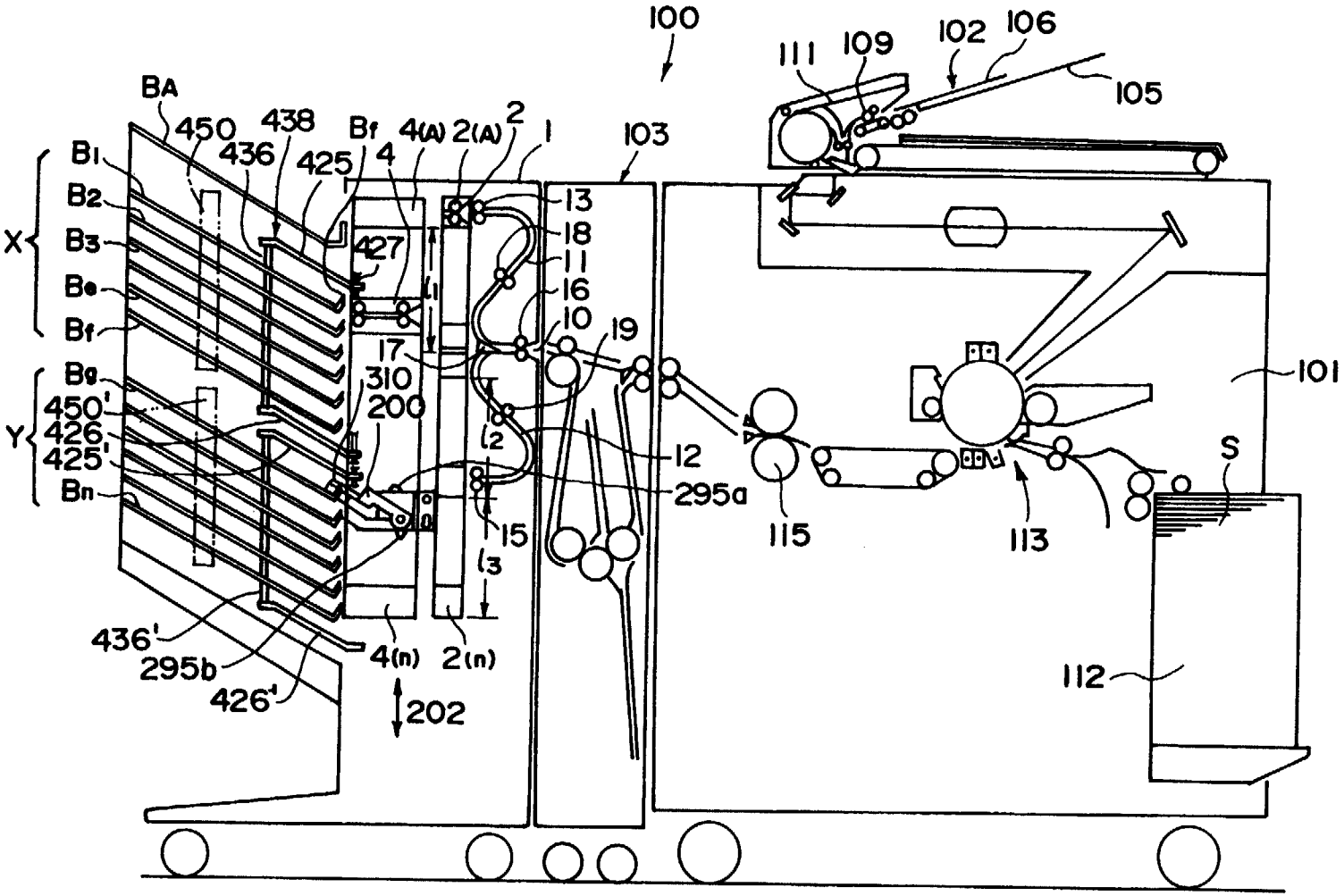
FIG. 1 is a schematic sectional front view of an embodiment of the image forming apparatus (constituting an image forming system, together with the sorter, folding apparatus, copying apparatus, or the like,) incorporating the post processing apparatus (sorter) in accordance with the present invention.

Hereinafter, the embodiments of the present invention will be described referring to the drawings.

FIG. 1 presents an electrophotographic copying machine (image forming apparatus) as the apparatus which discharges the sheet material. This copying machine comprises an automatic original feeding apparatus 102 disposed in the upper portion of the machine, a folding apparatus 103 placed on the side where a sheet material S is discharged from the main assembly 101 of the copying machine (image forming apparatus), and a sorter 1 positioned at a further downstream location.

Originals 106 laid on an original stand of the automatic original feeding apparatus 102 are separated from the bottom one by one, and are conveyed through a pass 109 onto a platen glass 107 of the main assembly 101 of the copying machine, where they are read by an optical system of the main assembly of the copying machine. After being read, they are moved away from the platen glass 107 through a pass 111 and are discharged onto the top of the rest of the originals in the original stand 105. A sheet material S is fed from a deck 112, and an image is formed on the sheet material S in an image forming station 113. Then, the image is fixed on the sheet material S in a fixing station. Next, generally speaking, the sheet material S is just passed through a folding apparatus, and is delivered to a sheet receiving opening of the sorter 1.

Here, the image forming process will not be described since it is a matter of public knowledge.

Figure 2:
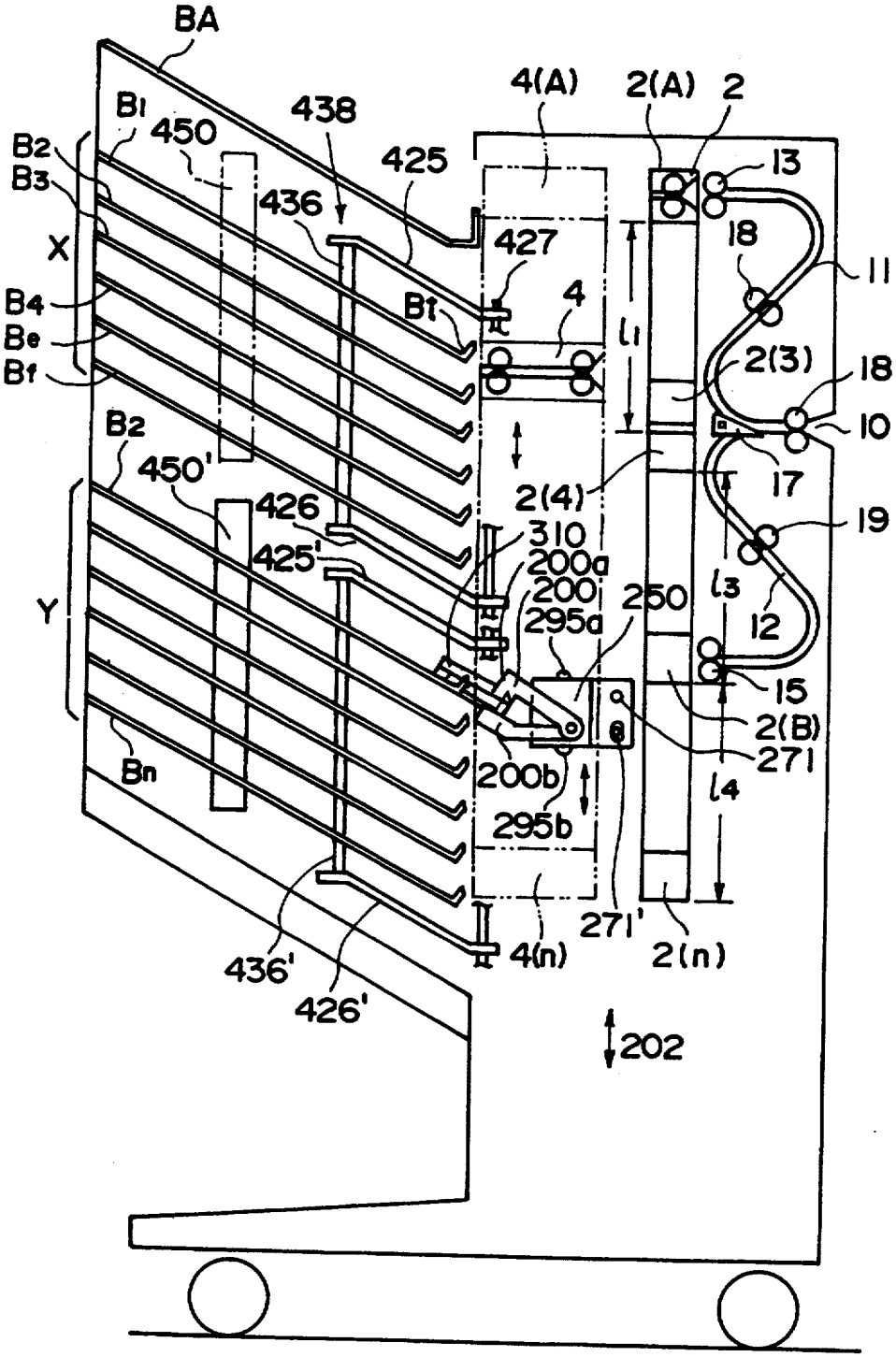
FIG. 2 is a sectional front view of the sorter shown in FIG. 1.

The sorter 1 has a large number of bins $B_1$–$B_n$ arranged in vertical multiple layers as shown in FIGS. 1 and 2, and the entrance 10 through which the sheet material S discharged from the main assembly 101 of the copying machine is received. Also, the first sheet passage 11 is aimed from this entrance 10 toward the bins. The first sheet passage 11 branches to form the second sheet passage 12, wherein an upper pair of discharge roller 13 is attached to the first sheet passage 11, and a bottom pair of discharge roller 15 is attached on the downstream side of the second sheet passage 12. Also, the first and second sheet passages are provided with pairs of sheet relay rollers 18 and 19, respectively, which can handle even the sheet of a minimum size.

Further, a pair of receiving rollers 16 and a deflector 17 are disposed at the location where the first and second sheet passages branch, whereby the sheet material S is selectively guided into either the first sheet passage 11 or the second sheet passage 12 depending on the way the deflector 17 is displaced.

Figure 3:
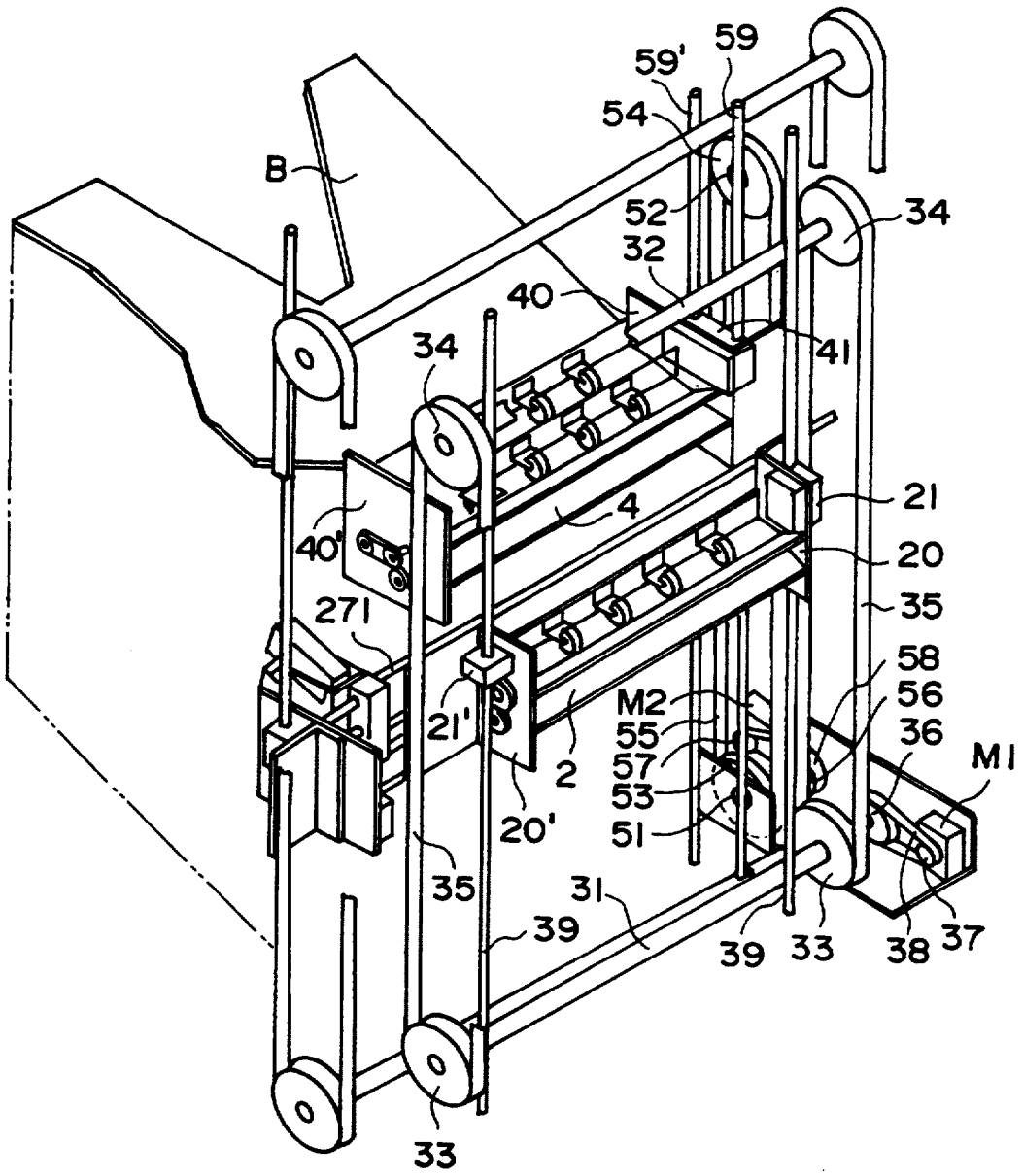
FIG. 3 is a perspective view of the sorter shown in FIG. 1.

FIG. 3 is a perspective view of a mechanism for moving vertically the first and second delivery units 2 and 4.

The mechanism for moving vertically the first delivery unit comprises: a pair of parallel main shafts 31 and 32 supported by bearings at the top and bottom portions of the sorter 1, respectively; pulleys 33—33, and 34—34 mounted at the front and rear ends of the main shafts 31 and 32, respectively; a pair of vertical belts 35—35, at front, and 36, at the rear, stretched around the pulleys 33—33 and 34—34, respectively; a pulley 36 mounted at the further rear end of the bottom main shaft 31 for picking up the power; a reversible motor $M_1$ for supplying the power for the vertical movement of the delivery unit 1; a driving pulley 37 mounted on the output shaft of the motor $M_1$; and a belt 38 stretched around the driving pulley 37 and the power pick up pulley 36. The first delivery unit 2 is substantially vertically suspended, wherein the side plates 20 and 20' of the unit are fixed to the pair of vertical belts 35—35, on the corresponding sides.

As the vertical movement motor $M_1$ rotates in the forward direction, the pair of belts 35—35 is rotated forward, whereby the first delivery unit 2 moves upward. Contrarily, if the motor $M_1$ rotates in reverse, the pair belts 35—35 is rotated in reverse, whereby the unit 2 moves downward.

The above mentioned pair of belts 35—35 are stretched around the pulleys 33—33 fixed on the driving main shaft 31 and the pulleys 34—34 fixed on the follower main shaft 32, respectively. This arrangement makes it less likely for the rotational phase difference to occur between the pair of belts 35—35; therefore, the unit 2 can hold level attitude while moving vertically.

Further, a pair of vertical rails 39—39 are fixed to unshown mounts, on the rear (right side in FIG. 3) and front sides, respectively. These vertical rails 39—39 are engaged with the rail engaging members 21 and 21' fixed on the side plates 20 and 20' of the delivery unit 2, whereby the side to side or forward and backward looseness are controlled during the vertical movement of the unit 2.

Next, a mechanism for moving the second delivery unit 4 will be described.

This mover mechanism comprises: a pair of main shafts 51 and 52 supported in parallel by the bearings at the bottom and top portions of the rear side of the sorter 1; pulleys 53 and 54 mounted on the main shafts 53 and 54, respectively; a vertical belt 55 stretched around the pulleys; a power pick up pulley 56 mounted at the rear end side of the bottom main shaft 51; a reversible motor $M_2$ for vertical movement; driving pulley 57 mounted on the output shaft of the motor $M_2$; and a belt 58 stretched around the driving pulley 57 and the power pick up pulley 56.

The second delivery unit 4 has a pair of side plates 40 and 40' which are fixed on the vertical belt 55.

On unshown mounts located on the rear side of the sorter 1, a pair of vertical rails 59 and 59' are mounted, and these vertical rails 59 and 59' are engaged with a rail engaging member 41 fixed on the outward facing surface of the side plate 40, that is, the one on the rear side of the unit 4.

The rail engaging member 41 has a pair of holes **41*a* and 41*b* having a diameter substantially equal to those of the rails (FIG. 6), and the rails 59 and 59'** are fitted through these holes.

This arrangement controls the looseness in the side to side or forward and backward directions during the vertical movement of the unit 4, whereby the unit 4 can hold level attitude while moving vertically.

As the vertical movement motor $M_2$ is driven to rotate forward, the belt 55 is rotated forward, whereby the second delivery unit 4 moves downward alongside the sheet material receiving opening side of each of the bins $B_1$–$B_n$ arranged in multiple vertical layers. Contrarily, as the motor $M_2$ is driven to rotate in reverse, the belt 55 is rotated in reverse, whereby the unit 4 moves upward.

Figure 4A:
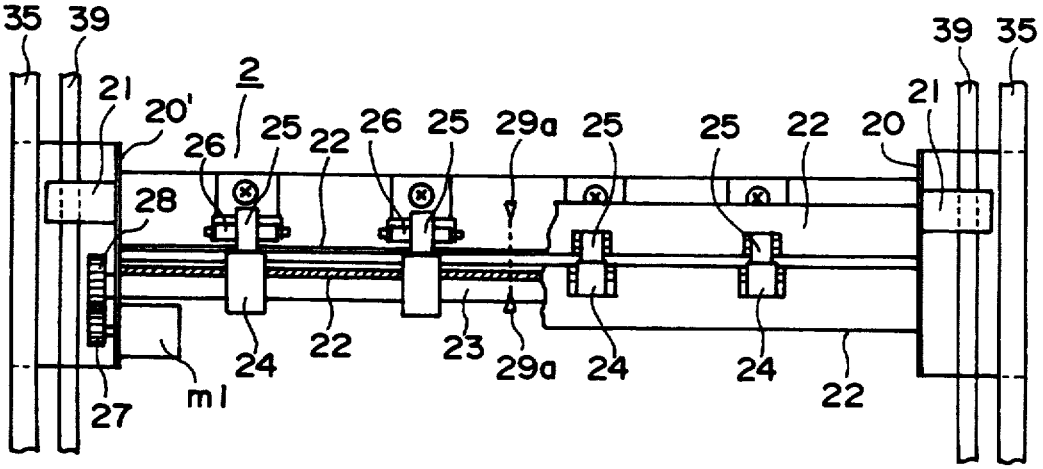
FIG. 4A presents a partially cut out left side view of the first delivery unit.
Figure 4B:
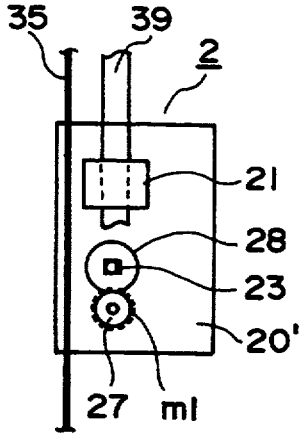
FIG. 4B is a rear view thereof.
Figure 4C:
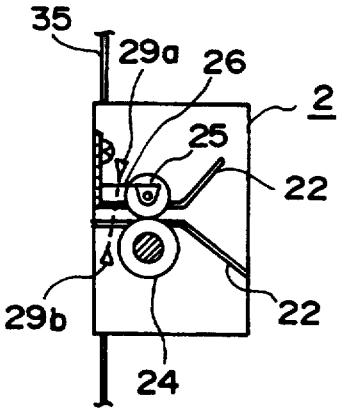
FIG. 4C is a sectional front view thereof.

FIGS. 4A, 4B and 4C are partially cut out front view, left side view, and sectional view of the first delivery unit 2, respectively.

The first delivery unit 2 comprises: a pair of sheet material guiding plates 22—22 which are located between the side plate 20 on the rear side and the side plate 20' on the front side, facing each other from the top and bottom; a roller shaft 23 supported between the side plates 20 and 20' by the bearings; two or more (four in this embodiment) rollers 24 of rubber or the like, which are mounted on the roller shaft 23, with predetermined intervals in the longitudinal direction of the shaft 23; pressure rollers 25 placed in contact with the peripheral surfaces of the respective rollers 24, being imparted with a proper constant pressure generated by leaf springs 26; a sheet material conveying motor $m_1$ fixed on one of the side plate 20'; a driving gear 27 mounted on the output shaft of the motor $m_1$; a power pick up gear 28 mounted on the end of the roller shaft 23 to mesh with the driving gear 27; sheet material detection sensors **29*a* and 29*b* (for example, a photocoupler comprising a light source and a receptor) located on the sheet exit side of the sheet material guiding plate 22—22**, for detecting the presence of the sheet material; and the like.

Contact nips formed between the respective rollers and pressure rollers 25 are present in a sheet material passage formed by the upper and lower sheet guiding plates 22 and 23.

Figure 5A:
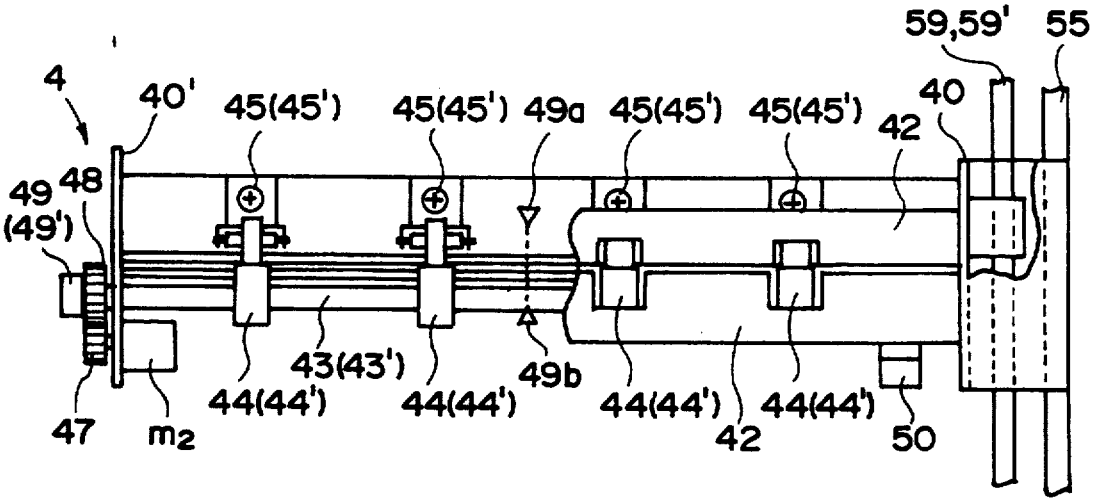
FIG. 5A presents a partially cut out left side view of the second delivery unit.
Figure 5B:
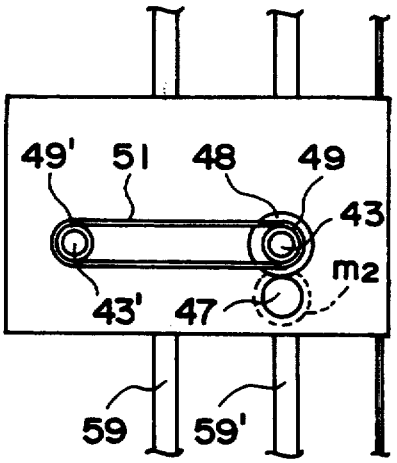
FIG. 5B is a rear view thereof.
Figure 5C:
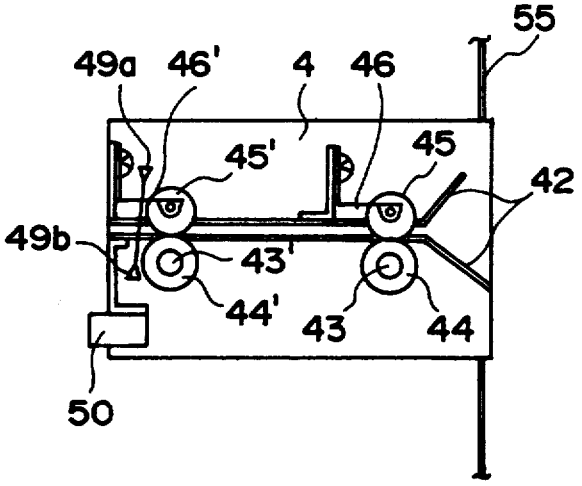
FIG. 5C is a sectional front view thereof.

FIGS. 5A, 5B and 5C are partially cut out front view, left side view, and sectional view, of the second delivery unit 4, respectively.

The second delivery unit 4 comprise: a vertically facing pair of sheet guiding plate 42 and 42' located between the side plate 40 on the rear side and the side plate 40' on the front side; a pair of roller shafts supported between the side plates 40 and 40' by the bearings; two or more (four per shaft in this embodiment) rollers 44 and 44' of rubber or the like mounted on the roller shafts 43 and 43', with predetermined intervals in the longitudinal direction of the rollers; pressure rollers 45 placed in contact with the peripheral surfaces of the respective rollers 44 and 44, being imparted with a proper constant pressure generated by springs 46 and 46'; a sheet material conveying motor $m_2$ mounted on one of the side plate 40'; a driving gear 47 mounted on the output shaft of the motor $m_2$; a power pick up gear 48 mounted toward the end of the roller shaft 43 to be meshed with the driving gear 47; a pulley 49 mounted at the end of the roller shaft 43; a pulley 49' mounted on the front end of the roller shaft 43' to receive a driving force from the pulley 49 by way of belt 51; and sheet material detecting sensors **49(*a*) and 49(*b*) (for example, a photocoupler or the like comprising a receptor and a light source) located on the sheet exit side of the sheet material guiding plates 42 and 42'**.

Also, the second delivery unit is provided with a bin position detecting sensor 50 (for example, a photocoupler) for detecting the position of each of bins $B_1$–$B_n$.

The contact nips formed between the respective rollers 44 and pressure rollers 45, and between the respective rollers 44' and pressure rollers 45', are present within a sheet material passage formed by the upper and lower sheet guiding plates 42 and 42'.

Figure 6:
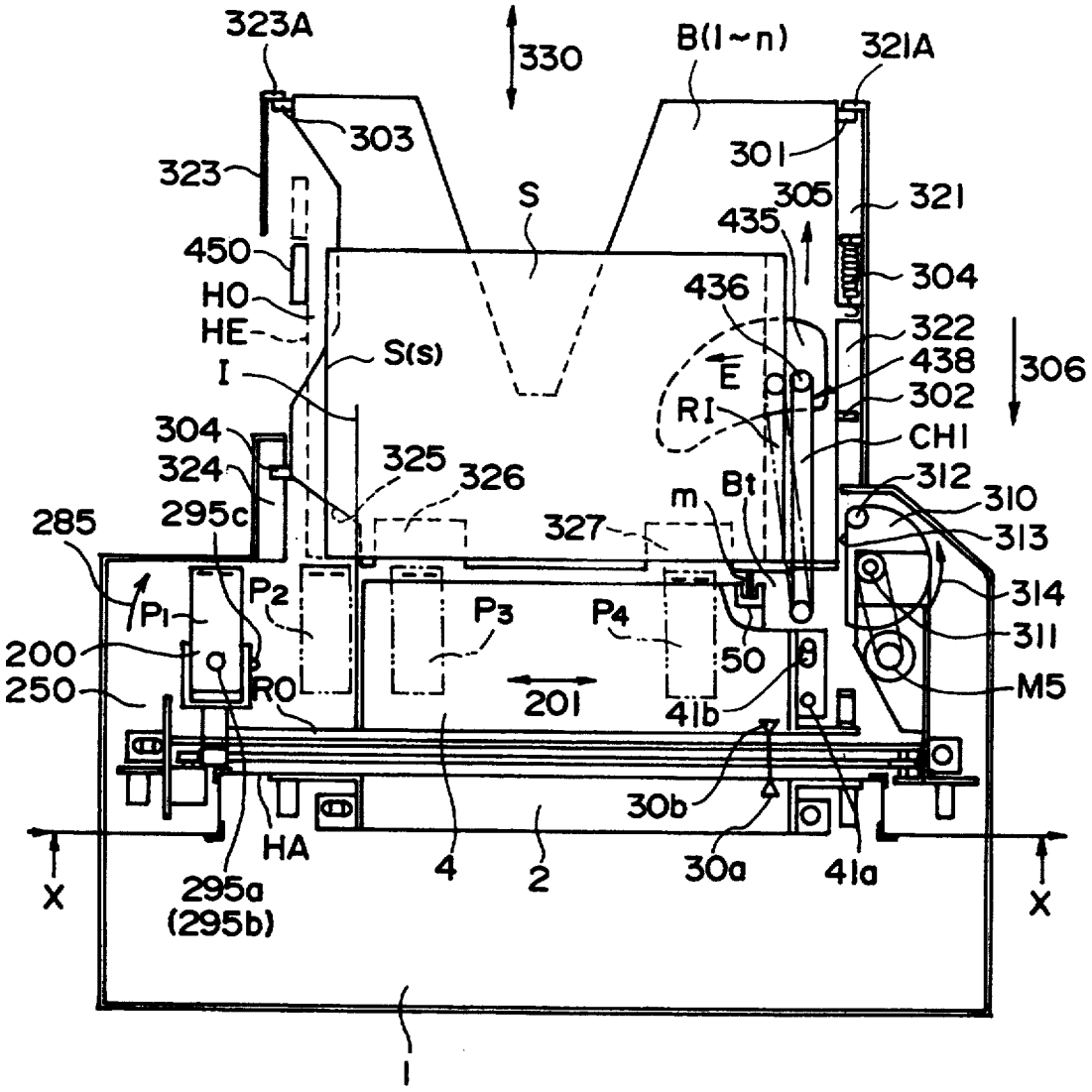
FIG. 6 is a plan view of the sorter shown in the preceding drawings.
Figure 7:
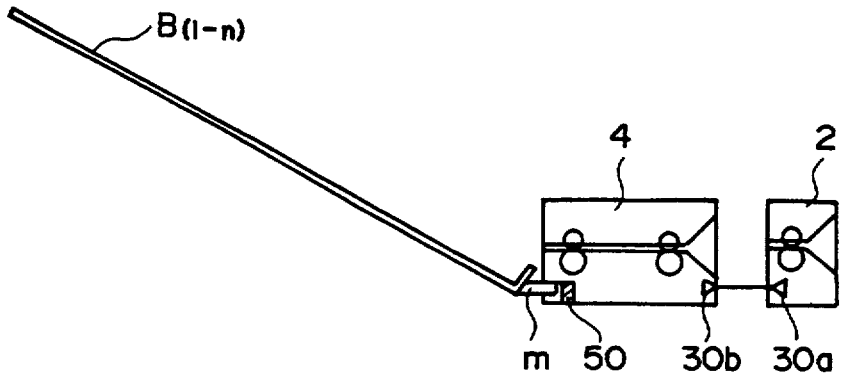
FIG. 7 is a sectional view of the first and second delivery units 2 and 4, at a predetermined sectional line.

FIG. 6 is a partially cut out plan view depicting the state in which the first delivery unit 2 is aligned with the second delivery unit 4, and FIG. 7 is a sectional view showing the same state, with reference to the sectional line passing the location of the sensor 50.

While moving upward or downward, the second delivery unit 2 detects the position of each bin by means of detecting and counting the flag m projecting on the sheet material receiving side of each bin, with use of the sensor 50, whereby the second delivery unit can be precisely controlled to move and stop at the location where it exactly faces the sheet receiving side of a given bin.

The first and second delivery unit 2 and 4 are provided with position sensors **30*a* and 30*b* for detecting each other's position (for example, a photocoupler comprising a receptor and a light source), whereby the first delivery unit 2 is precisely controlled to move and stop at a location where it is exactly aligned with the second delivery unit 4** while moving upward or downward.

Figure 10:
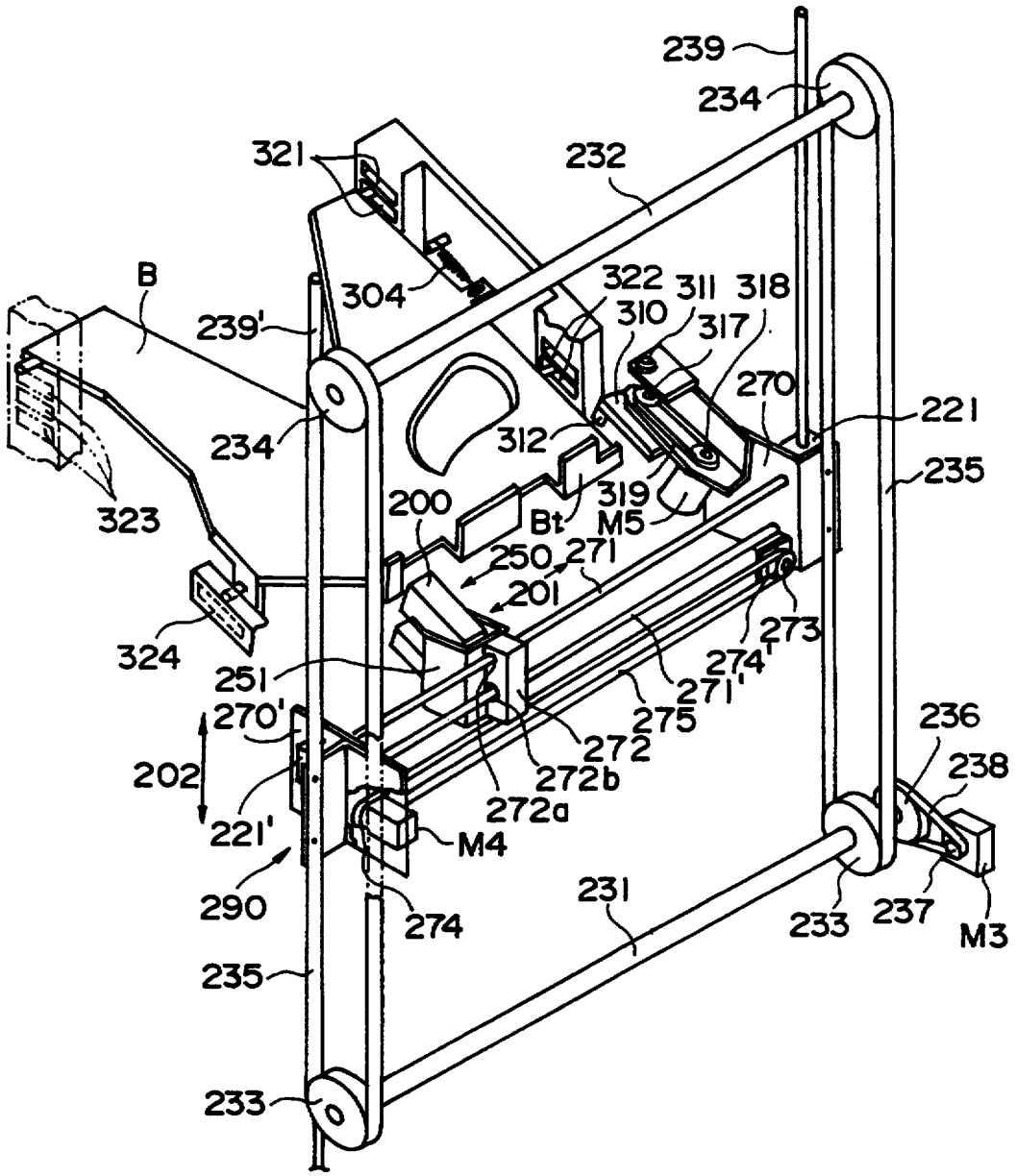
FIG. 10 is a perspective view of the main structure of the sorter shown in the preceding drawings.

Next, a mechanism for moving the stapler 200 will be described (FIGS. 6 and 10). The stapler 200 is enabled to move in the first direction 201 (substantially perpendicular to the direction in which the sheet material is conveyed) to staple the sheet materials in the bin, at an optional location, or locations, on the sheet surface, and in the second direction 202 (direction perpendicular to the first direction) to a position where it is aligned with one of the vertically arranged bins $B_1$–$B_n$.

First, a mechanism for moving the stapler in the first direction will be described.

The mechanism comprise: a stapler supporting member 251 on which the stapler 200 is mounted (stapler unit 250); side plates 270 on the rear side, with reference to the stapler unit 250, and 270' on the front side; and rails 271 and 271' located between the side plates, which together constitute a stapler supporting unit 290.

The rails 271 and 271' are engaged with the engaging members 272 (**272*a* is a positioning hole, and 272*b* is an elongated hole) provided on the stapler unit 250, whereby the stapler unit 250 can move in the direction indicated by an arrow 201** without suffering from the looseness in the side to side, forward and backward, or upward and downward.

On the side plate 270' which constitutes the front side of the stapler supporting unit 290, a motor $M_4$ is mounted, on the output shaft of which a pulley 274 is mounted. On the side plate 270 which constitutes the rear side of the stapler supporting unit 290, an idler shaft 273 is mounted, and a pulley 274' is rotatively mounted on the idler shaft 273. Around the pulleys 274 and 274' a belt 275 is stretched, and the staple unit 250 is fixed on the belt 275.

As the motor $M_4$ is driven to rotate forward or in reverse, the staple unit 250 is moved in the arrow 201 direction.

As the stapler unit 250 moves all the way toward the front side (passing a line (I) in FIG. 6) of the stapler supporting unit 290, the staple unit 250 can retreat out of the path of the second delivery unit 4.

Further, since rails 271 and 271' and other components such as belt are located outside the paths of the first and second delivery units 2 and 4 (between a line (RO) and (HA), they do not interfere with the movement of the first and second delivery units 2 and 4.

With presence of such a mechanism, the stapler 200 is capable of moving in the arrow 201 direction.

Next, a mechanism for moving vertically (second direction indicated by the arrow 202) the stapler 200 to the position where the stapler 200 is aligned with one of bins $B_1$–$B_n$ (FIGS. 1 and 10).

The mechanism for moving vertically the stapler unit 250 comprises: a pair of main shafts 231 and 232 supported in parallel by the bearings at the bottom and top sides of the sorter 1, respectively; pulleys 233—233 and 234—234 mounted on the main shafts 231 and 232, at the rear ends and the front ends, respectively; a pair of vertical belts 235—235 stretched around the pulleys 233–234 and 233–234, on the front side and rear side, respectively; a power pick up pulley 236 mounted at the extended rear end of the bottom main shaft 231; a reversible motor $M_3$ for vertical movement; a driving pulley 237 mounted on the output shaft of the motor $M_3$; and a belt 238 stretched around the driving pulley 237 and power pick up pulley 236. To the pair of vertical belts 235—235, the side plates 270 and 270' of the stapler supporting unit 290 are fixed, on the respective sides, so that the stapler unit 250 is substantially levelly suspended.

With presence of this mechanism, as the motor $M_3$ for vertical movement is driven to rotate forward, the pair of belts 235—235 are rotated forward, whereby the stapler unit 250 is moved upward along the vertically arranged bins $B_1$–$B_n$.

Contrarily, as the motor $M_3$ is driven to rotate in reverse, the pair of belts 235—235 are rotated in reverse, whereby the unit 250 moves downward. Since the pair of belts 235—235 are stretched around the pulleys 233—233 fixed to the main shaft 231 which is the driving shaft, and the pulley 234—234 fixed to the main shaft 232 which is the follower shaft, respectively, the rotational phase difference is not likely to occur between the belts 235—235, whereby the stapler unit 250 can remains level while moving vertically.

Also, a pair of vertical rails 239 and 239' are fixed to unshown mounts disposed on the rear and front sides of the sorter 1, respectively, and these vertical rails 239 and 239' are engaged with rail engaging members 221 and 221' provided on the outward facing surfaces of the side plates 270 on the rear side, and 270' on the front side, of the stapler unit 250, respectively, (member 221 has a round hole, and member 221' has an elongated hole), whereby the looseness in the side to side or forward and backward direction are controlled while the stapler unit 250 makes vertical movements.

This mechanism further comprises delivery unit position detecting means 295*a*, 295*b*, and 295*c*, such as a microswitch, located on the stapler unit 250, on the top and bottom surfaces and the surface facing the second delivery unit 4; therefore, even an anomaly occurs, there is no chance that the stapler unit 250 and the second delivery unit 4 collide to each other (FIGS. 2 and 6).

Figure 9:
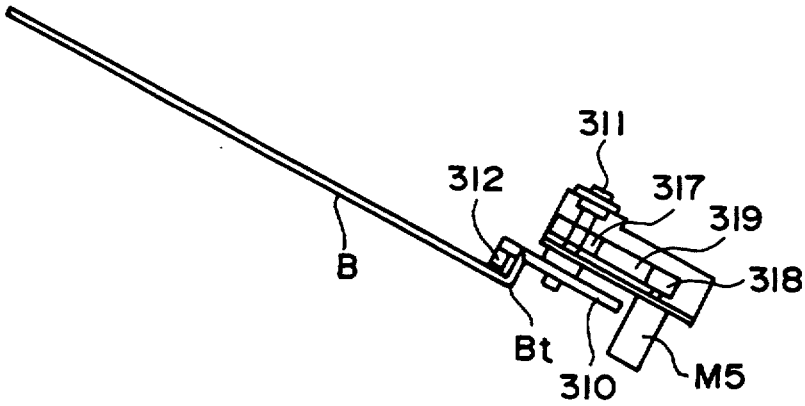
FIG. 9 is a front view of a mechanism for moving the bins.

Next, a mechanism for moving the bin B when the stacked sheets are stapled by the stapler 200 (refer to FIGS. 6, 9, and 10).

Referring to FIG. 6, each of the bins $B_1$–$B_n$ is provided with four positioning bosses (301, 302, 303, and 304) located at each of the four corners of the bin surface for positioning the bin when the bin is moved and the bosses are engaged with grooved rails 321, 322, 323, and 324 attached to the main assembly of the sorter 1 in a manner to partition the bins from each other, whereby the each bin is supported so as to be capable of moving in the direction indicated by an arrow 330. Also, each of the bins $B_1$–$B_n$ is constantly pressured by a pressuring means 304 such as a spring in the direction indicated by an arrow 305, whereby it is positioned at a location where the bosses 301 and 303 of each of bins $B_1$–$B_n$ are placed in contact with the stoppers 321A and 323A, respectively.

As is evident from the above mentioned structure, the bins $B_1$–$B_n$ in the state described above are movable in the direction indicated by an arrow 306.

To the side plate 270, that is, the plate on the rear side, of the stapler supporting unit 290, a bin moving means 310 is fixed. The bin moving means 310 is rotated by a motor $M_5$ about a central shaft 311. As shown in the drawings, the bin moving means 310 is shaped like a halfmoon, and its peripheral surface is provided with a bin pushing member 312. To the central shaft 311 of the bin moving means 310, a pulley 317 is fixed, and the driving force from the motor $M_5$ is transmitted to the pulley 317 via a pulley 318 fixed to the output shaft of the motor $M_5$, and a belt 319.

Normally, this bin moving means 310 is oriented so as to cause the bow side surface 3B to face the bin B, in order to prevent it from interfering with the bin B. However, when the bin B is to be pulled back in the arrow 306 direction to staple the sheets, the bin moving means is rotated in the direction indicated by an arrow 314 by a signal from an unshown controlling means, whereby the bin pushing member 312 engages with a bin stopper $B_i$, moving thereby a specific bin B to an out position (position outlined by a solid line in FIG. 11) in the arrow 306 direction. At this time, since the bosses 301 to 304 of the bin B are engaged with the respective rails 321 to 324, the bin B moves without suffering from the looseness in the forward and backward, side to side, or upward and downward, directions.

In addition, the stapler 200 is moved in advance to a predetermined location where it faces the cutouts 325, 236, or 327, of the bin, and in this state, the bin is moved as described above, whereby the sheets in the bin are positioned to face the stapler, and stapled.

After the above mentioned sequence, the bin moving means is rotated in reverse to return to the state shown in FIG. 6, whereby the specific bin B is return to the normal location by the force generated by the pressuring means 304.

When the sheets in another bin need to be stapled, the stapler supporting unit 290 is moved upward or downward, as needed, to a position where the stapler unit becomes aligned with this specific bin, and the stapling sequence is repeated.

With presence of the above described structure, when the sheets need to be stapled, only a specified bin is pulled out toward the stapler; therefore, the upper and lower jaw portions 200*a* and 200*b* (hammer and anvil) of the stapler do not interfere with the bin right above and the bin right below. Needless to say, it is unnecessary to make the bin interval wider for the stapling operation as was described in regard to the sorter of the moving bin type.

Figure 12:
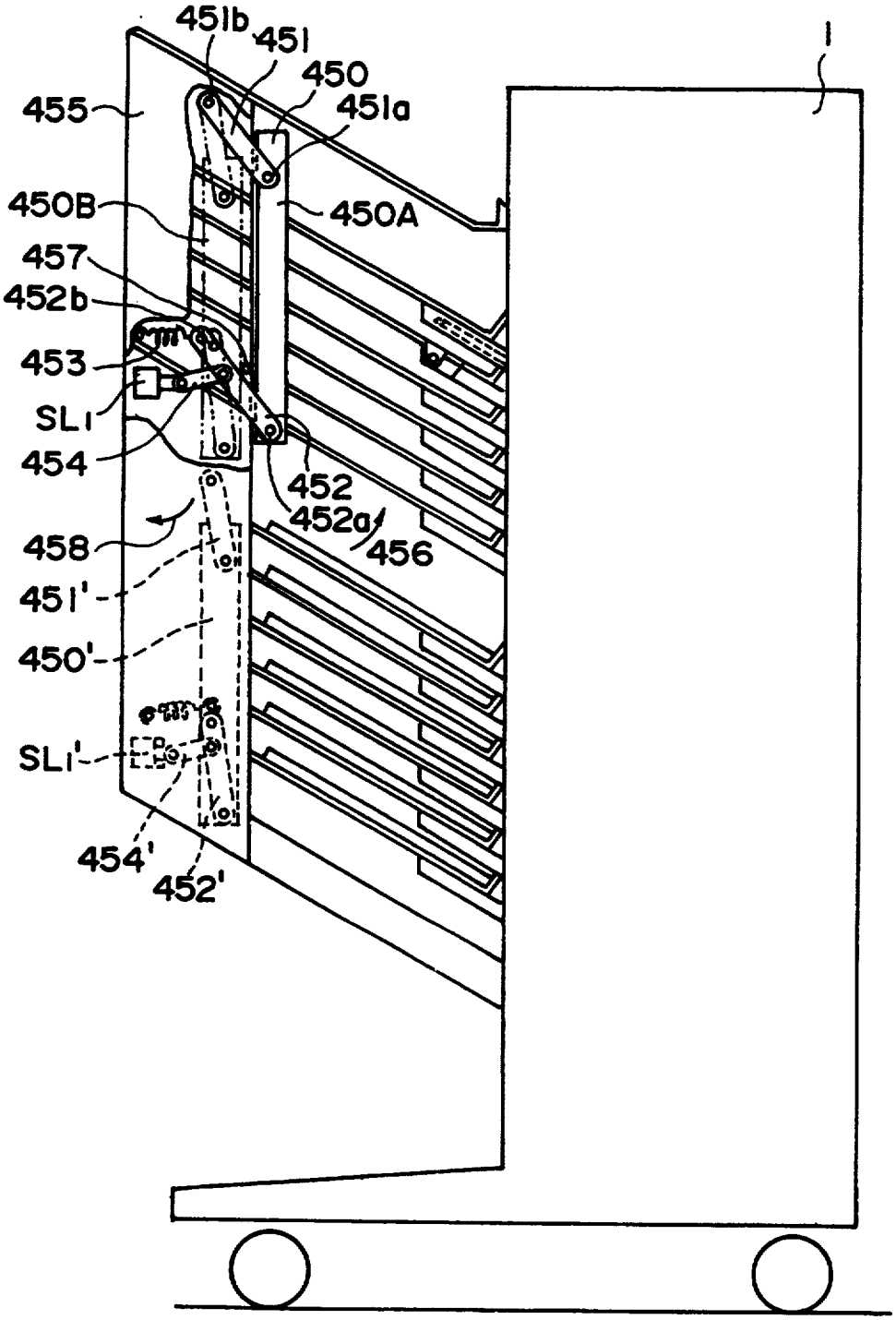
FIG. 12 is a sectional front view of a mechanism for moving the reference wall of the sorter.

Next, a means for aligning (jogging) the sheets in the bin will be described (FIGS. 2, 6, and 12).

Here, the description will be made as to a case in which the bins $B_1$–$B_n$ are divided into two modules $X(B_1$–$B_f)$ and $Y(B_g$–$B_n)$. When n is odd number, the bins may be divided into two modules $B_1$-$B_{\{(n-1)/2\}}$ and $B_{\{(n-1)/2+1\}}-B_n$.

First, the first module X($B_1$-$B_f$) will be described. On the rear side of the bin B, a rotational central shaft 427 is pivotally supported by unshown supporting plates provided on the sorter 1, wherein the upper and lower ends of the rotational central shaft 427 are fixed to an upper and lower arms 425 and 426, respectively. Between the upper and lower arms 425 and 426, an jogging member 428 having a jogging rod 436 is placed. Here, the jogging rod 436 is penetrating each of bins $B_1$-$B_f$through a cutout 435. The jogging member 428 is pivoted about the rotational central shaft 427 by an unshown pulse motor or the like by way of a gear train.

Figure 13:
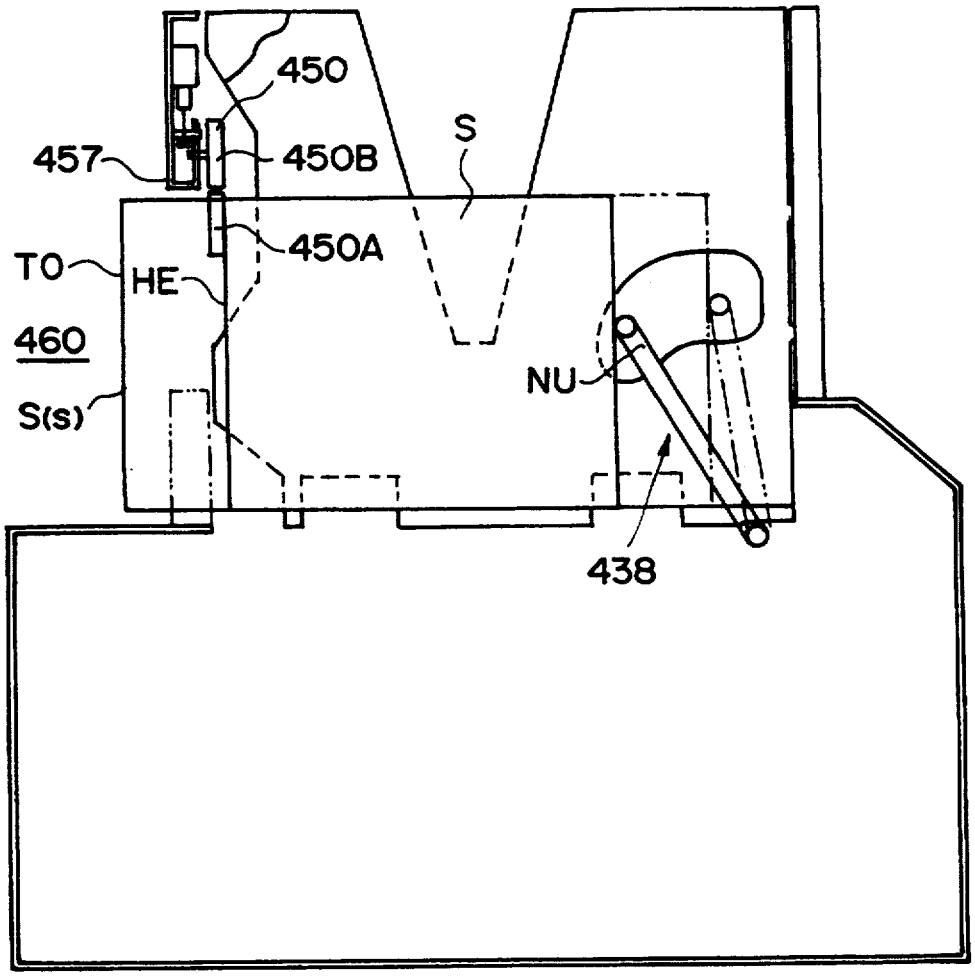
FIG. 13 is a plan view of the mechanism for moving the reference wall of the sorter.

On the front side of the bin, a jogging reference wall 450 is provided, against which the sheets are jogged by the jogging rod 436. The jogging reference wall 450 is connected to each of one ends of a pair of links 451 and 452 with use of pivots 451*a* and 452*a*, respectively, and the other ends of the links is connected, with use of pivots 451*b* and 452*b*, to a cover member 455 formed integrally with the rail members on which the bins slide. As shown in FIG. 12, a spring 453 is attached to one end of the link 452, whereby the link 452 is under a constant pressure which tries to rotate the link 452 about the pivot 452*b*, in the direction indicated by an arrow 456, so that the link 452 is placed in contact with the a stopper 457 located on the cover member 455, on the inside wall (FIGS. 12 and 13), being positioned there. Thus, the jogging reference wall is positioned in the state indicated by an outline 450A. Also, a lever 454 of a solenoid $SL_1$ is attached to the link 452. When the solenoid is turned on by an unshown controlling means, the link 452 is moved in the direction indicated by an arrow 458; therefore, the jogging reference wall takes a position indicated by an outline 450B, whereby the front side of the bin becomes open as shown in FIG. 13, allowing the sheet material S to be pulled out in the direction indicated by an arrow 460.

Hereinbefore, the first module X, that is, the upper group of bins $B_1$-$B_f$, was described. Since the second module Y, that is, the lower group of bins $B_g$-$B_n$, is structured substantially in the same manner as the first module X, the corresponding components in the second module Y are designated by the same reference numerals, except being marked by an apostrophe, as the first module X and the description of its structure is omitted.

Figure 14:
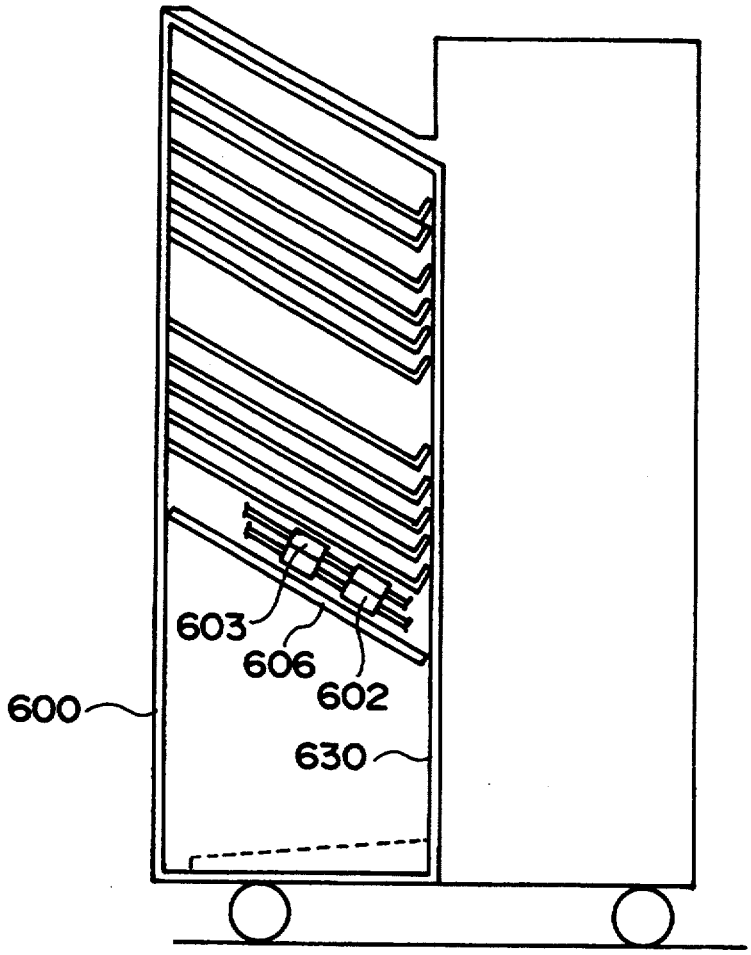
FIG. 14 is a front view of a sorter provided with a stacker.
Figure 15:
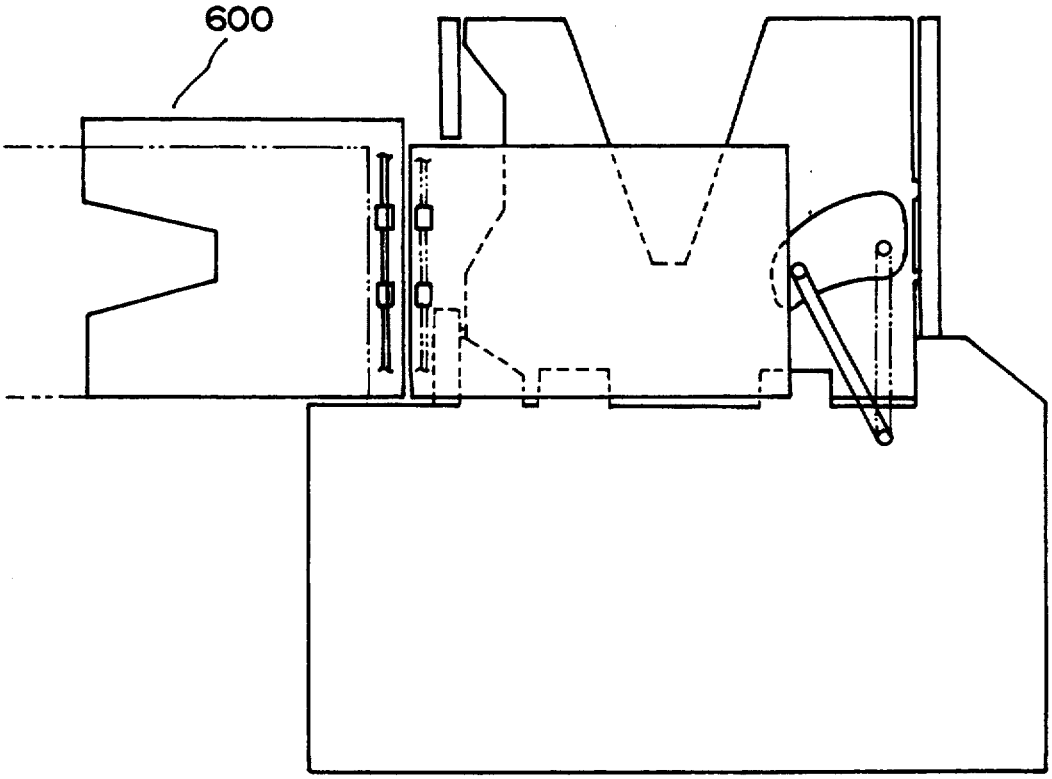
FIG. 15 is a plan view of a sorter provided with a stacker.
Figure 16:
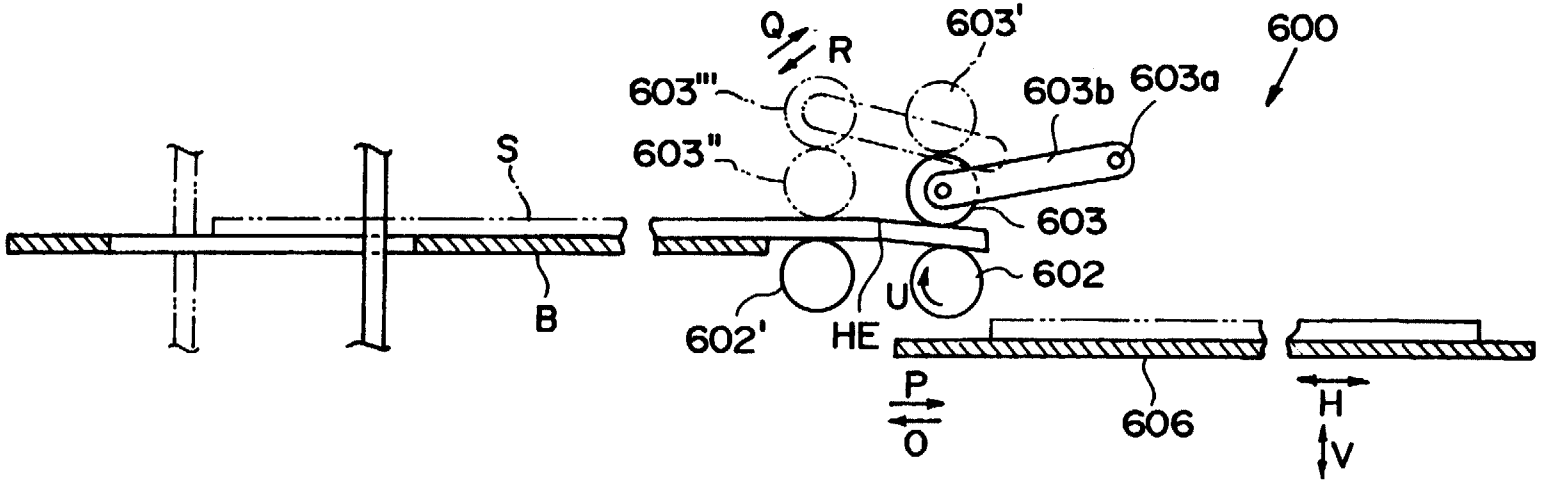
FIG. 16 is a left side view of a mechanism for sending out a bundle of sheets to the stacker.

FIGS. 14, 15, and 16 show an embodiment in which a stacker 600 for taking out the sheets in bin B is provided on the front side (in the direction perpendicular to the one in which the sheets are inserted into the bin B) of the sorter 1. A receiver tray 606 is placed adjacent to the bin B and slightly below a specific bin from which the sheets are taken out. This tray 606 is vertically moved to a position where it is aligned with a specific bin when the sheet material S is to be taken out, by an unshown driving means. Also, this tray 606 is provided with sheet picking rollers 602 and 603 which vertically move with the tray. The sheet material S is taken out from the bin B by these rollers to be loaded into the tray 606. The details of this operation will be described below.

Hereinafter, the operation of this embodiment having the structure described above will be described.

(A) Operation in a sorting mode i. An original is placed on the original stand 105 of the automatic original feeding apparatus 102 of the main assembly 101 of the copy machine (FIG. 1), and after specific sorting mode conditions are inputted to a control circuit, through an unshown console panel, a start key is pressed.

ii. A standby procedure of the sorter 1 is started by a signal generated by pressing the start key. In other words, it is confirmed whether or not the first delivery unit 2 is at a home position 2(A), that is, whether or not the first delivery unit 2 is facing the upper pair of discharge rollers 13 of the sorter 1. Further, it is confirmed by a control circuit whether or not the second delivery unit 4 is at a predetermined home position 4(A), that is, whether or not the second delivery unit 4 is facing the sheet receiving opening of the non-sorting bin $B_A$ disposed at the top.

Figure 21A:
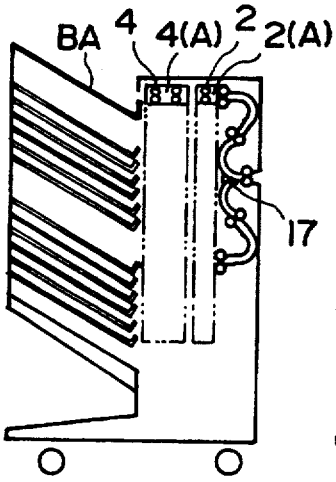
FIGS. 21A–21H present explanatory drawing for describing the operational sequence (for the first bin) of the embodiment of the sorter in accordance with the present invention.
Figure 21B:
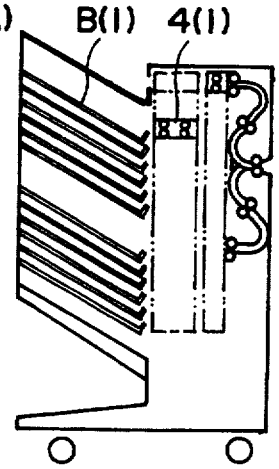
Figure 21C:
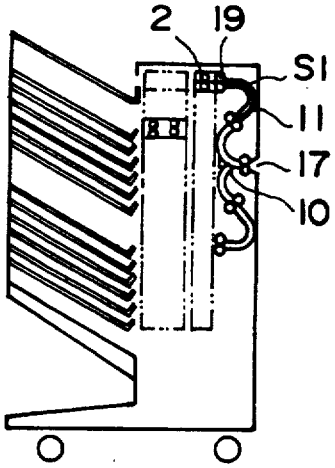
Figure 21D:
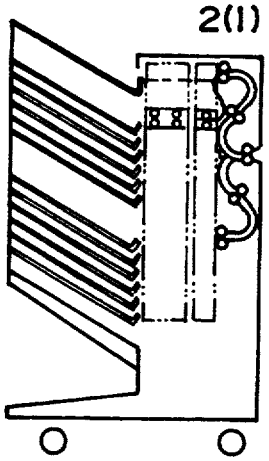
Figure 21E:
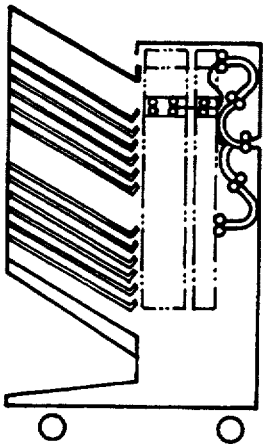
Figure 21F:
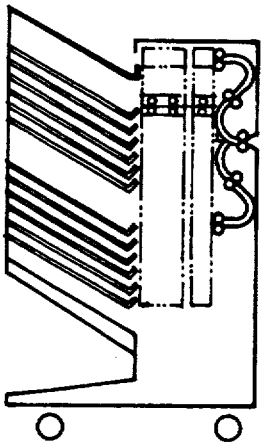
Figure 21G:
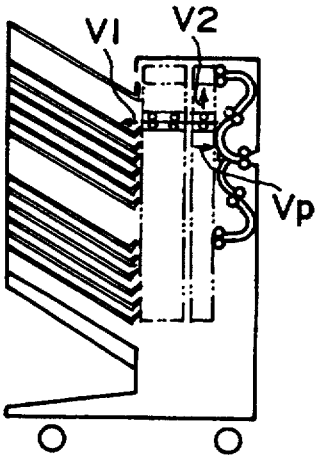

These confirmations are made by signals from detecting means such as a microswitch (unshown) which is turned on when the first and second delivery units 2 or 4 is at the home position.

iii. When one or both of the first and second delivery units 2 and 4 are not at the home position, one or both of the vertical movement motors $M_1$ and $M_2$ (FIG. 3) are driven to rotate forward or in reverse so that both of the units 2 and 4 return to their home positions (initialing operation) (FIG. 21A).

iv. At the same time as, or after the completion of, the above described standby procedures i–iii for the sorter 1, the original 206 is conveyed onto the platen glass 107, when the main assembly of the copying machine starts the copying operation.

v. At the same time, the sheet conveying motors $m_1$ and $m_2$ of the first and second delivery units 2 and 4 are driven to rotate forward, whereby the pairs of rollers 24–25, 44–45, 44'–45' are rotated forward, being prepared for receiving the sheet material (FIG. 21B), and the second delivery unit 4 is driven by the vertical movement motor $M_2$ to be moved to a position corresponding to the uppermost sorting bin $B_1$ (position 4(1) facing the sheet receiving opening). This arrival of the second delivery unit 4 is detected by the above described flag m and the sensor 50 (FIG. 7), whereby the motor $M_2$ is stopped.

vi. The first sheet material $S_1$ discharged after an image is formed on it by the copying machine 101 is fed into the sorter 1 through the entrance 10, is guided and introduced into the first sheet passage 11 by the deflector 17 which has been displaced in angle during the preceding standby procedure of the sorter, and is introduced into the first delivery unit 2 through the upper pair of discharge rollers 13.

vii. Here, the sheet material $S_1$ is fed between the upper and lower guide plates 22—22 of the first delivery unit 2 being on standby at the home position facing the upper pair of discharge rollers 13, where its leading end of the sheet material $S_1$ is guided by the guiding plates 22—22 to be introduced into the nip formed between the pair of rollers 24–25.

viii. Since the pair of rollers 24–25 are rotating forward, the sheet material $S_1$ is conveyed straight forward between the guide plates 22—22 (FIG. 21C).

ix. After passing between the pair of rollers 24–25, the leading end of the sheet material $S_1$ is detected by the sensors 29*a* and 29*b* (FIG. 4(*c*)), when the rotation of the sheet material conveying motor $m_1$ of the first delivery unit 2 is stopped with a predetermined timing. Therefore, the leading end of the sheet material $S_1$ is firmly and securely held between the pair of rollers 24–25 which has ceased their rotation.

x. At the same time, the vertical movement motor $M_1$ of the first delivery unit 2 is driven in reverse, whereby the unit 2 begins to descend, holding the leading end of the sheet material $S_1$ between the pair of rollers 24–25. In other words, the sheet material $S_1$ begins to be conveyed downward. This descending speed of the unit 2 is set to be the same as, or slightly slower than, the speed at which the sheet material $S_1$ is discharged from the upper pair of discharge roller 13, whereby a proper amount of slack is given to the sheet material S, allowing it to be conveyed downward without being creased or being pulled between the pair of rollers 24–25 and the upper pair of discharging rollers 13, with an excessive amount of force.

xi. As soon as the arrival of the descending first delivery unit 2 at a position, where the first delivery unit 2 becomes aligned with the second delivery unit 4 being on standby while facing the sheet receiving opening of the uppermost bin $B_1$, is detected by the position detecting sensors 30*a* and 30*b* (FIG. 7), the reverse rotation of the vertical movement motor $M_1$ of the first delivery unit 2 is stopped by the signal from the sensors. In other words, the downward movement of the first delivery unit 2 is stopped (FIG. 21D).

xii. At the same time, the sheet material conveying motor $m_1$ of the first delivery unit 2 is driven forward for the second time to rotate forward the pair of rollers 24–25, whereby the sheet material $S_1$ having been held between the pair of rollers 24–25 is conveyed into the opening formed by the sheet guiding plates 42—42 of the second delivery unit 4 (FIG. 21E).

xiii. The leading end of the sheet material $S_1$ is guided and led into the nip formed between the pair of rollers 44–45 and 44'–45' of the second delivery unit 4, by the guiding plates 42—42. The roller pressures of the pair of rollers 44–45 and 44'–45' are set up to be the same as, or slightly higher than, that of the pair of rollers 24–25, whereby the leading end of the sheet material $S_1$ is assured to be firmly gripped between the pairs of rollers 44–45 and 44'–45' so that the sheet material $S_1$ is reliably conveyed.

xiv. Since the pair of rollers 44–45 and 44'–45' are rotating forward, the introduced sheet material $S_1$ is conveyed further forward within the second delivery unit 4 (FIG. 21F).

xv. When the leading end of the sheet material $S_1$ which has been introduced into the second delivery unit 4 and conveyed forward through the pairs of rollers 44–45 and 44'–45' is detected by the sheet material detecting sensors 49*a* and 49*b* (FIG. 5C), the vertical movement motor $M_1$ of the first delivery unit 2 is driven forward by the signal from the sensors, whereby the unit 2 begins the ascending movement. At this time, the leading end of the sheet material $S_1$ is held between the pairs of rollers 44–45 and 44'–45' of the second delivery unit 4, with a sufficient force; therefore, the sheet material $S_1$ is reliably delivered from the first delivery unit 2 to the second delivery unit 4.

xvi. At the same time, the sheet conveying motor $m_1$ of the first delivery unit 2 is controlled to rotate forward at a high speed. In other words, the roller 24 is rotated at a high speed (FIG. 21G).

Figure 21H:
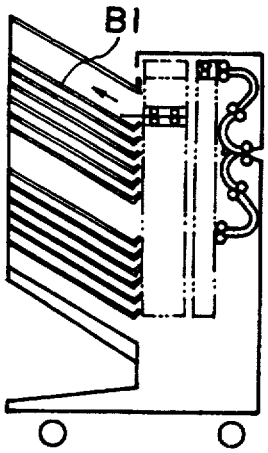

This high speed rotational speed of this roller 24, that is, the sheet conveying speed $V_R$ of this roller 24 during the return movement of the first delivery unit 2, substantially equals to the sum of the sheet material conveying speed V1 of the pairs of rollers 44–45 and 45'–45' of the second delivery unit 4, and the ascending (returning) speed V2 of the first delivery unit 2, that is, V1+V2. Therefore, even if the first delivery unit 2 is moved upward when the sheet material $S_1$ is passing through the first delivery unit 2, that is, when the sheet material $S_1$ has not completely come out of the first delivery unit 2, the portion of the sheet material between the units 2 and 4 is practically not subjected to an excessive tension, friction, or creasing force, or the similar load; or even if it is subjected, the magnitude of the load is substantially smaller.

xvii. When the ascending first delivery unit 2 arrives at the home position, that is, the position where the unit 2 faces the upper pair of sheet material discharging rollers 13, the rotation of the vertical movement motor $M_1$ is stopped; the rotational speed of the sheet conveying motor $m_1$ is switched back to the normal rotational speed, that is, the speed before the speed is switched to the high speed; and the first delivery unit 2 waits to receive the next sheet material to be discharged from the upper pair of discharging rollers 13 (FIG. 21H).

By the time the first delivery unit 2 arrives at the home position, the trailing end of the sheet material $S_1$, the leading end of which has been delivered to the second delivery unit 4, is completely out of the first delivery unit 2.

Figure 22A:
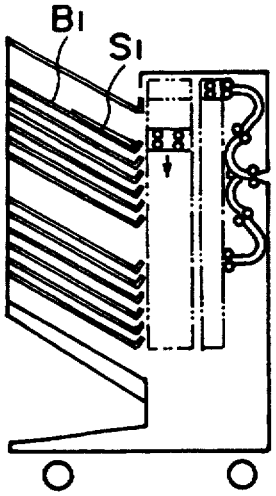
FIGS. 22A–22E present explanatory drawing for describing the operational sequence (for the second bin) of the embodiment of the sorter in accordance with the present invention.
Figure 22B:
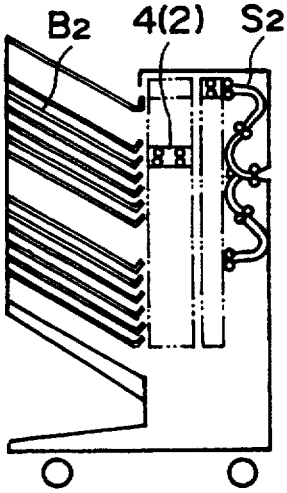
Figure 22C:
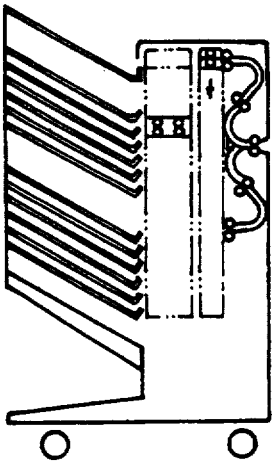
Figure 22D:
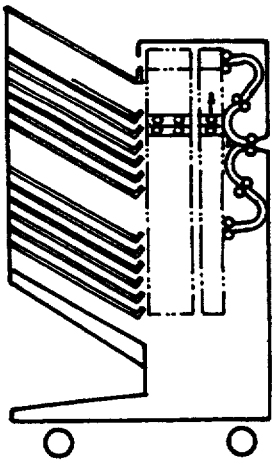
Figure 22E:
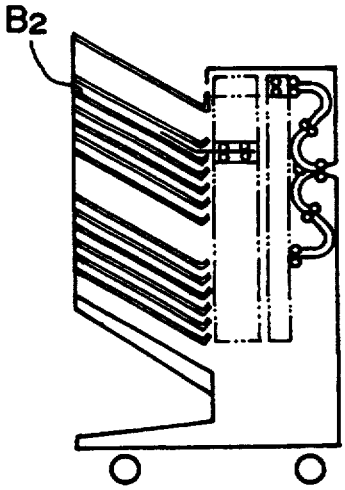
Figure 23A:
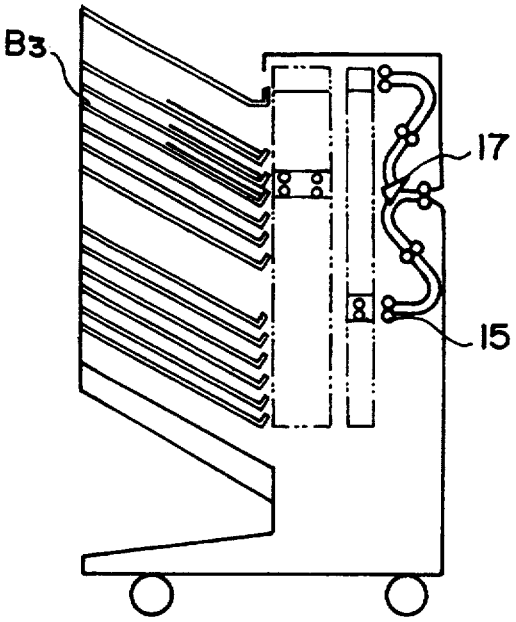
FIGS. 23A–23D present explanatory drawing for describing the operational sequence (for the third bin) of the embodiment of the sorter in accordance with the present invention.
Figure 23B:
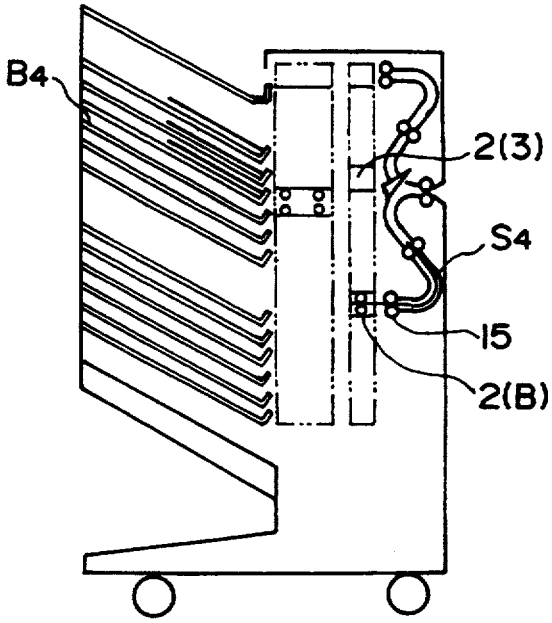

The speed V2, at which the first delivery unit 2 returns to the home position is, is preferred to be as high as possible. This is because the higher the speed is, the more time there will be for receiving the sheet material, assuring the reliable conveyance.

xviii. On the other hand, the sheet material $S_1$ given to the second delivery unit 4 is introduced into the uppermost bin $B_1$ which the second delivery unit 4 faces, by the forward rotation of the pairs rollers 44–45 and 44'–45' of the second delivery unit 4.

xix. When it is detected, by the sensors 49*a* and 49*b* which detect the passage of the trailing end of the sheet material $S_1$, that the sheet material $S_1$ is completely in the bin $B_1$, the vertical movement motor $M_2$ of the second delivery unit 4 is driven to rotate forward, whereby the second delivery unit 4 begins its descent in the same manner as was described before (FIG. 22A). It is also advantageous for this descent of the second delivery unit 4 to be made as fast as possible.

xx. As soon as the arrival of the descending second delivery unit 4 at a position, where the second delivery unit 4 is aligned with the sheet receiving opening of bin $B_2$ at the second level, is detected by the flag m and sensor 50 (FIG. 7), the forward rotation of the vertical movement motor $M_2$ is stopped, whereby the second delivery unit 4 is kept on standby while facing the sheet receiving entrance of the bin $B_2$ at the second level (FIG. 22B).

xxi. The second sheet material $S_2$ comes out of the main assembly 101 of the copying machine; is passed through the sheet pass; and is discharged from the upper pair of discharge rollers 13 to be introduced into the sorter 1.

xxii. The sequence comprising the same procedures as vii to xvii is repeated (FIG. 22C–FIG. 22E).

xxiii. Since, at this time, the second delivery unit 4 is in alignment with the second sorting bin $B_2$ from the top, the second sheet material $S_2$ is introduced into the second bin $B_2$.

xxiv. When it is detected, by the sensors 49*a* and 49*b*, that the second sheet material $B_2$ is completely in the bin $B_2$, the second delivery unit 4 descends in the same manner as was described in xix.

xxv. The second delivery unit 4 makes its descent to a position, where it becomes aligned with the sheet material receiving entrance of the next bin, that is, the third bin $B_3$ from the top, and there, it remains on standby. Then, a sequence comprising the same operations as were described before is repeated to deliver the sheet material to the bin $B_3$ (FIG. 23A).

Figure 23C:
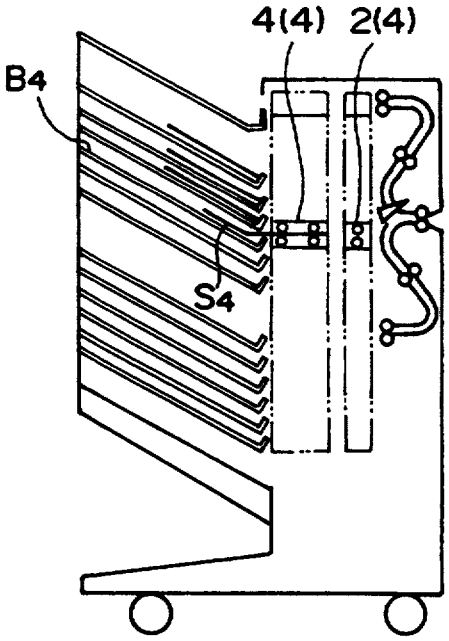

As soon as (or before) the second delivery unit 4 becomes aligned with the sheet material receiving entrance of the bin $B_4$, through the repetition of the above mentioned sequence, and takes the stand-by position, the deflector 17 is displaced in angle, whereby the sheet material $S_4$ is introduced into the second sheet passage 12, and then, is introduced into the first delivery unit 2 through the lower pair of discharge rollers 15. By this time, the first delivery unit 2 has moved to the lower home position 2(B) from the position (2(3)), where it was in alignment with the bin $B_2$ (FIG. 23A). Then, the sheet material $S_4$ is conveyed from the first delivery unit 2, which ascends for delivery, to the second delivery unit 4 by the repetition of the same sequence as the previous one (except that the sheet material $S_4$ is delivered from the bottom pair of delivery rollers 15), which in turn discharges the sheet material $S_4$ into the bin $B_4$ (FIG. 23C).

Figure 23D:
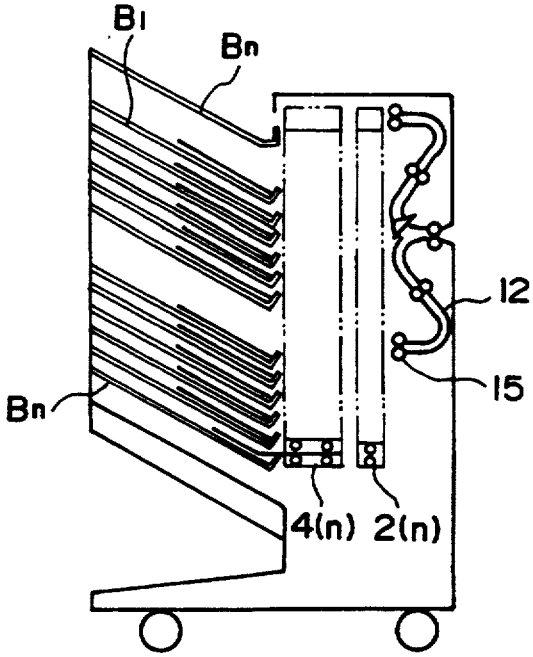

The above described sequence (the sequence using the second sheet passage 12) is repeated for $B_4$–$B_n$ in this order (FIG. 23D).

AS for the switching of the sheet passage by the deflector 17, it is made at the point, the maximum distances from which the first delivery unit 2 must travel to reach the upper pair of discharge rollers 13 and the bottom pair of discharge rollers 15 becomes substantially the same (FIG. 2).

In other words, for the sheet deliveries to $B_1$ to $B_3$, the upper pair of discharge rollers 13 (from $2_{(A)}$) to $2_{(3)}$) are used by the first delivery unit 2, wherein the maximum moving distance is $l_1$. For the sheet deliveries to B(4) to $B_n$, the lower pair of discharge rollers 15 ($2_{(4)}$ to $2_{(n)}$) are used by the first delivery unit 2, wherein the maximum moving distances from the lower pair of discharge rollers 15 become $l_2$ and $l_3$, respectively, and the sheet deliveries to $B_A$, $B_1$ to $B_n$ are made so as for the distances $l_1$, $l_2$, and $l_3$ to be proportioned substantially the same. This is because of the following reason. If there is only a single pair of discharge rollers, the distance the first delivery unit 2 must travel during the sheet intervals becomes longer, which translates into that the distance the first delivery unit 2 must travel to deliver all of the sheets S to all of the bins B become excessively long; therefore, if, for example, the main assembly of the copy machine is of a high speed type, the first delivery unit 2 must move at a very fast speed. Because of the above concern, two sheet passages are provided to reduce the moving distance of the first delivery unit 2, wherein the maximum moving distances from the upper and lower pairs of discharge rollers 13 and 15 are made substantially equal, whereby it becomes possible to reduce the maximum moving speed of the first delivery unit 2. In addition, the distances from the deflector 17 to the upper pair of discharge rollers 13 through the first sheet passage 11 and to the lower pair of discharge rollers 15 through the second sheet passage 12 are made to be substantially the same. This is because of the following reason. If one (11 or 12) is extremely short compared to the other, a next sheet arrives at the discharge opening of the shorter sheet passage while the first delivery unit 2 is still delivering a sheet, which comes through the longer sheet passage 12 or 11, to the second delivery unit 4, or before the sheet reaches the first delivery unit 2. Therefore, the sorting operation falls behind, and the main assembly of the copying machine may have to be stopped or the speed of the first delivery unit 2 may have to be further increased.

Thus, the sheet materials are sequentially sorted into a specific number of bins through the above described sequence of operations. For example, when it is necessary to collate n sets of copied sheets, each set comprising three sheets, if the sheets are sorted in the following manner, the collating operation is efficiently performed; the copies sheets of the first original are sorted into bins $B_1$ to $B_n$ (starting from the bin $B_1$) through the above described sequence of operations; next, the copied sheets of the second original are sorted into bins $B_n$ to $B_1$ (starting from the bin $B_n$); and then, the copied sheets of the third original are sorted into the bins $B_1$ to $B_n$ (again, starting from the bin $B_1$).

(B) Operational steps in a non-sorting mode (1) The same standby procedure as Ai–Aiii in the sorting mode are taken (at this time, specific non-sorting mode conditions are inputted through the console panel (Ai)). In this state, the first delivery unit 2 is at the position 2(A), where it is in alignment with the upper pair of discharge rollers 13, and the second delivery unit 4 is at the position 4(A), where it is in alignment with the sheet receiving opening of the non-sorting bin $B_A$.

(2) At the same time as, or after the completion of, the standby procedure Ai–Aiii for the sorter 1, the original 206 is delivered onto the platen glass 107 of the main assembly 101 of the copying machine, by the automatic original feeding apparatus 102, when the main assembly of the copying machine begins to operate.

(3) Substantially at the same time, the sheet material conveying motors $m_1$ and $m_2$ of the first and second deliver units 2 and 4, respectively, are driven forward, whereby the pairs of rollers 24–25, 45—45, and 44'–45' are rotated forward, becoming prepared for receiving the sheet material.

(4) The first sheet material $S_1$ discharged after an image is formed on it by the main assembly of the copying machine is taken in through the entrance 10; is guided into the first sheet passage 11 by the deflector 17 which has been displaced in angle during the standby procedure; and is introduced into the first delivery unit 2 through the upper pair of discharge rollers 13.

(5) The introduced sheet material $S_1$ enters between the upper and lower guiding plates 22—22 of the first delivery unit 2 being on standby at the home position, where it is in alignment with the upper pair of discharge rollers 13, where the leading end of the sheet material $S_1$ is guided into the nip formed between the pair of rollers 24–25, by the guiding plates 22—22.

(6) Since the pair rollers 24–25 are rotating forward, the sheet material $S_1$ is conveyed straight forward, between the guiding plates 22—22, into the space between the guiding plates 42—42 of the second delivery unit 4, in which it is conveyed forward by the pairs of rollers 44–45 and 44'–45' to be discharged into the non-sorting bin $B_A$.

Figure 24:
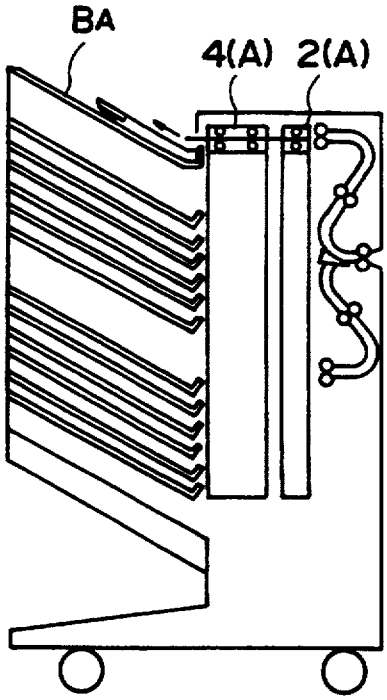
FIG. 24 is an explanatory drawing describing the non-sorting operation of the embodiment of the sorter in accordance with the present invention.

With presence of such an arrangement, in the non-sorting mode, not only it is unnecessary to move the first and second delivery units 2 and 4 as in the sorting mode, but also, it is unnecessary to activate and deactivate the pairs of rollers (FIG. 24).

Figure 25:
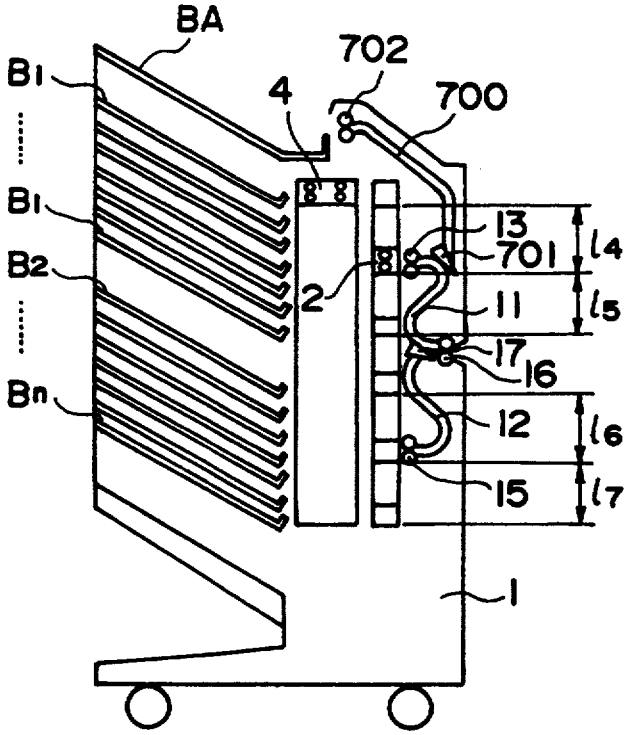
FIG. 25 is a sectional front view of another (sixth) embodiment of the sorter in accordance with the present invention.

Hereinbefore, the present invention was described referring to an embodiment in which two sheet passages (11 and 12) are provided. However, a non-sorting sheet passage 700 as shown in FIG. 25 may be provided, wherein in the non-sorting mode, the sheet material S is guided into the non-sorting sheet passage 700 which branches out of the first sheet passage 11, and is discharged into the non-sorting bin $B_A$ from a pair of non-sorting rollers 702 after passing through the non-sorting sheet passage 700. Also in this arrangement, the distances to be travelled by the first delivery unit 2 in the sorting mode are made to be substantially equal ($l_4 \approx l_5 \approx l_6 \approx l_7$). In other words in the case of the bins $B_1$–$B_f$, the first delivery unit 2 receives the sheet material from the upper pair of discharge rollers 13 and travels upward or downward the distances of $L_4$ or $L_5$ to hand over the sheet to the second delivery unit 4 waiting on standby at the sheet receiving opening of a specific bin. In the case of the bins $B_g$–$B_n$, the first delivery unit 2 receives the sheet material from the bottom pairs of discharge rollers 15 and travels upward or downward the distances of $l_6$ or $l_7$ to deliver the sheet to the second delivery unit 4 being on standby at the sheet receiving opening of a specific bin. Also in this arrangement, the lengths of the first and second sheet passages are made to be equal because of the same reason as was previously described (distances from 16 to 13 and 15). This arrangement can reduce the length of the maximum distance the first delivery unit 2 must travel, assuming that the number of bins in the sorter remains the same.

In other words, in the preceding embodiment, a position, where the first delivery unit 2 comes into alignment with the non-sorting bin $B_A$, that is, the uppermost bin, is selected as the home position for the first delivery unit 2, and therefore, the first delivery unit 2 can move only downward. However, in the embodiment shown in FIG. 25, it is possible for the first delivery unit 2 to move upward or downward from the position corresponding to the upper or lower pairs of discharge rollers 13 or 15, and therefore, the length of the maximum distance the first delivery unit 2 must travel can be reduced, which in turn, enables the sorter to be compatible with a high speed copying machine. Incidentally, it is needless to say that a sorter to be matched with a low speed copying machine may be provided with only a single sheet passage. This is apparent from the previously described reason.

Thus, the sheet materials are sorted into each of the bin B. Next, the jogging and the post-processing of the sheet materials will be described, referring to the upper group X of bins (FIGS. 6 and 7).

After the sheet material S is discharged into the bin B from the second delivery unit 4, the sheet material S slides down, due to its own weight, toward the rear end stopper $B_t$ of the bin B which is tilted, with the rear end stopper $B_t$ becoming the lower end. Then, as shown in FIG. 6, the jogging member 438 is moved a predetermined distance (position (RI)) which corresponds to the sheet material size, from a standby position (CHI), in the direction indicated by an arrow E, by an unshown pulse motor of the like, in response to a pulse signal, whereby the lateral side $S_s$ of the sheet material S is jogged against the jogging reference wall 450, causing thereby the other lateral side of the sheet material S, which is opposite to the side pushed by the jogging member 438, to be moved from a position (HO), where the sheet material S settles after being discharged from the second delivery unit 4, to a position (HE). Then, the jogging member 438 returns to the standby position (CHI) to be prepared for the next sheet material S to be discharged.

The above described sequence is repeated each time the sheet material S is discharged or after all of the sheet materials S are sorted into all of the bins $B_1$–$B_f$, whereby two or more sheet materials S in a single bin B are all jogged against the jogging reference wall 450 and the bin stopper $B_t$, being thereby jogged. Since the jogging member 438 is penetrating through all the bins $B_1$–$B_f$, the sheet materials S deposited in each of bins $B_1$–$B_f$ are also jogged in the same manner. In this embodiment, the bins are divided into two groups X and Y, for which jogging members 438 and 438' are separately provided, respectively, and therefore, when a number of sets exceeds a number of the upper group of bins, the same jogging operation as the above is carried out for the lower group of bins. As for the operation for binding the sheet materials discharged into the bin B, it is optional, and unless a binding mode is selected, the operation of the sorter 1 ends once at this point.

Figures 8A, 8B, 8C, 8D:
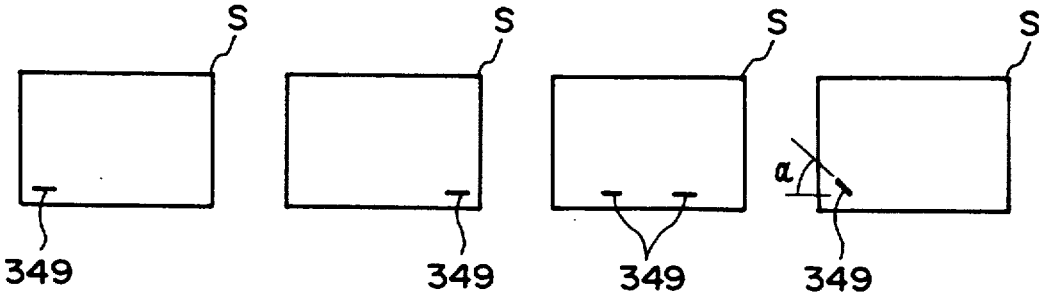
FIGS. 8A, B, C and D are a schematic drawing for indicating the locations at which the sheets are stapled.

Next, a case in which a binding mode is selected will be described. In this embodiment, an operator can choose one of three binding options; the sheet materials are bound by a binding staple at a single point on the front side (FIG. 8A), a single point on the rear side (FIG. 8B), or two points substantially toward the lateral center, of the sheet materials (FIG. 8C). In addition, the sheet materials can be bound at an angle $\alpha$ by rotating the stapler 200 (in the direction indicated by an arrow 285 in FIG. 6), as shown in FIG. 8D.

Here, a single point binding on the front side of the sheet material S will be described. With the selection of the binding mode, the stapler supporting unit 290 is caused to ascend or descends to a position where it becomes aligned with a specific bin B, by the driving means described before, after the sheet materials S are completely sorted into the bins and jogged there. In this embodiment, the home position for the stapler unit is selected to be a position $P_1$ in FIG. 6 which is also in alignment with the bin $B_1$. Therefore, when a bundle of sheets S in the bin $B_1$ are to be bound, the stapler supporting unit 290 is not moved vertically. Next, the stapler unit 250 holding the stapler 200 is driven to $P_2$ from the home position $P_1$ by the driving means, as shown in FIG. 6.

Figure 11:
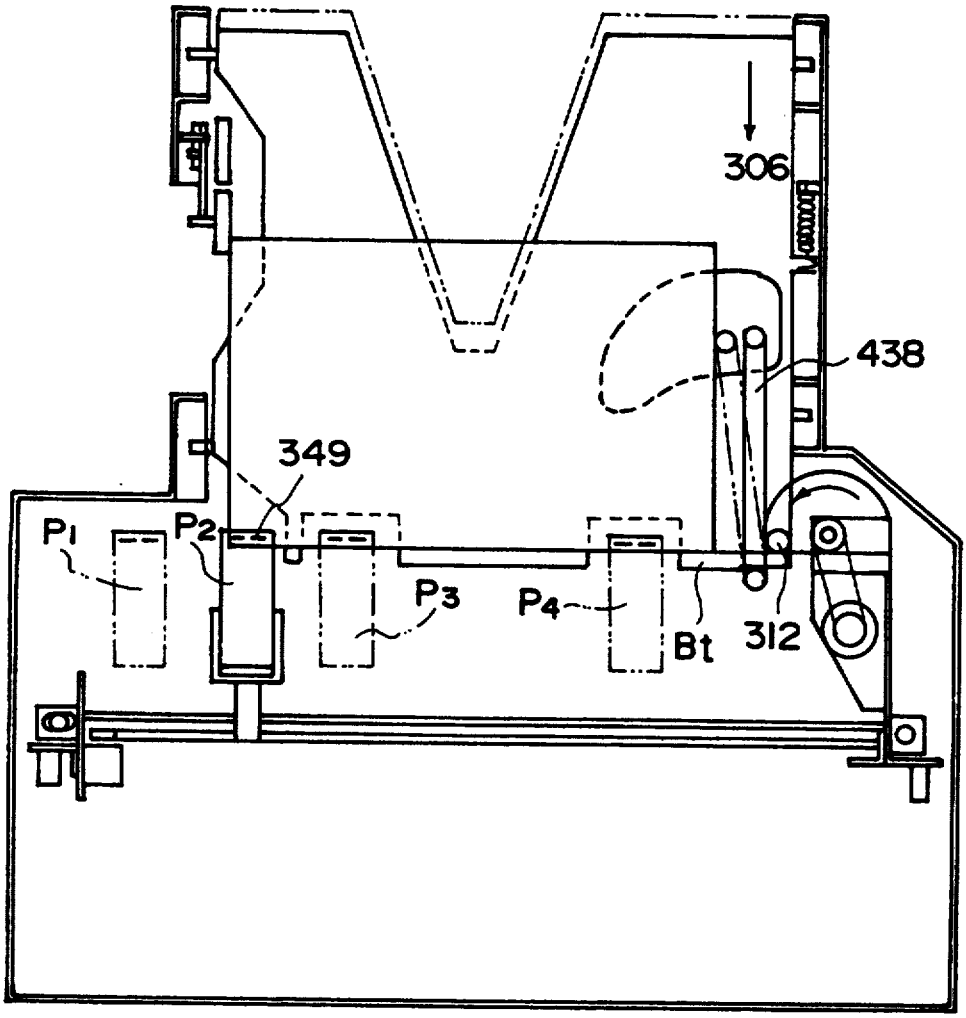
FIG. 11 is a plan view of the main structure of the sorter shown in the preceding drawings.

When it is detected by a detecting means that the stapler unit 250 completes its movement, the bin moving means 310 is driven, whereby the bin pushing member 312 is engaged with the bin stopper $B_t$ of the bin $B_1$, displacing the bin in the direction indicated by an arrow 306 as stated before. As a result, the end of sheet S moves to a predetermined stapling location. Then, the electric stapler 200 is driven in response to a binding permit signal issued from the controlling means, whereby the staple 349 is stricken into the sheet material S as shown in FIG. 11. After the staple 349 is stricken into the sheet material S, the bin moving means 310 is rotated in reverse to resume the original state (FIG. 6), whereby the bin B returns to the original location, which concludes the binding operation for the specific bin B.

When the binding operation is carried out for two or more bins B, the stapler supporting unit 290 is moved downward, being stopped each time it becomes aligned with one of the bins, while the positioning of the stapler unit 250 in the arrow 201 direction is kept unchanged, and each time it comes into alignment with the bin, the bin is pulled out and the sheet materials S are stapled.

As for the bin position detecting means, such a detecting device as is used in the above mentioned second delivery unit 4 (combination of a flag provided on the bin, and a photocoupler) will suffice.

When the sheet materials S are to be bound at the single point on the rear side, the stapler unit 250 is positioned at a location $P_4$ (FIG. 6). In the case of the two point binding, all needed is to control the stapler unit 250 to be moved to a location $P_3$, where the first binding is carried out, and then, to a location $P_4$, where the sheet materials are bound for the second time.

In this case of two point binding, the stapling may be done in the following manner; first, the stapler supporting unit 290 is moved upward or downward across the bins, the number of which corresponds to the necessary number of sheet material sets, while stapling them at the location $P_3$, and then, after the stapler unit 250 is moved to the location $P_4$, it is moved in reverse (downward or upward) while stapling them at the location $P_4$, this time. Needless to say, after the sheet materials in one bin are bound at the location $P_3$, the stapler unit 250 may be moved to the location $P_4$ to staple the same sheet materials, and then, the stapler supporting unit 290 may be moved upward or downward to next bin to repeat the two point binding. Further, in this embodiment, only a single stapler is employed for the stapling operation. However, it is of course acceptable to place two stapler units 250 at the location $P_1$, wherein only a single staple is used for the single point binding, but both stapler units 250 are moved in the arrow 201 direction in the case of the two point binding.

Figure 26C:
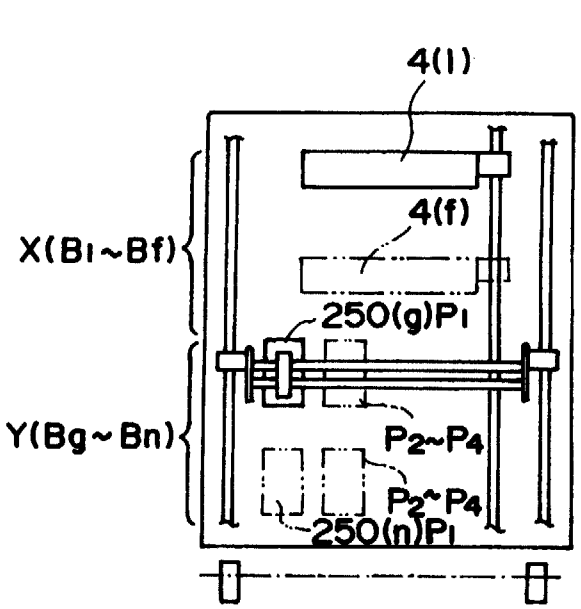
FIGS. 26A–26C present explanatory drawing for describing the operational sequences for the embodiments of the delivery unit and the stapler unit in accordance with the present invention, with reference to a sectional line X—X in FIG. 6.
Figure 26B:
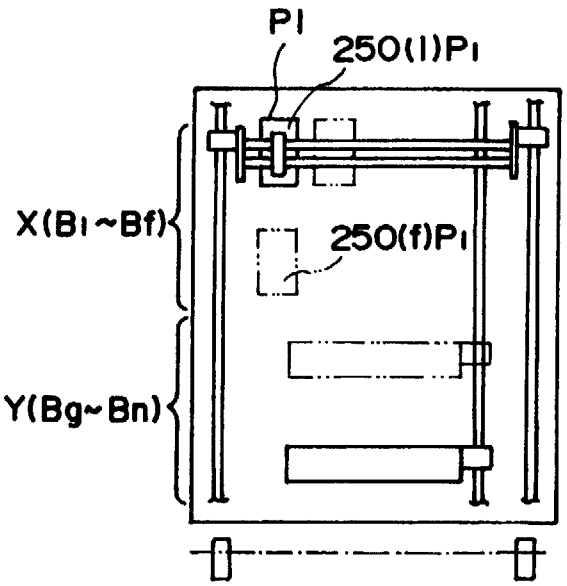
Figure 26A:
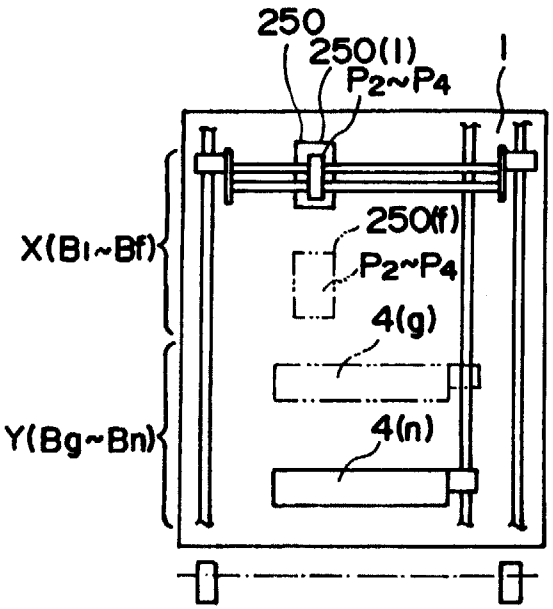

Further, when the stapling unit is in operation, the second delivery unit 4 is at a location where it does not interferes with the stapling operation. For example, while the stapler unit 250 is stapling the sheet materials in the bins $B_1$–$B_f$ belonging to the upper bin group X (stapler unit 250 is at one of the locations 250(1)$P_2$–250(f)$P_4$), the second delivery unit 4 is at one of the locations 4(*g*)–4(*n*) which correspond to the bins $B_g$–$B_n$ belonging to the lower bin group Y (FIG. 26A). When the second delivery unit 4 must be moved to the upper bin group X side so that the stapler unit 250 can come out of the above mentioned state to be moved to process the sheet materials in the bins belonging to the lower bin group, the stapler unit 250 is moved, first, to the position $P_1$ (FIG. 26B); then, after the second delivery unit 4 is moved upward to the upper bin group ($B_1$–$B_f$) side, the stapler unit 250 is moved to the lower bin group Y side (or both units may be moved at the same time); and next, the stapler unit 250 is moved to one of the positions $P_2$–$P_4$. In this way, both unit can be moved without interfering with each other (FIG. 26C).

In an operation reverse to the above operation (the stapler unit is moved from the lower bin group side to the upper bin group side, and the second delivery unit 4 is moved from the upper bin group side to the lower bin group side), it is only necessary to follow the above described sequence in reverse after moving the stapler unit to the position $P_1$.

Referring to FIGS. 12 and 13, after the completion of the jogging operation or jogging-stapling operation, the jogging reference wall 450 is moved by the driving means from the position 450A to the position 450B, and the jogging member 438 is moved to a position (NU), whereby the end $S_{(s)}$ of the sheet material S is moved from a position (HE) to a position (TO). As a result, the sheet material S can be easily picked out, from the front side (in the direction indicated by an arrow 460).

In this embodiment, the bins are divided into the upper bin group X and the lower bin group Y, whereby even while the sheet materials in the upper bin group X are jogged and/or going through the post processing, the sheet materials in the lower bin group Y can be pushed out all at once.

Figure 19:
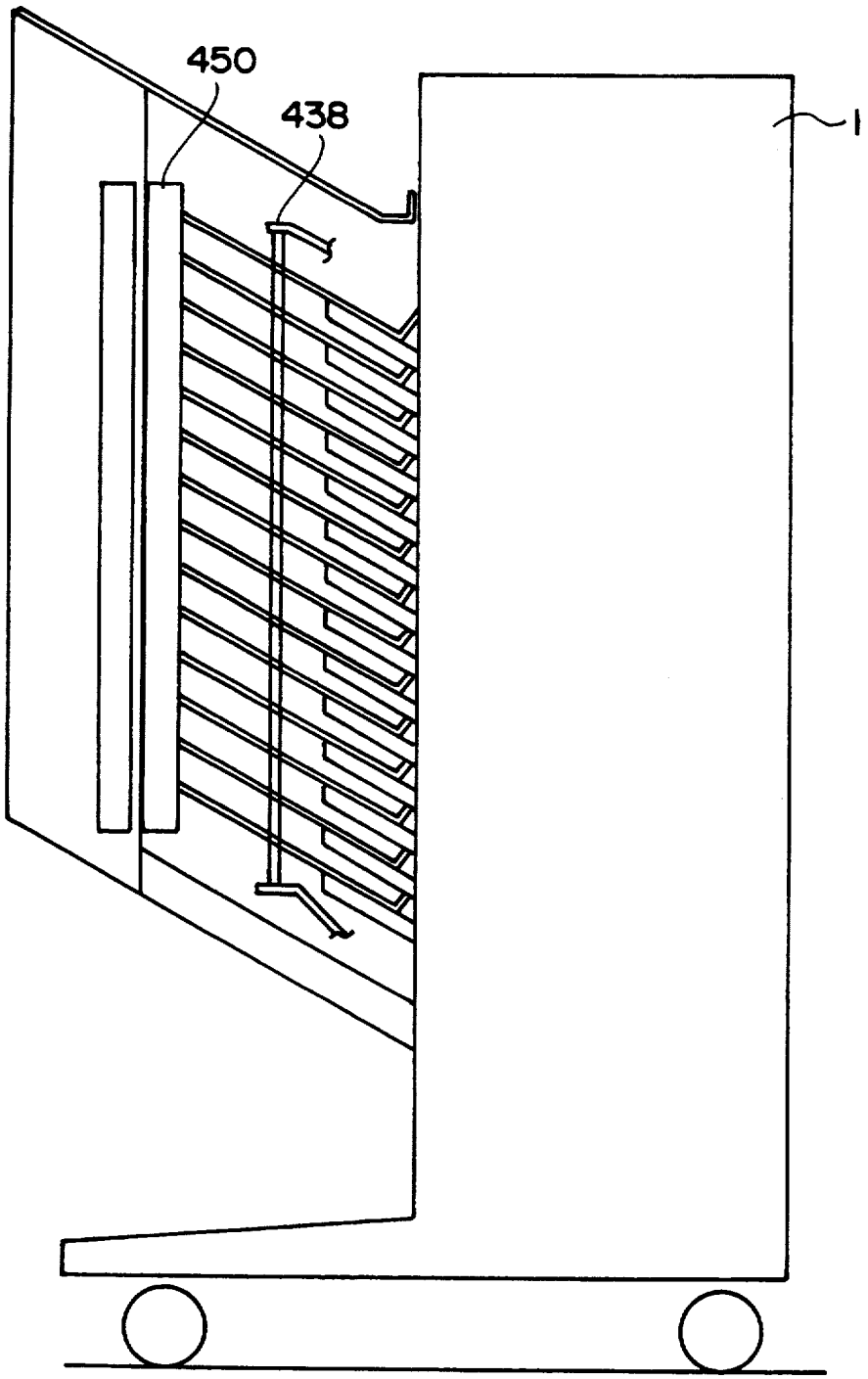
FIG. 19 is a front view of another (third) embodiment of the sorter in accordance with the present invention.

Hereinbefore, the embodiment of the present invention was described referring to the case in which the bins $B_1$–$B_n$ are structured into two groups. However, it is needless to say that such a structure as is shown in FIG. 19, in which only a single jogging member 438 and a single jogging reference wall 450 are provided (structure in which the bins are not grouped), may be employed, or the bins may be divided into three or more groups.

Also, in the embodiment described above, the jogging reference wall 450 was provided on the front side of the bin, and the jogging member 438 was on the rear side. However, two jogging members may be used.

Figure 20A:
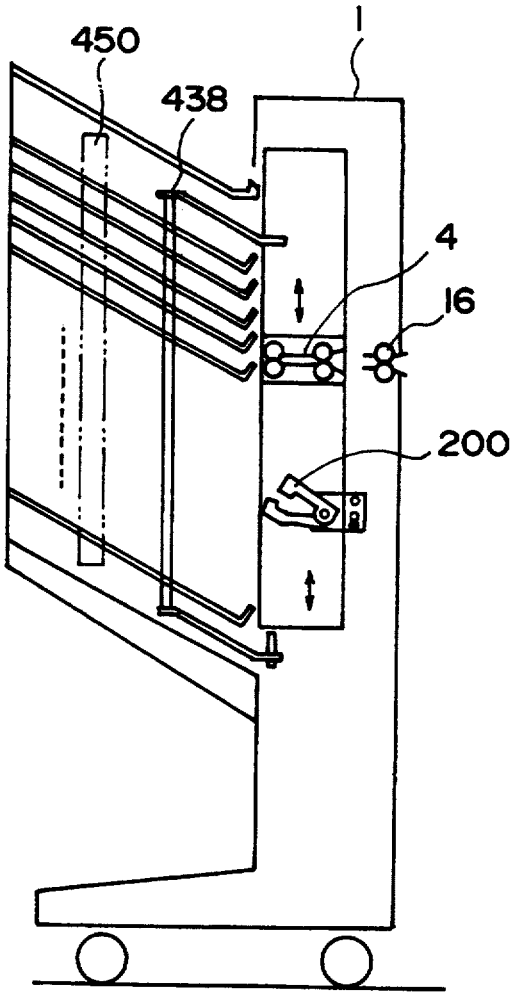
FIG. 20A presents a front view of a sorter according to an additional (fourth) embodiment.

Also, the embodiment of the present invention was described referring to the sorter having two delivery units. However, a sorter having only a single delivery unit is of course acceptable (FIG. 20(A).

Further, in this embodiment, the position $P_1$ where the stapler 200 retreats is on the front side of the sorter. However, it may be on the rear side.

Figure 20B:
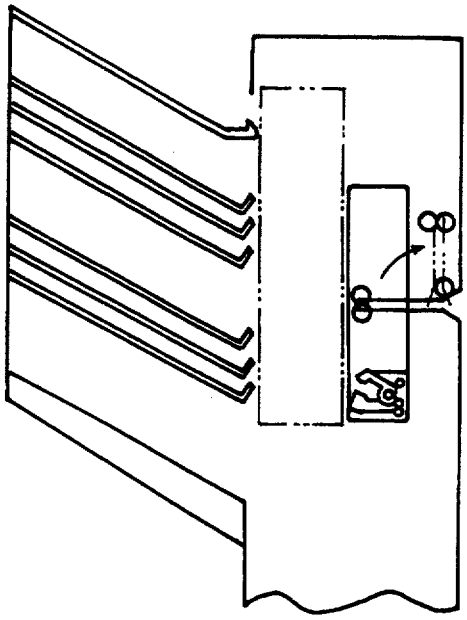
FIG. 20B is a partial front view of a sorter of another (fifth) embodiment.

Also, the position $P_1$ may be set up for the pair of discharge rollers, wherein the pair of discharge rollers retreat when the stapler 200 makes vertical movements (FIG. 20B).

Next, a case, in which a stacker 600 is provided in the sorter 1, will be described, referring to an operation for taking the sheet S out of the bin B (FIGS. 14, 15, and 16). This stacker 600 comprises a sheet receiving tray 606 which vertically moves to a specific bin and receives the sheets from it, a sheet stopper wall 630, and a pair of rollers 602 and 603 for taking the sheet out of the bin. This pair of rollers can be moved in the direction indicated by arrows O and P, by an unshown driving means. An arm 603*b* supporting the roller 603 by a central shaft 603*a* can be rotated by an unshown driving means, in the direction indicated by arrows Q and R. Referring to FIGS. 12 and 13, after the jogging reference wall 450 (450') retreats toward the front side, and the sheet material S is moved toward the front side by the jogging member 438 (438'), whereby the end of the sheet material sticks out of the bin edge, as was described before, Then, in order to take out a bundle of sheet materials from each of the bins B, the pair of rollers 602 and 603, and the tray 606 move to the location of the specific bin in the manner described above.

After the pair of rollers 602 and 603 and the tray 606 move to a position where they become aligned with a specific bin B, the pair of rollers 602 and 603 is moved a predetermined distance in the arrow O direction from a position where it is in a state depicted by reference numerals 602 and 603' (the pair of rollers is open), to another position where it is in another state depicted by reference numerals 602' and 603''', being ready for grasping the sheet S). Then, the arm 603*b* is pivoted in the direction indicated by an arrow R, gripping the sheet S as depicted by reference numerals 602' and 603'', and the pair of rollers is moved back in the arrow P direction in this state (back to the state depicted by the reference numerals 602 and 603). At this time, the pair of rollers are rotated in the direction indicated by an arrow U, whereby the sheet is conveyed into the receiving tray 606, and is accumulated there. After this operation, the pair of rollers 602 and 603, and the tray 606 are moved to the next specific bin in order, and so on, wherein this operation is repeated till the sheets S in all the bins B are taken out.

As for the sorting in the receiving tray 606, either the tray itself may be moved in the alternate direction indicated by an arrow H for each set of sheets S, or the position to which the sheets S are discharged by the pair of rollers 602 and 603 may be alternately changed for each set of the sheets S (stopping position in the arrow P direction is changed).

The tray 606 gradually shifts in the direction indicated by an arrow V due to the weight of the accumulated sheets S. When the sheet S is discharged into the tray 606, there is a possibility that the uppermost sheet S of the sheets S accumulated in the tray 606 moves (shifts) with the sheet being currently discharged on top of it, but this possibility can be eliminated by providing a retractable sheet holding member which presses the accumulated sheets from above, only while the sheet is discharged into the tray.

In the above embodiment, the sheet S is transferred from the bin B to the tray 606, using a pair of rollers. However, such an arrangement that the sheet S is taken out using a gripper or the like is of course acceptable.

Figure 17:
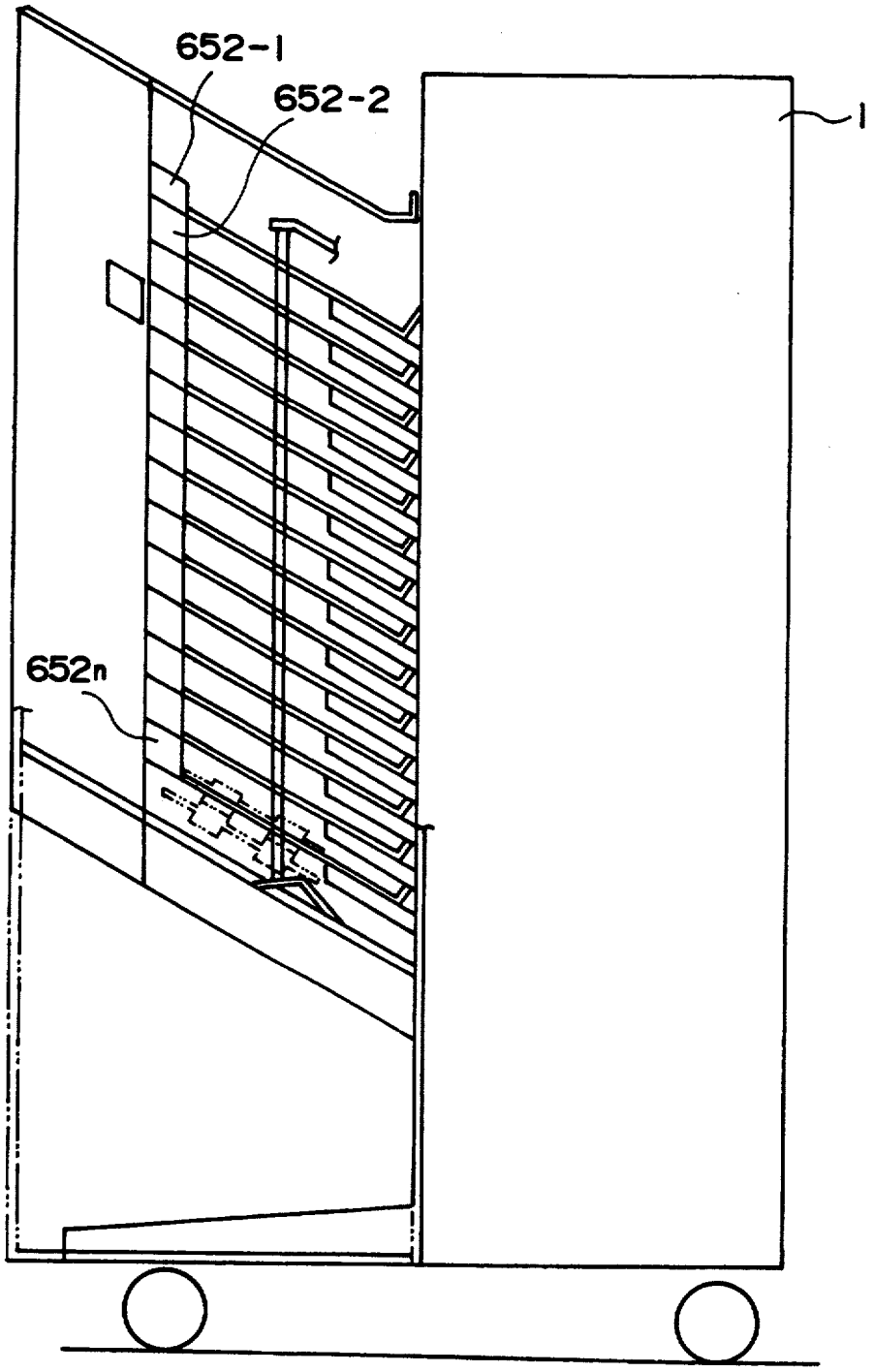
FIG. 17 is a front view of another (second) embodiment of the sorter (provided with the stacker) in accordance with the present invention.
Figure 18:
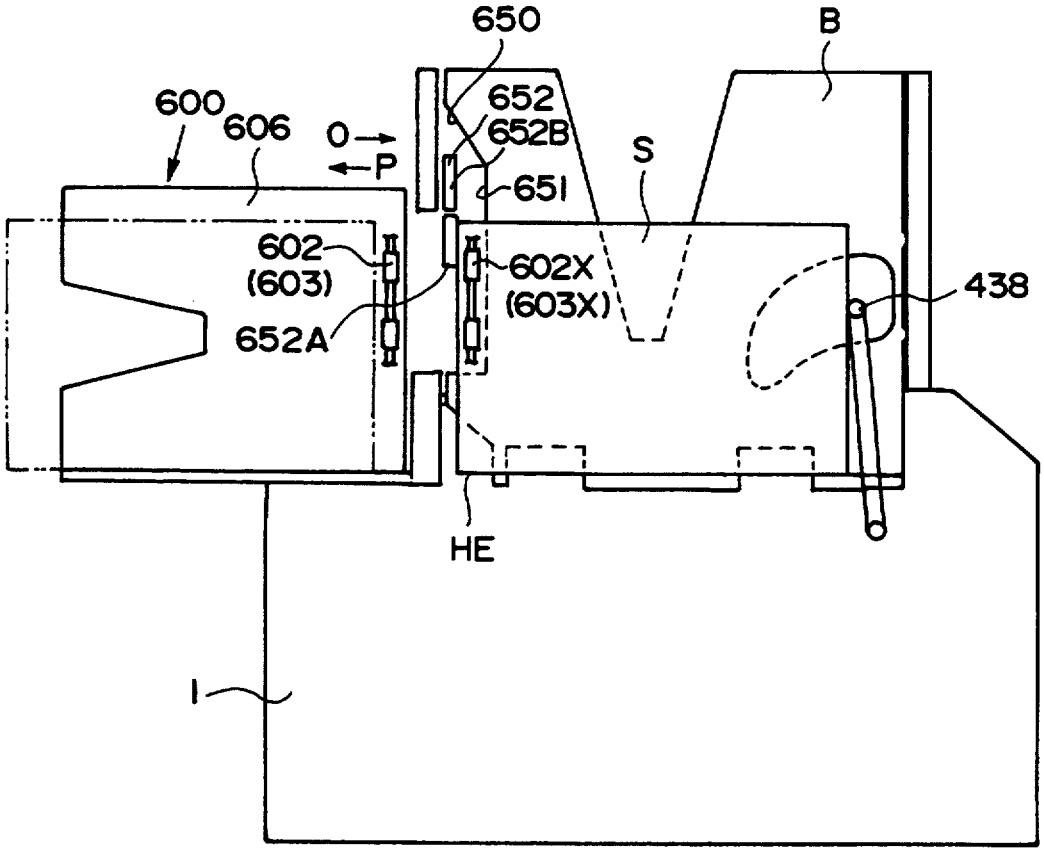
FIG. 18 is a plan view of another (second) embodiment of the sorter (provided with the stacker) in accordance with the present invention.

FIGS. 17 and 18 shows an embodiment of a stacker arrangement in which the jogging (aligning) member 438 does not push the sheet S within the bin B to cause the sheet to stick out of the bin B, to be picked out, but instead, it gets the sheets S ready to be transferred onto the stacker, from which the sheets can be taken out from the front side. Since the details of this arrangement are the same as those of the stacker discharge operation, the detailed description of this arrangement will be omitted.

The bin B has a cutout 650 on the side from which the sheet is to be taken out; therefore, during the jogging operation, the sheet S projects beyond the bin edge 651. Then, the pair of rollers 602 and 603 moves in the O direction as described before, invades into the cutout 650 (602*x*, 603*x*), grips the sheet S, and moves back in the P direction, whereby the sheet S is accumulated into the tray 606.

The jogging reference wall 652 is provided in each bin ($652_1$–$652_n$), and when the sheet is taken out, only the jogging reference wall 652 of the specific bin from which the sheet is to be taken out can be moved from a position 652A (jogging position) to a position 652B (open position), by a driving means. Therefore, even while the sheets are taken out from this specific bin, the sheets in the other bins can be stapled or jogged.

Hereinafter, the control sequences of an embodiment of the present invention will be described in detail, referring to flowcharts in FIGS. 27 to 44.

For the sake of convenience of description, the following terms will be adopted.

Carriage 2: First delivery unit 2

Conveying motor 2: Sheet material conveying motor $m_1$

Pass sensor 2: Sheet material presence detecting sensors 29*a* and 29*b*

Carriage 1: Second delivery unit 4

Conveying motor 2: Sheet material conveying motor $m_2$

Pass sensor 1: Sheet material presence detecting sensors 49*a* and 49*b*

Sheet picking roller: Sheet picking rollers 602 and 603

Sheet accumulator tray: Sheet receiving tray 606

Figure 27A:
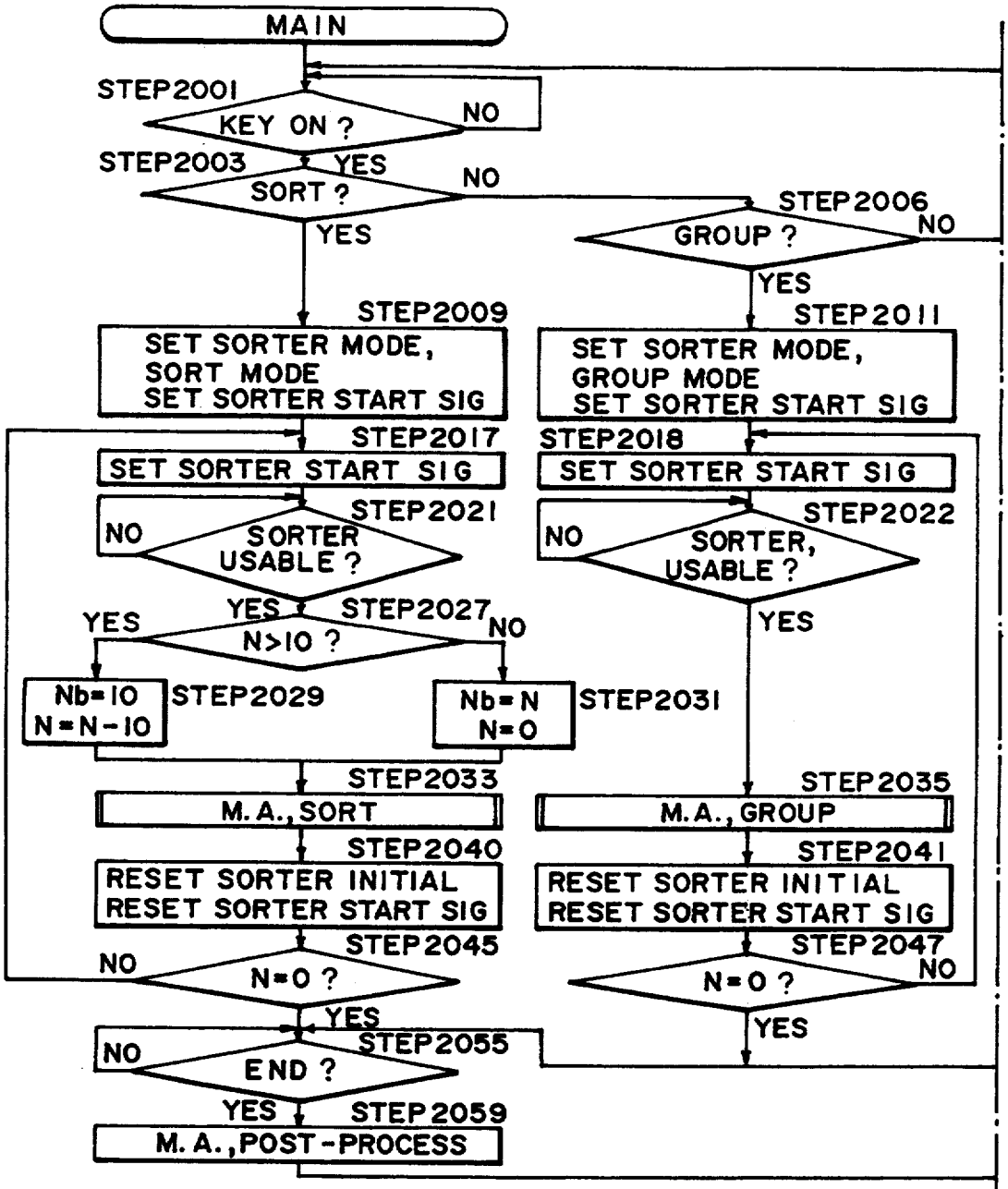
FIG. 27 which consists of FIGS. 27A and 27B, is a flow chart for controlling the main assembly of the copying machine.
Figure 27:
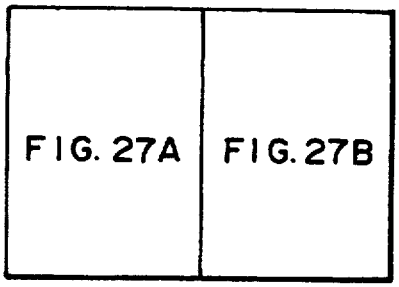
Figure 27B:
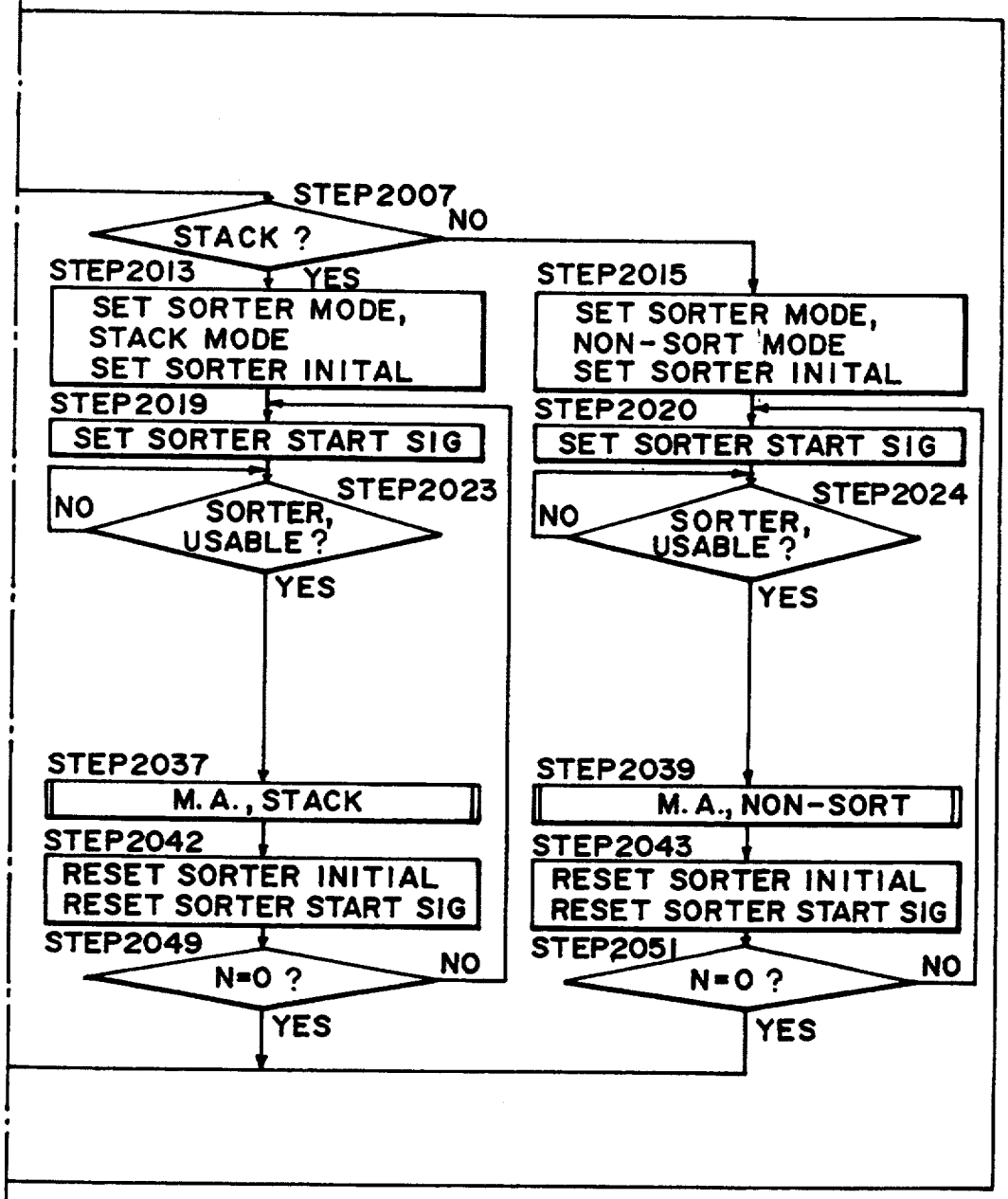
Figure 28:
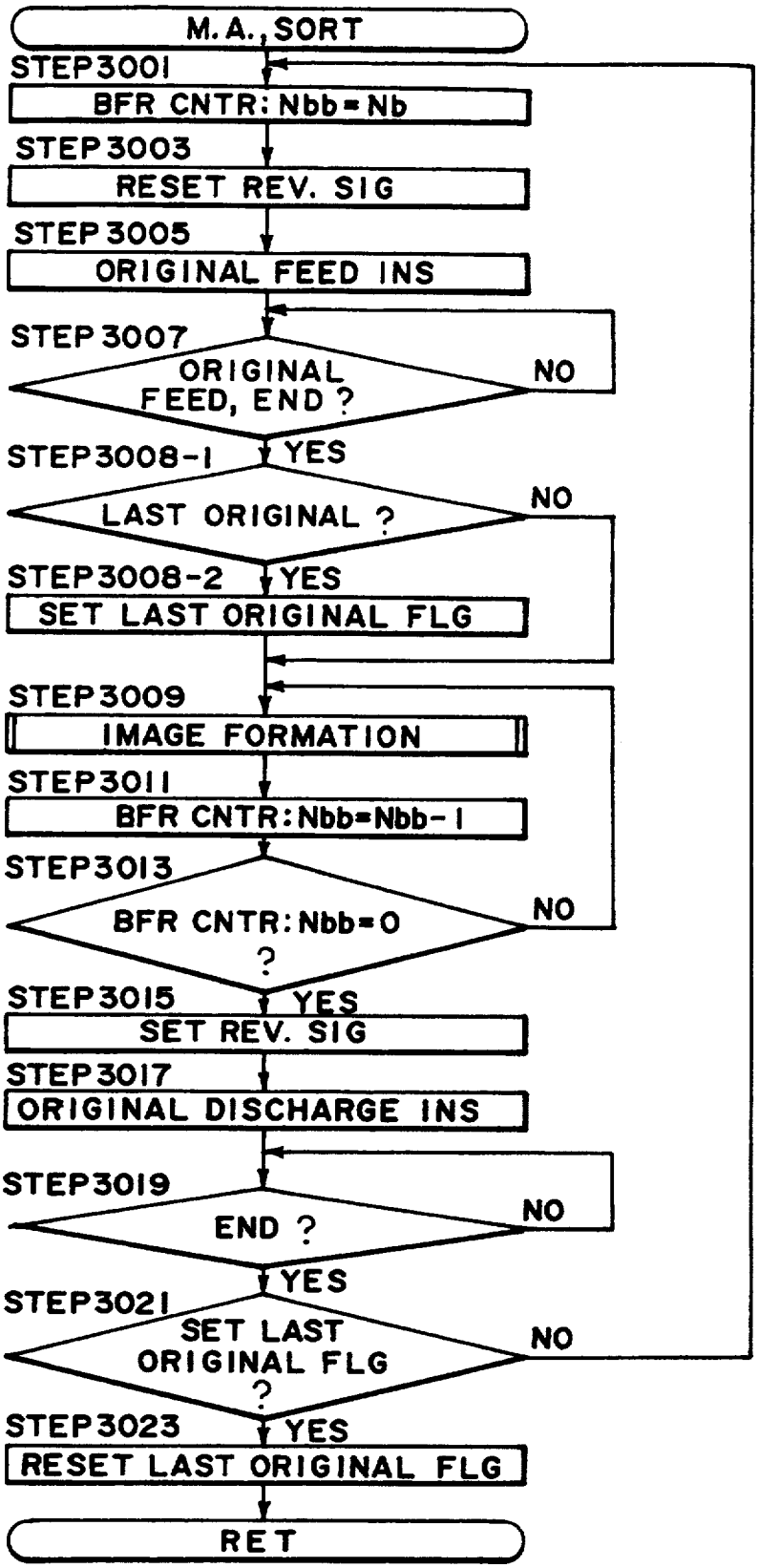
FIG. 28 is a flow chart for a sorting operation.
Figure 29:
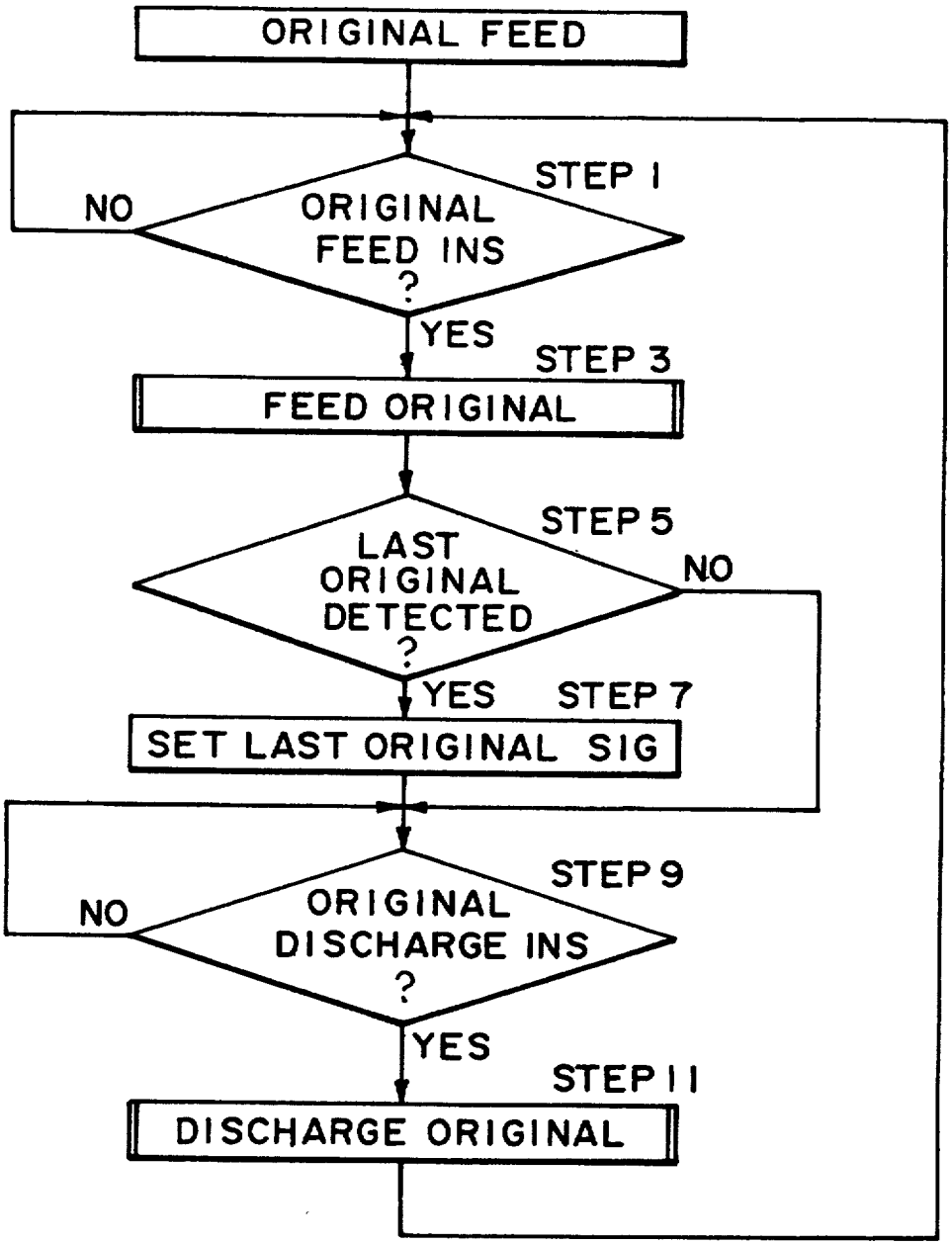
FIG. 29 is a flow chart for feeding an original.

First, the controls in this embodiment are divided into an image forming apparatus control, automatic original feeding apparatus control, post-processing apparatus (hereinafter, sorter) control, and sheet bundle storing apparatus (hereinafter, stacker) control, wherein FIGS. 27 and 28 show the flowchart for the image forming apparatus; FIG. 29, the automatic original feeding apparatus; FIGS. 30 to 43, the sorter; and the FIG. 44 shows the stacker.

MAIN ASSEMBLY

The operation of the image forming apparatus will be described referring to FIGS. 27 and 28, wherein FIG. 27 refers to the main program of the image forming apparatus, and FIG. 28 refers to the sub-routines of the image forming apparatus.

Main program for the main assembly

Referring to FIG. 27, first, the control waits for an ON-signal which indicates the initiation of the image forming operation, and upon receiving the ON-signal, Step 2003 is taken (step 2001). In Step 2003, it is detected whether or not a selected mode is a sorting mode, and if it is the sorting mode, the program proceeds to Step 2009 where the actual sorting mode begins, and if not, Step 2005 is followed, The operational mode is discriminated in Step 2005 and Step 2007 in the same manner, and if it is a grouping mode, Step 2011 is followed, and if it is a stacking mode, Step 2013 is taken. Otherwise, the mode is a non-sorting mode, and therefore, Step 2015 is followed.

In Step 2009, the sorting mode is selected as the operational mode of the sorter, and a sorter initialization signal is set to initialize the sorter (step 2009). Next, a sorter start'signal is set to indicate the start of the sorter operation (Step 2017). Then, as soon as the sorter enters a standby state (Step 2021), the program proceeds to Step 2027. In Step 2027, it is detected whether or not a value set for the number of copies (hereinafter, counter value: N) through a control panel of the main assembly is not more than 10. If it is not more than 10, the program proceeds to Step 2031. Otherwise, it proceeds to Step 2029. In Step 2029, a value 10 is set as the copy count counter (: Nb) for the image formation as the first job, and 10 is subtracted from the counter value. In Step 2031, the counter value is set as the copy count counter (: Nb) for the image forming operation as the first job, whereby the counter value is cleared. Then, in Step 2033, the sorting operation in the main assembly, which will be described later, is carried out. As soon as the sorting is completed, the sorter initialization signal and the sorter start signal are reset. Then, counter value is checked in Step 2045. If it is 0, the program proceeds to Step 55 where the program waits for the completion of the operation (Step 2045). Afterward, the post operation routines such as clearing the memories or stopping the driving systems are run (Step 2059). Then the program returns to Step 2001. When the counter value is not 0 in Step 2045, the program again proceeds to Step 2017. At this time, the sorter initialization signal for initializing the sorter is not set since the operation is continued from the first job. Following such a sequence, the operation is continued till the counter value becomes 0.

In Step 2011, the grouping mode is selected as the operational mode of the sorter, wherein the sorter initialization signal for initializing the sorter is set, and in Step 2018, the sorter start signal to indicate the start of the sorter operation is set. Then, as soon as the sorter enters the standby state (Step 2022), the program proceeds to Step 2035. In Step 2035, the main assembly grouping operation is carried out. Immediately after the completion of the operation, the sorter initialization signal and the sorter start signal are reset (Step 2041). Then, in Step 2047, the counter value is checked. When it is 0, the program proceeds to Step 2055 where it waits for the completion of the operation. After the completion of the operation, the post-operation routines such as clearing the memories or stopping the driving systems are run (Step 2059), and then, the program returns to Step 2001. When the counter value is not 0 in Step 2047, the program again proceeds to Step 2018. Through such a sequence as the above, the operation is continued till the counter value becomes 0. Since the grouping operation of the main assembly is substantially the same as the sorting operation of the main assembly, the detailed description is omitted.

In Step 2013, the stacking mode is selected as the operational mode of the sorter, where the sorter initialization signal for initializing the sorter is set, and in Step 2019, the sorter start signal indicating the start of the sorter operation is set. As soon as the sorter enters the standby state (step 2023), the program proceeds to Step 2037. In Step 2037, the stacking operation of the main assembly is carried out. Immediately after the completion of the operation, the sorter initialization signal and the sorter start signal are reset (Step 2042). Then, in Step 2049, the counter value is checked. When it is 0, the program proceeds to Step 2055 where the program waits for the completion of the operation. After the completion of the operation, the post-operation routines such as clearing the memories or stopping the driving systems are run (Step 2059), and then, the program returns to Step 2001. When the counter value is not 0 in Step 2049, the program again proceeds to Step 2019. Through such a sequence as the above, the operation is continued will the counter value becomes 0. Since the stacking operation is substantially the same as the sorting operation of the main assembly, the detailed description is omitted.

In Step 2015, the non-sorting mode is selected as the operational mode of the sorter, where the sorter initialization signal for initializing the sorter is set, and in Step 202, the sorter start signal indicating the start of the sorter operation is set. As soon as the sorter enters the standby state (Step 2024), the program proceeds to Step 2039. In Step 2039, the non-sorting operation of the main assembly is carried out. Immediately after the completion of the operation, the sorter initialization signal and the sorter start signal are reset (Step 2043). Then, in Step 2051, the counter value is checked. When it is 0, the program proceeds to Step 2055 where the program waits for the completion of the operation. After the completion of the operation, the post-operation routines such as clearing the memories or stopping the driving systems are run (Step 2059), and then, the program returns to Step 2001. When the counter value is not 0 in Step 2051, the program again proceeds to Step 2019. Through such a sequence as the above, the operation is continued till the counter value becomes 0. Since the non-sorting operation is substantially the same as the sorting operation of the main assembly, the detailed description is omitted.

Next, the sorting operation of the main assembly will be described referring to FIG. 28. First, a copy count counter (Nb) is entered in a copy count buffer counter (NNN) (Step 3001), and a sorter shift direction reversal signal is reset (Step 3003). Next, an original feed instruction is sent to the automatic original feeding apparatus so that the original is fed onto the platen glass (Step 3005), and the program waits for the completion of the original feeding (Step 3007). At this time, it is discriminated whether or not the fed original is the last original (Step 3008-1). When it is the last one, a last original flag is set in the memory (Step 3008-2). Next, in Step 3009, an image reflecting the original on the platen glass is formed (Step 3009). During the image forming operation in Step 3009, the transfer material is fed from the sheet feeding portion of the main assembly; an image is formed using a known image forming system; and the fixed sheet is discharged into the sorter (here, the detailed description is omitted). Then, after the completion of the image forming operation, the copy count buffer counter is decremented (Step 3011). The above sequence from Step 3009 to Step 3011 is repeated till the value in the counter becomes 0 (Step 3013). As soon as the value in the copy count buffer counter becomes 0, the sorter shift direction reversal signal is outputted (Step 3015). Then, an original discharge instruction is sent to the automatic original feeding apparatus (Step 3017), and the program waits for the completion the original discharge (Step 3019). Then, in Step 3021, the last original flag which shows the current original is the last one is checked. When it is the last one, the program proceeds to Step 3023, and when it is not the last one, the program returns to Step 3001, repeating the Steps 3001 to 3021. In Step 3023, the last original flag is reset, which concludes this operation. Through such a sequence as the above, the image forming operation is repeated for each original to obtain the rest of the required number of copies until the last original is detected.

Original feeding operation

Next, a routine for controlling the automatic original feeding apparatus will be described referring to FIG. 29. When an original feed instruction is detected in Step 1, an original feeding operation is carried out in Step 3. This original feeding operation refers to a routine in which a single original is separated from a stack of originals placed in an original stand of the automatic original feeding apparatus, and this single original is conveyed onto the platen glass of the image forming apparatus, where it is positioned at an optional image forming location (here, the detailed description is omitted). At this time, when it is detected that the current original is the last one, the last original signal is set (Steps 5 and 7). Next, in Step 9, when the original discharge instruction is detected, the original is discharged in Step 11. This original discharging operation refers to a routine in which the original on the platen glass of the image forming apparatus is conveyed and discharged into the original stand, by the original feeding apparatus (here, the detailed description is omitted).

Sorting mode operation

Figure 30:
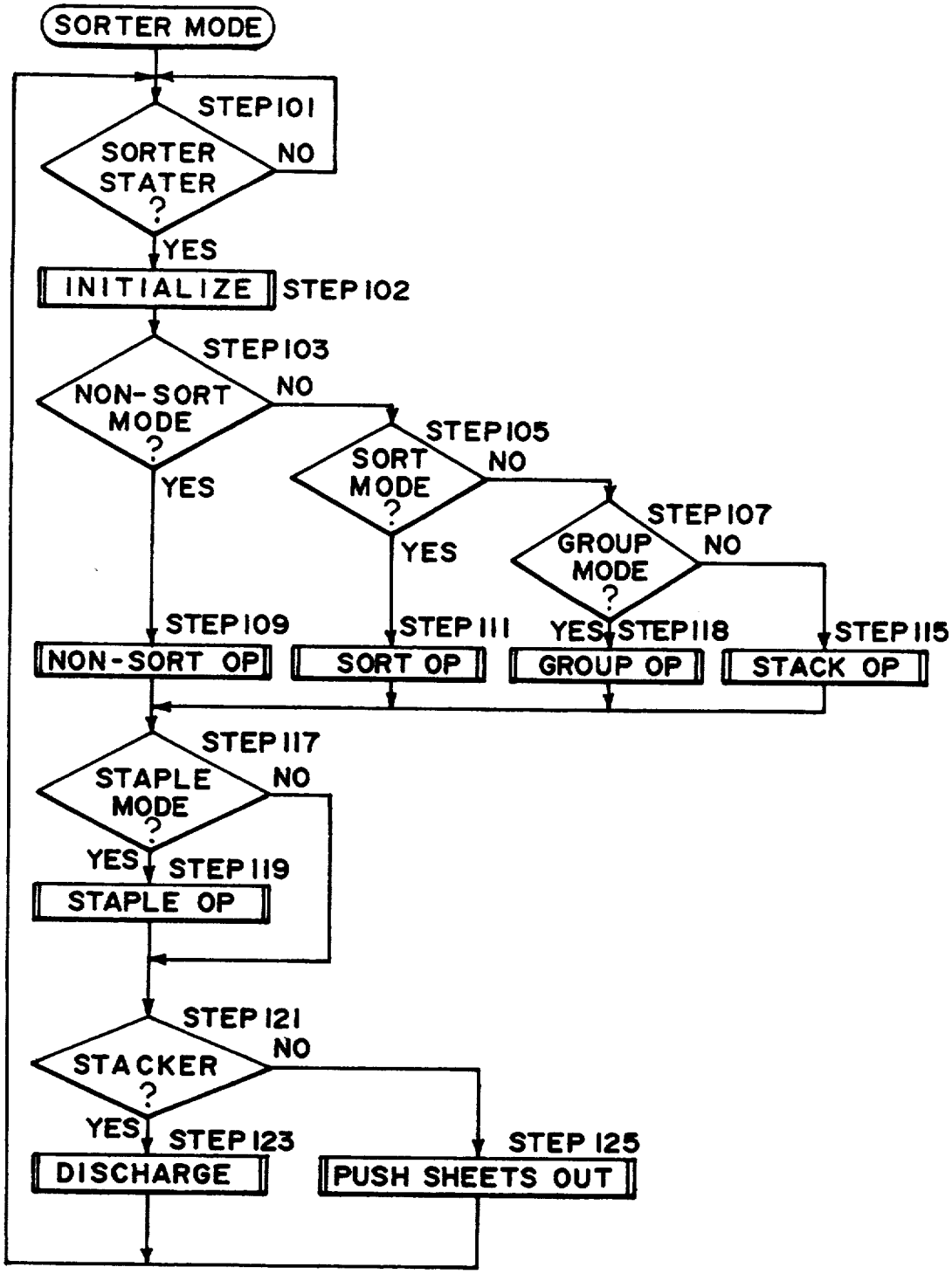
FIG. 30 is a flow chart for selecting a sorter mode.

First, a sorting mode program which executes the overall control of the sorter will be described referring to FIG. 30. In Step 101, it is detected whether or not a "sorter start signal" is present, which indicates that the sheet discharge from the main assembly of the copy machine. When there is, the sorter is initialized in Step 102, and, the program proceeds to Step 103. When there is not "sorter start signal" in Step 101, the program returns to the beginning of the Step 101.

In Steps 103 to 107, it is detected which sorter mode has been selected to handle the sheets discharged from the copying machine, whereby the program process to a routine for the selected sorter mode, which will be described later. In other words, in the case of the non-sorting mode, the non-sorting operation is carried out (Step 103, Step 109), which will be described later; in the case of the sorting mode, the sorting operation (Step 105, Step 111), which will be described later; in the case of the grouping mode, the grouping operation (Step 107, Step 113), which will be described later; and in the case other than those mentioned above, the stacking operation (Step 115) is carried out. After the preceding routines, when the stapling mode is detected (Step 117), the stapling operation is carried out (Step 119, which will be described later), wherein when the stacker is connected, the stacker discharge operation (Step 123, which will be described later) is carried out, and when not, the operation for pushing out the bundles of sheets is carried out (Step 125, which will be described layer). Then, the program returns to Step 101.

Sorter initialization operation

Figure 31:
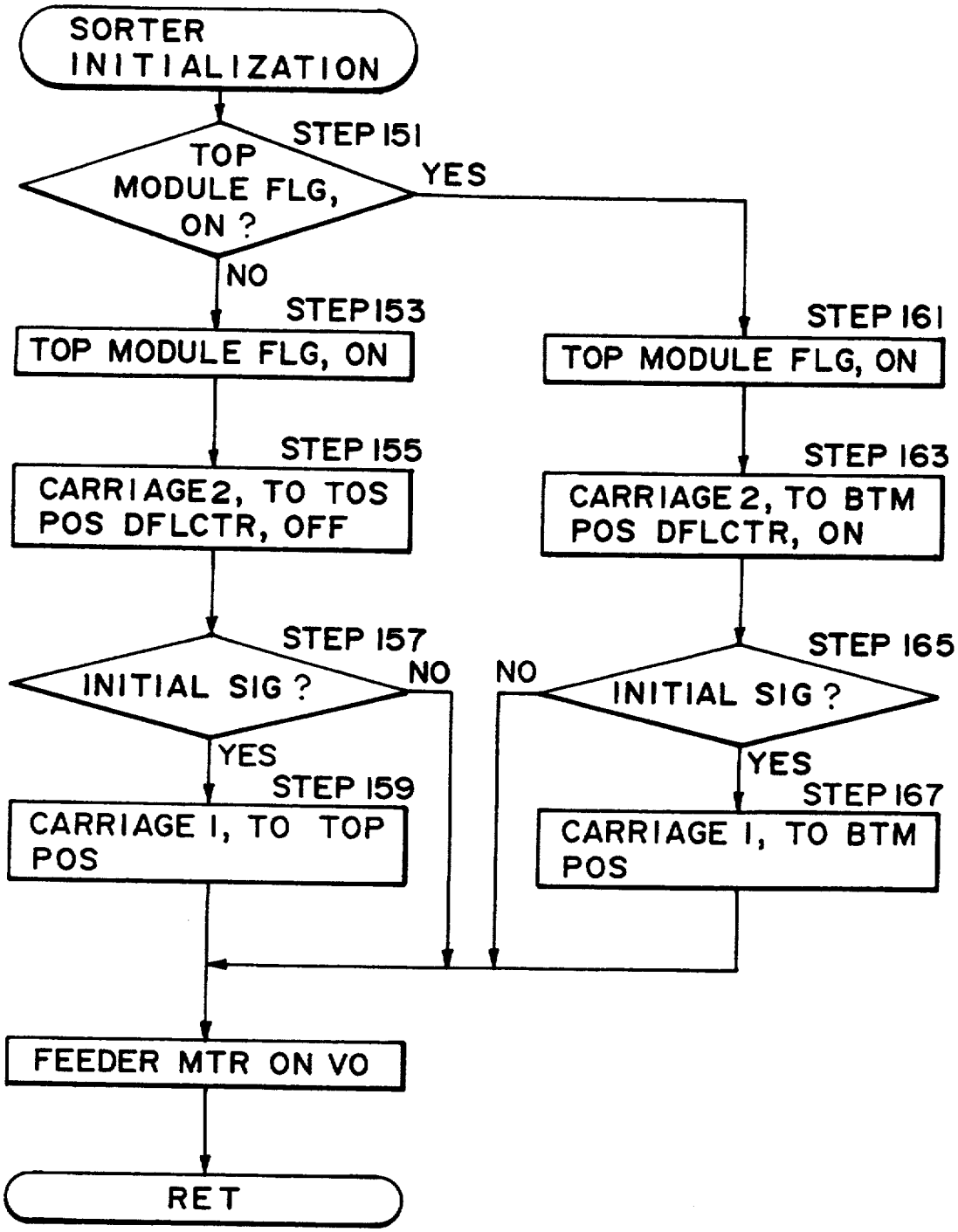
FIG. 31 is a flow chart for initializing the sorter.

Next, referring to FIG. 31, the sorter initialization operation will be described. In Step 151, it is detected whether or not an upper module flag has been set, which indicates that the upper module of the sorter will be used. When it has not been set, the upper module flag is set, and the initialization procedure is taken to use the upper module. In this embodiment, the upper ten bins are grouped as the "upper module", and the lower ten bins are grouped as the "lower module", whereby each group can be independently controlled. Needles to say, the number and size of the module may be optionally structured in this case. Step 153 and the following steps are for initializing the sorter to use the upper module, and Step 161 and the following steps are for initializing the sorter to use the lower module. In Step 155, the first delivery unit 2 (hereinafter, carriage 2) is moved to the initial position in the upper module, and since the upper sheet passage is used, the deflector is not activated. Here, the initial position of the carriage 2 in the upper module is where it is in alignment with the discharge rollers of the upper sheet passage. When there is the sorter initializing signal is detected, the second delivery unit (hereinafter, carriage 1) is moved to the initial position (Step 157, Step 159). Here, the initial position of the carriage 1 is where it becomes aligned with the uppermost bin. Then, the conveying motor 2 is started to receive the sheet. At this time, the sheet conveying speed of the conveying motor 2 is set a speed ($=v_0$) which is substantially the same as the one at which the sheet is discharged from the main assembly of the copying machine (Step 169).

When it is detected in Step 151 that the upper module flag is set, the flag is reset in Step 161, and Step 163 is followed. In Step 163, the carriage 2 is moved to the initial position in the lower module, wherein since the lower sheet passage is used, the deflector is activated. Here, the initial position of the carriage 2 in the lower module is where it is becomes aligned with the discharge rollers of the lower sheet passage. When the sorter initialization signal is detected, the carriage 1 is moved to the initial position in the same manner (Step 165, Step 167). Here, the initial position of the carriage 1 is where it becomes aligned with the 11th bin. Then, the conveying motor 2 is started to receive the sheet. At this time, the sheet conveying speed of the conveying motor 2 is set at a speed ($=v_0$) which is substantially the same as the one at which the sheet is discharged from the main assembly of the copying machine (Step 169).

Non-sorting operation

Figure 32:
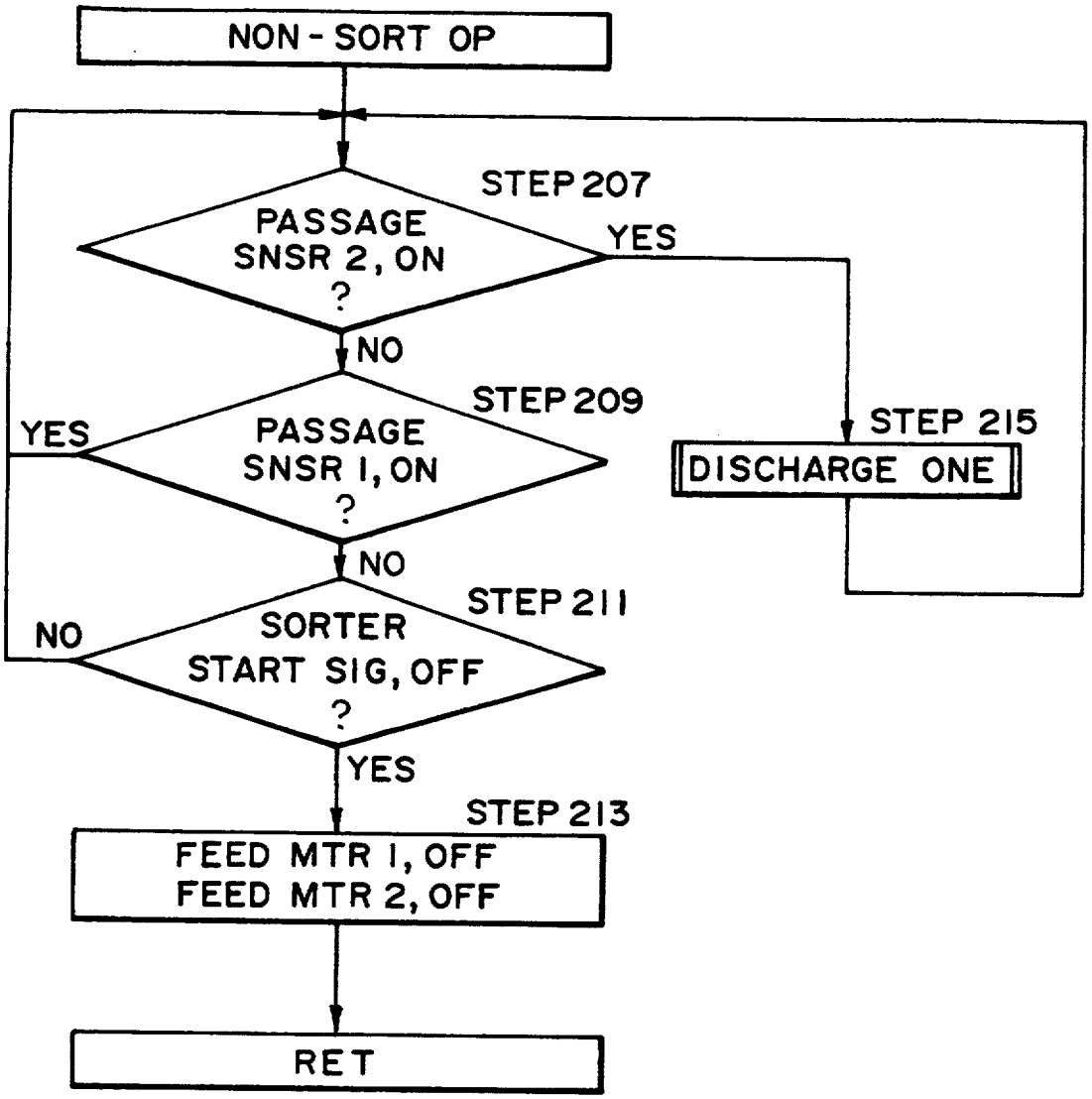
FIG. 32 is a flow chart for a non-sorting operation.

Next, referring to FIG. 32, an operation in the aforementioned non-sorting mode will be described. When the sheet passage sensor 2 is turned on, a single sheet discharge operation is carried out (Step 207, Step 215). The single sheet discharge operation will be described later. After the single sheet is discharged, the operation returns to the beginning of Step 207. When it is detected in Step 207 that the sheet passage sensor is off, Step 209 and Step 211 are followed. In Step 209 and Step 211, it is checked whether the sheet passage sensor 1 and the sorter start signal are on or off, respectively. When one of them is on, the operation returns to Step 207, and only when both are off, the conveyer motors 1 and 2 are turned off in Step 213, whereby the non-sorting operation concludes.

Sorting operation

Figure 33:
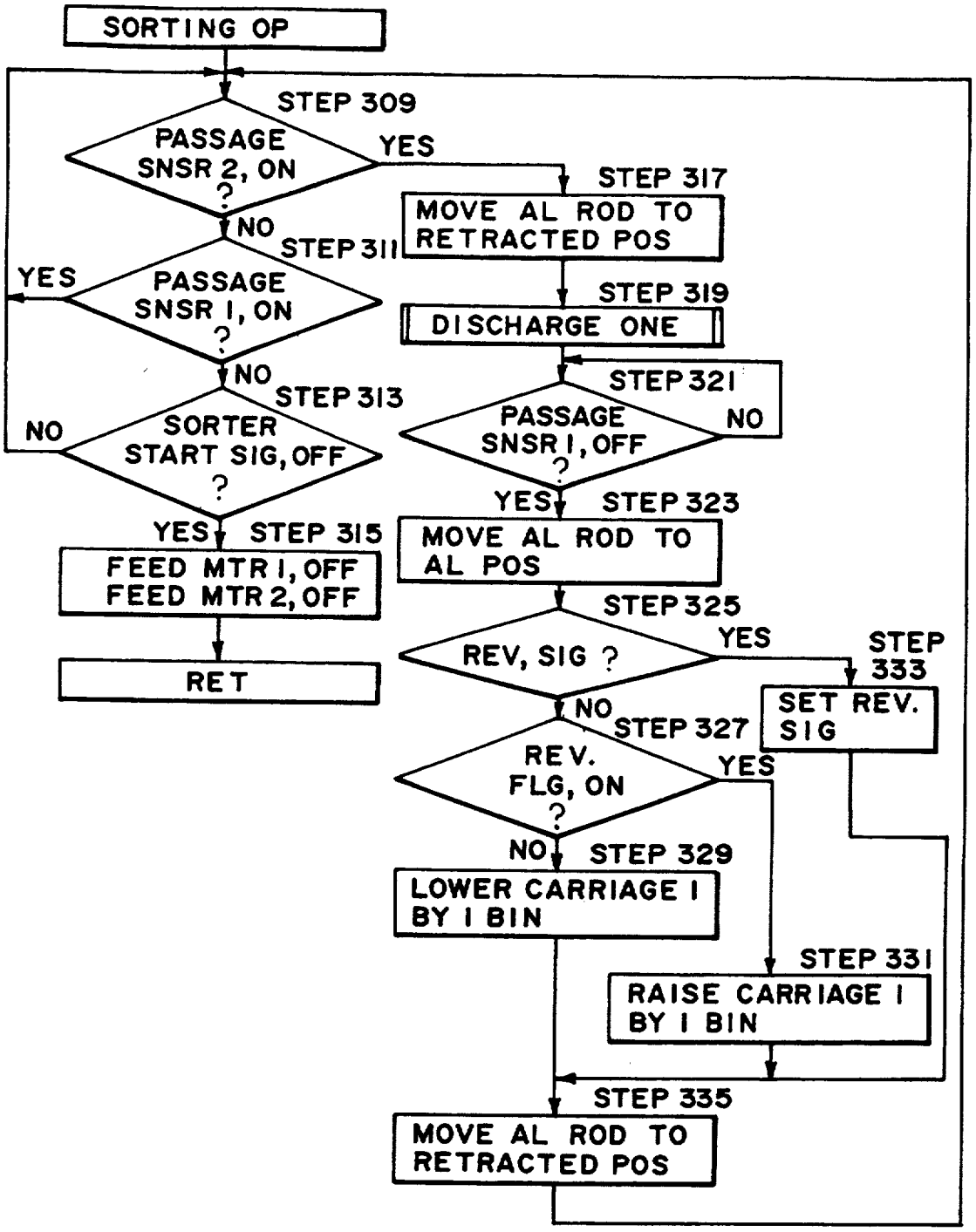
FIG. 33 is a flow chart for a sorting operation.

Next, referring to FIG. 33, an operation in the aforementioned sorting mode will be described. In Step 309, the sheet passage sensor 2 is checked. When the sheet passage sensor 2 is off, Step 311 and Step 313 are followed. In Step 311 and 313, it is checked whether the sheet passage sensor 1 and the sorter start signal are on or off. When it is detected in Step 311 and Step 313 that one of them is on, the operation returns to Step 309, and only when both are off, the conveying motors 1 and 2 are turned off in Step 315, which concludes the sorting operation. When it is detected in Step 309 that the sheet passage sensor 2 is on, the operation proceeds to Step 317. In Step 317, the jogging member is retracted since the jogging operation for the discharged sheets is carried out later. Then, the single sheet discharge operation, which will be described later, is carried out (Step 319). After the single sheet discharge, when it is confirmed that the sheet passage sensor 1 is off (Step 321), the sheet jogging operation is carried out (Step 323). Then, when the shift direction reversal signal is detected is Step 325, Step 333 is followed, and when not, Step 327 is followed. In Step 333, shift direction reversal flag is set, which is a status in the memory for reversing the direction in which the bins are shifted, and at this time, the bin shifting operation is not initiated. Then, the operation proceeds to Step 335. When the shift direction reversal signal is not detected in Step 325, it is checked in Step 327 whether or not the shift direction flag is on. When it is not on, the carriage 1 is lowered one level so that the bin on this level becomes the next bin to receive the sheet. When it is detected in Step 327 that the shift direction reversal flag is on, the carriage 1 is raised one level so that the bin on this level becomes the next bin to receive the sheet. Next, Step 335 is followed, where the jogging rod is retracted, and then, the operation returns to Step 309.

Grouping operation

Figure 34:
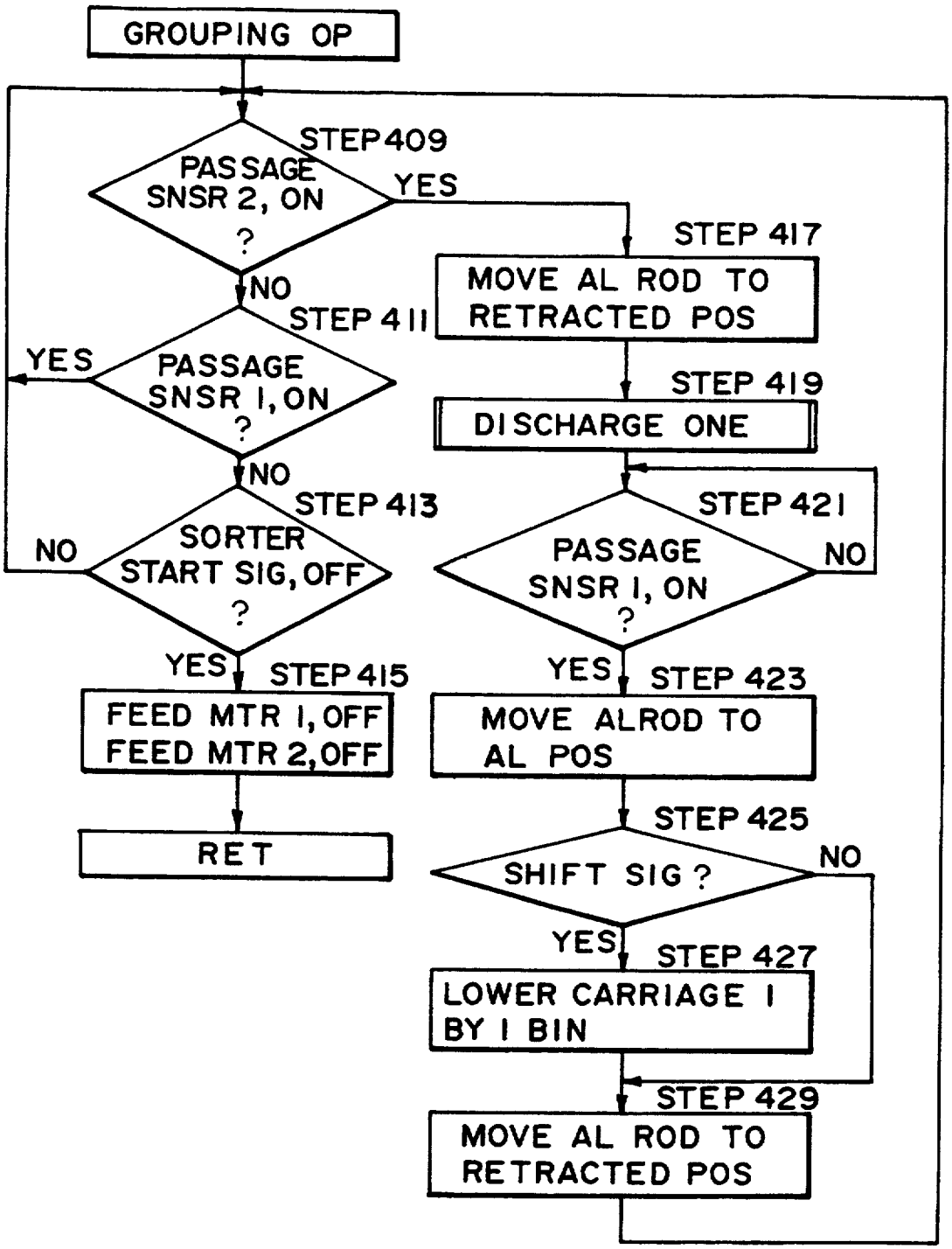
FIG. 34 is a flow chart for a grouping operation.

Next, referring to FIG. 34, the operation in the aforementioned grouping mode will be described. In Step 409, the sheet passage sensor 2 is checked. When the sheet passage sensor 2 is off, Step 411 and Step 413 are followed. In Step 411 and 413, it is checked whether the sheet passage sensor 1 and the sorter start signal are on or off. When it is detected in Step 411 and Step 413 that one of them is on, the operation returns to Step 409, and only when both are off, the conveying motors 1 and 2 are turned off in Step 415, which concludes the sorting operation. When it is detected in Step 409 that the sheet passage sensor 2 is on, the operation proceeds to Step 417. In Step 417, the jogging member is retracted since the jogging operation for the discharged sheets is carried out later. When, the single sheet discharge operation, which will be described later, is carried out (Step 419). After the single sheet discharge, when it is confirmed that the sheet passage sensor 1 is off (Step 421), the sheet jogging operation is carried out (Step 423). Then, when the shift signal is detected in Step 425, Step 427 is followed, and when not, Step 429 is followed. In Step 427, the carriage 1 is lowered one level so that the bin on this level becomes the next bin to receive the sheet. Next, Step 429 is followed, where the jogging rod is retracted, and then, the operation returns to Step 409.

Stacking operation

Figure 35:
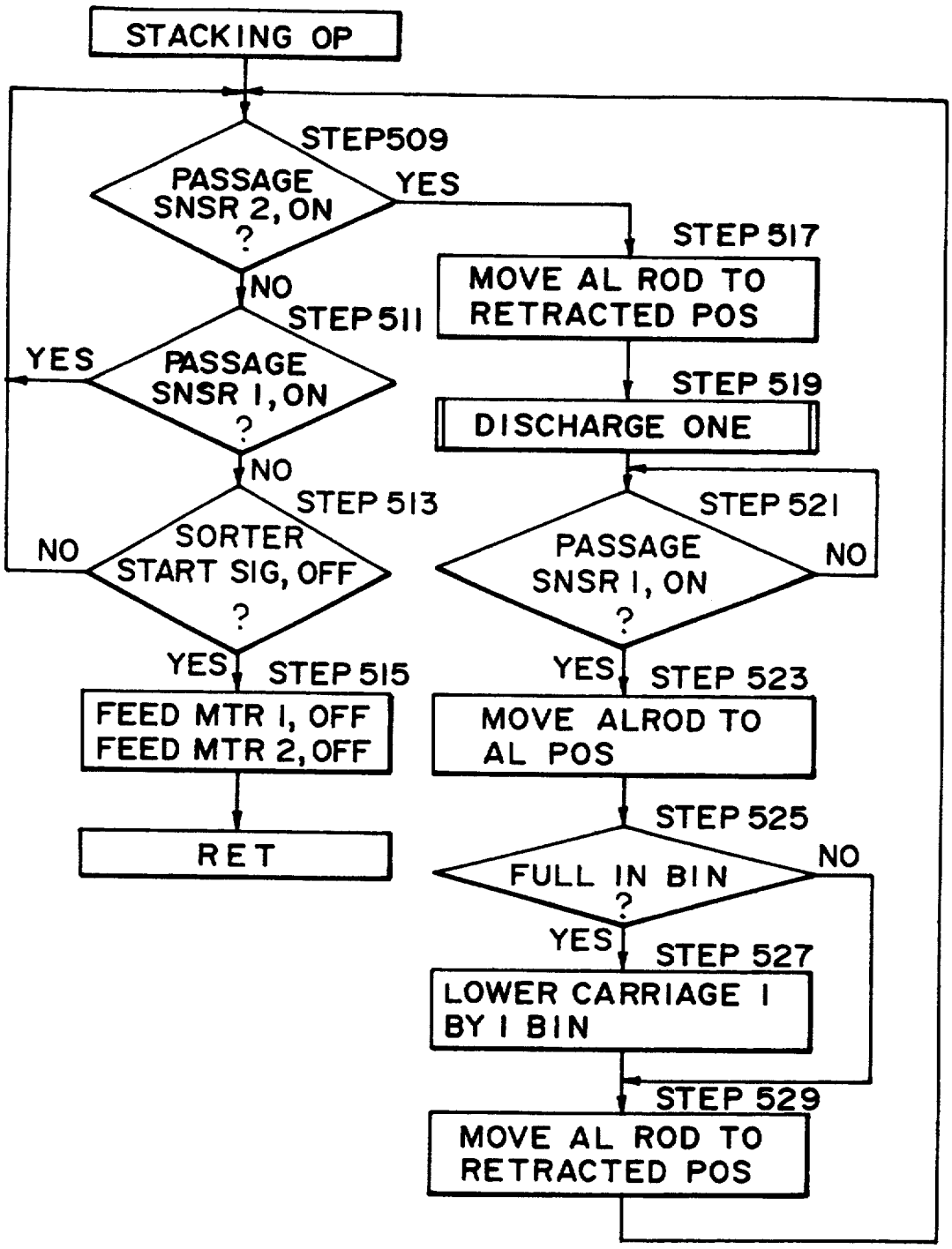
FIG. 35 is a flow chart for a stacking operation.

Next, referring to FIG. 35, the operation in the aforementioned stacking mode will be described. In Step 509, the sheet passage sensor 2 is checked. When the sheet passage sensor 2 is off, Step 511 and Step 513 are followed. In Step 511 and 513, it is checked whether the sheet passage sensor 1 and the sorter start signal are on or off. When it is detected in Step 511 and Step 513 that one of them is on, the operation returns to Step 509, and only when both are off, the conveying motors 1 and 2 are turned off in Step 515, which concludes the sorting operation. When it is detected in Step 509 that the sheet passage sensor 2 is on, the operation proceeds to Step 517. In Step 517, the jogging member is retracted since the jogging operation for the discharged sheets is carried out later. Then, the single sheet discharge operation, which will be described later, is carried out (Step 519). After the single sheet discharge, when it is confirmed that the sheet passage sensor 1 is off (Step 521), the sheet jogging operation is carried out (Step 523). Then, in Step 525, it is checked whether or not the count is up, by counting the number of the sheet accumulated in the bin. When it is detected that the count is up, Step 527 is followed, and when not, Step 529 is followed. In Step 527, the carriage 1 is lowered one level so that the bin on this level becomes the next bin to receive the sheet. Next, Step 529 is followed, where the jogging rod is retracted, and then, the operation returns to Step 509.

Stapling operation

Figure 36:
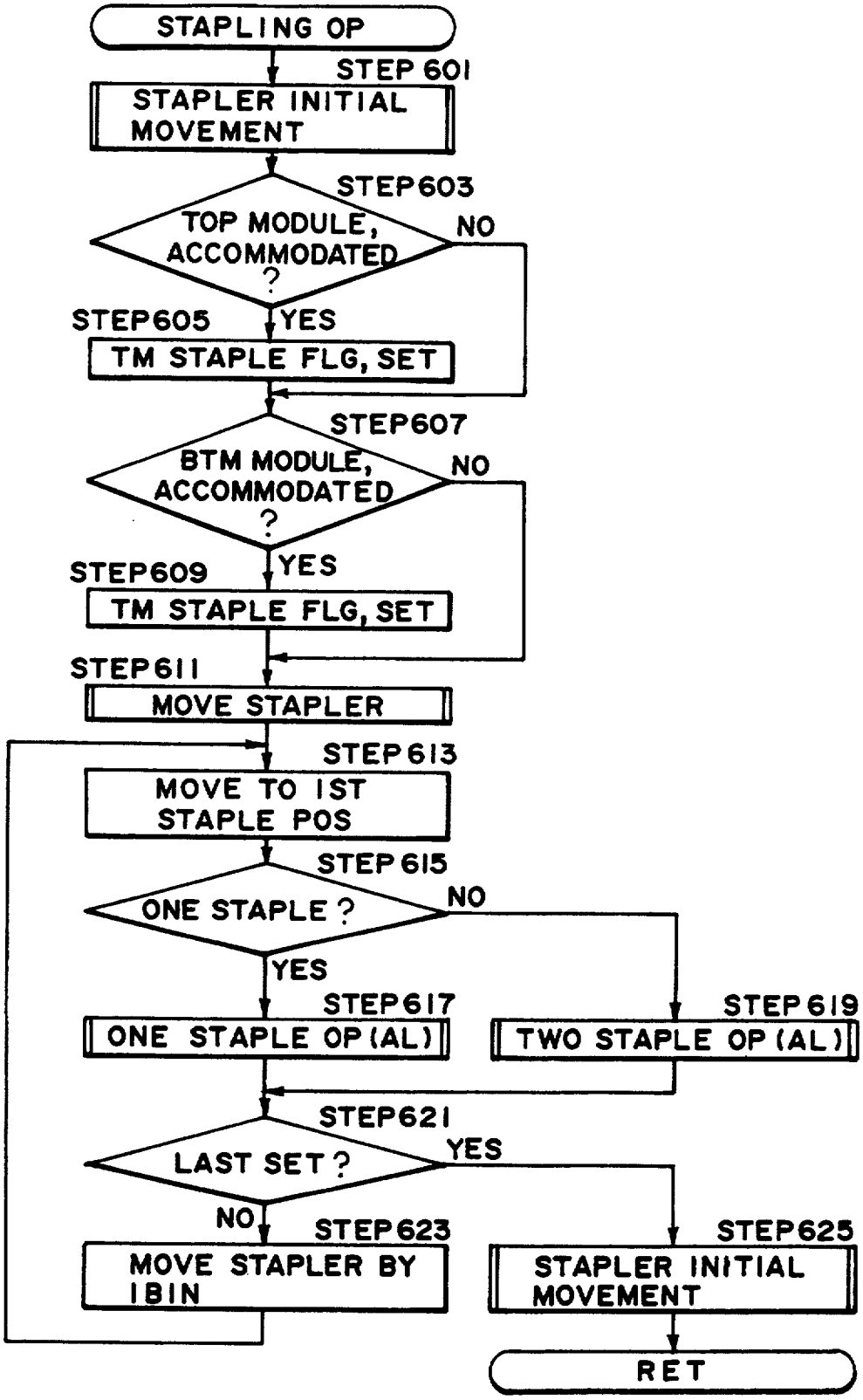
FIG. 36 is a flow chart for a stapling operation.

Next, referring to FIG. 36, the stapling operation will be described. FIG. 36 is a flowchart showing the flow of the stapling operation. In Step 601, the stapler is moved to an initial position to initiate a sequence for the stapling operation. After the stapler is moved to the initial position, the module in which the stapling operation is to be carried out is selected. In other words, when the sheet reception in the upper module has been completed in the upper module, an "upper module stapling flag" is set, and the module in which the stapling operation is to be carried out is selected in the same manner. In other words, when the sheet reception in the lower module has been completed, a "lower module stapling flag" is set (Step 603, Step 605, Step 607 and Step 609). Next, the stapler is moved in response to the selected flag (Step 611).

Next, the stapler is moved to the first stapling position. A bundle of sheets can be stapled at two or more points by moving horizontally a single stapler in this manner. In Step 613, the stapler is moved to one of the single point stapling locations. Next, in Step 615, it is checked whether the sheets are to be stapled at a single point or two points. The type of stapling mode is detected from the stapling mode data sent from the main assembly through the aforementioned serial communications. When it is detected in Step 615 that the stapling mode is the single point stapling, the program proceeds to Step 617 where the staple is placed at a single point. When it is detected in Step 615 that the stapling mode is the two point stapling, the program proceeds to Step 619 where the sheets are stapled at two points. Step 617 for the single point stapling and Step 619 for the two point stapling will be described later in detail. After the completion of stapling in Step 617 or Step 619, the program proceeds to Step 621, where it is checked whether or not the then stapled bundle is the last bundle of sheets to be stapled in this sequence of stapling operation. When it is the last one, the stapler is moved back to the initial position, which concludes the stapling operation, and when not the stapler is vertically moved by one bin. Then, the program returns to Step 613 to continue the stapling operation.

Figure 37:
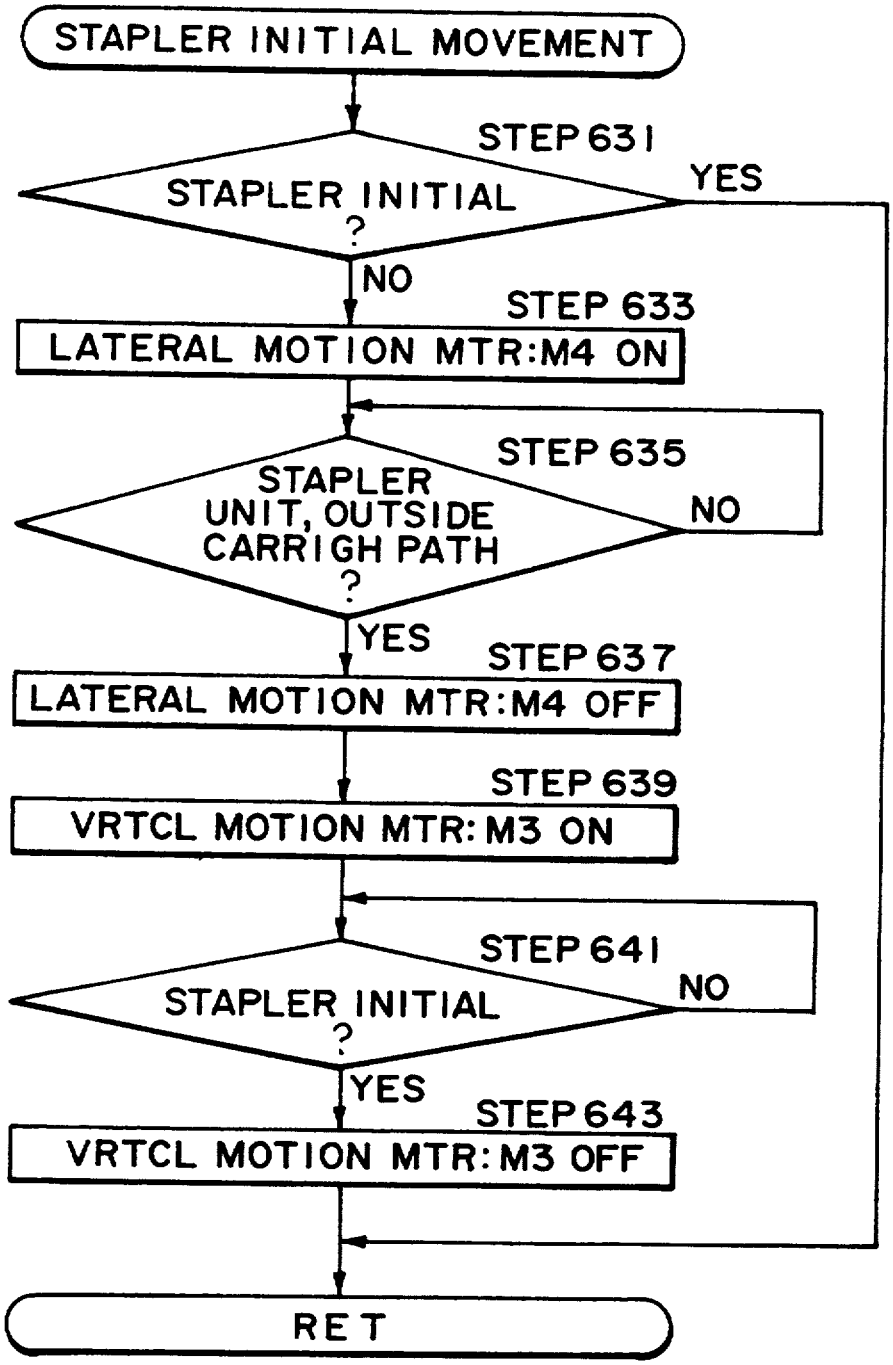
FIG. 37 is a flow chart for a stapler initial movement.

Referring to FIG. 37, the aforementioned stapler initialization procedure will be described. In Step 631, it is checked whether or not the stapler is currently located at the initial position. When the stapler is at the initial position, the procedure concludes. When the stapler is not at the initial position, a motor for moving the stapler unit in the horizontal direction (hereinafter, $M_4$) is turned on in Step 633, and as soon as the stapler unit goes out of the carriage path, the motor $M_4$ is stopped (Step 636 and Step 637). While the stapler is out of the carriage path, it does not come in contact with the carriage even if the stapler is vertically moved. In the same manner, a motor for moving the stapler unit in the vertical direction (hereinafter $M_3$) is turned on, and as soon as the stapler arrives at the initial position, the motor $M_3$ is stopped (Step 641 and Step 643).

Figure 38A:
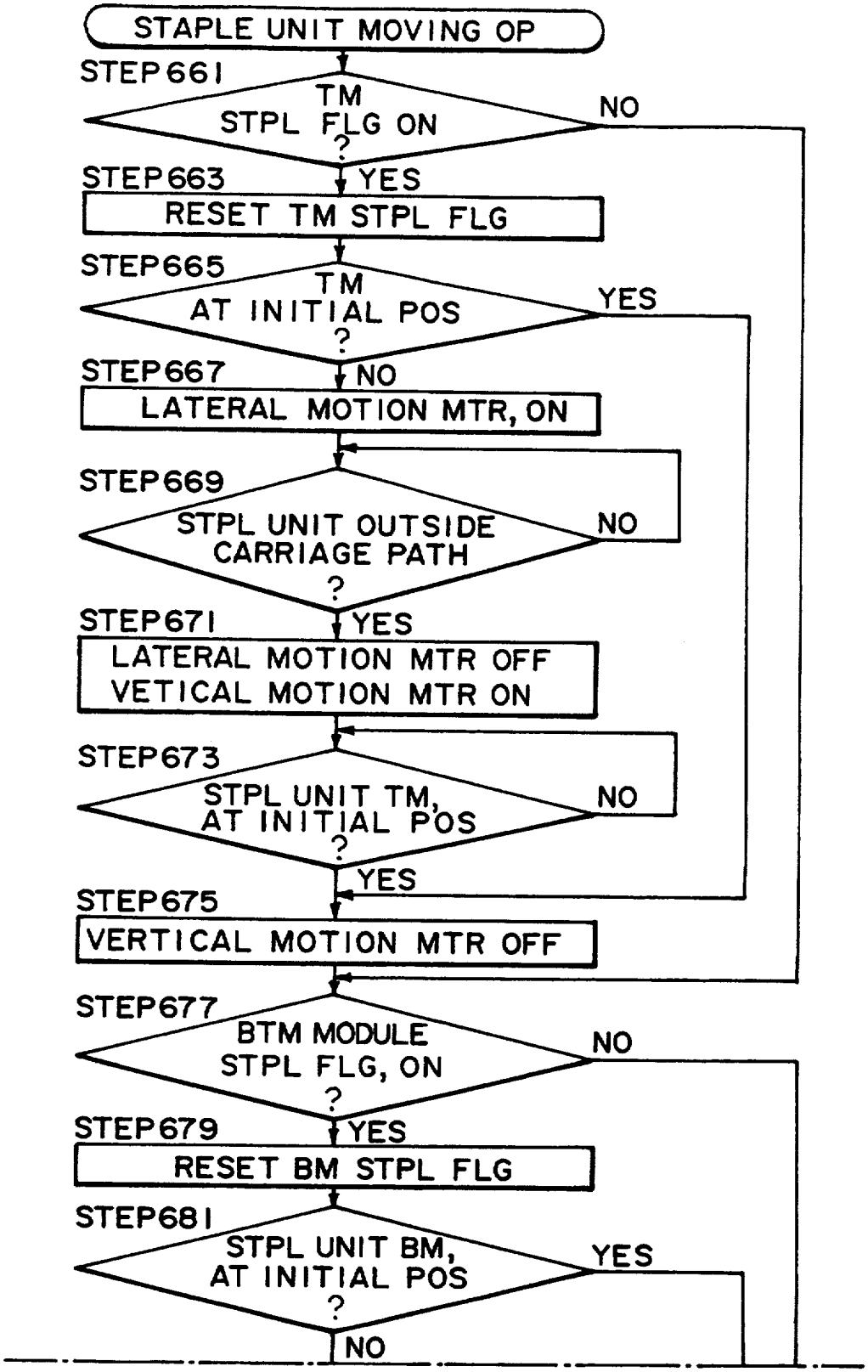
FIG. 38 which consists of FIGS. 38A and 38B, is a flow chart for moving the a stapler.
Figure 38B:
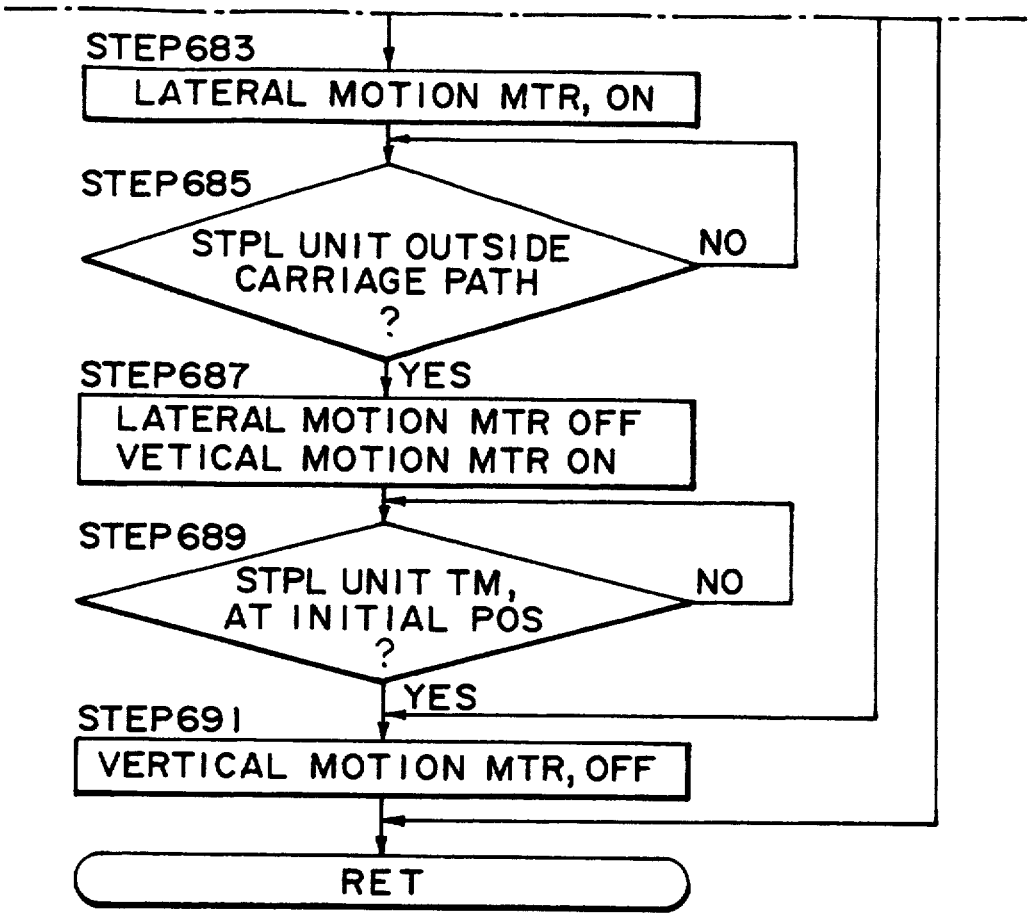
Figure 38:
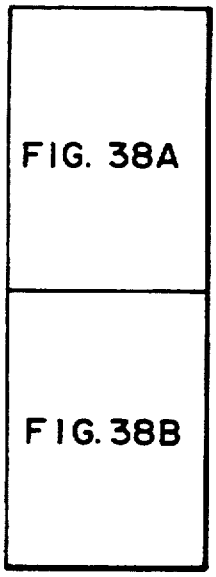

Referring to FIG. 38, the aforementioned stapler moving procedure will be described. In Step 661, it is checked whether or not the upper module stapling flag is set. When it is not set, Step 677 is followed. When it is, the upper module stapling flag is reset in Step 663, and Step 665 is followed. In Step 655, it is checked whether or not the stapling unit is currently at the initial position in the upper module. When it is, Step 675 is followed. When it is not, $M_4$ is turned on in Step 667, and as soon as the stapler goes out of the carriage path, the motor is stopped (Step 669). Immediately, $M_3$ is turned on, and as soon as the stapler arrives at the initial position in the upper module, the motor is stopped (Step 671, Step 673, and Step 675). Here, the initial position of the stapler in the upper module is where it becomes aligned with the uppermost bin. When it is detected in Step 677 that the lower module stapling flag is not set, the operation is concluded, and when it is on, the lower module stapling flag is reset in Step 679, and the operation moves onto Step 681. In Step 681, it is detected whether or not the stapling unit is currently at the initial position in the lower module. When it is, Step 691 is followed. When it is not, $M_4$ is turned on in Step 683, and as soon as the stapler goes out of the carriage path, the motor is stopped (Step 685). Immediately, $M_3$ is turned on, and as soon as the stapler arrives at the initial position in the lower module, the motor is stopped (Step 687, Step 689 and Step 691). Here, the initial position of the stapler in the lower module is where it becomes aligned with the uppermost 11th bin.

Figure 39:
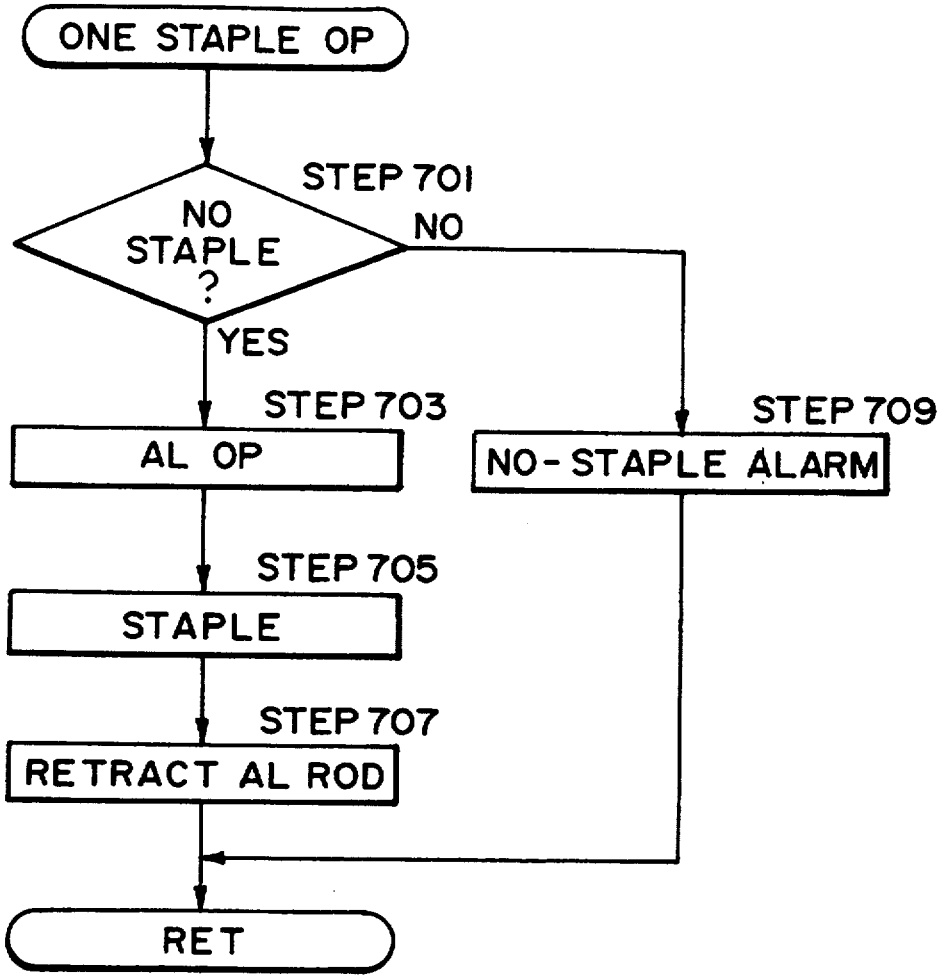
FIG. 39 is a flow chart for stapling the sheets at one place.

Referring to a flowchart in FIG. 39, the single point stapling operation, that is, one of the aforementioned stapling modes, will be described in detail. First, in Step 701, it is detected whether or not there are staples in the stapler. When there are, the program proceeds to Step 703 where the bundle of sheets is held by the jogging rod to prevent the sheets from becoming misaligned. Then, Step 705 is followed where the bundle of sheets is stapled, and the jogging rod is moved back in Step 707, which concludes the single point stapling operation. When it is detected in Step 701 that there is no staple, Step 709 is followed where a no-staple alarm is sent to the main assembly, which concludes the operation.

Figure 40:
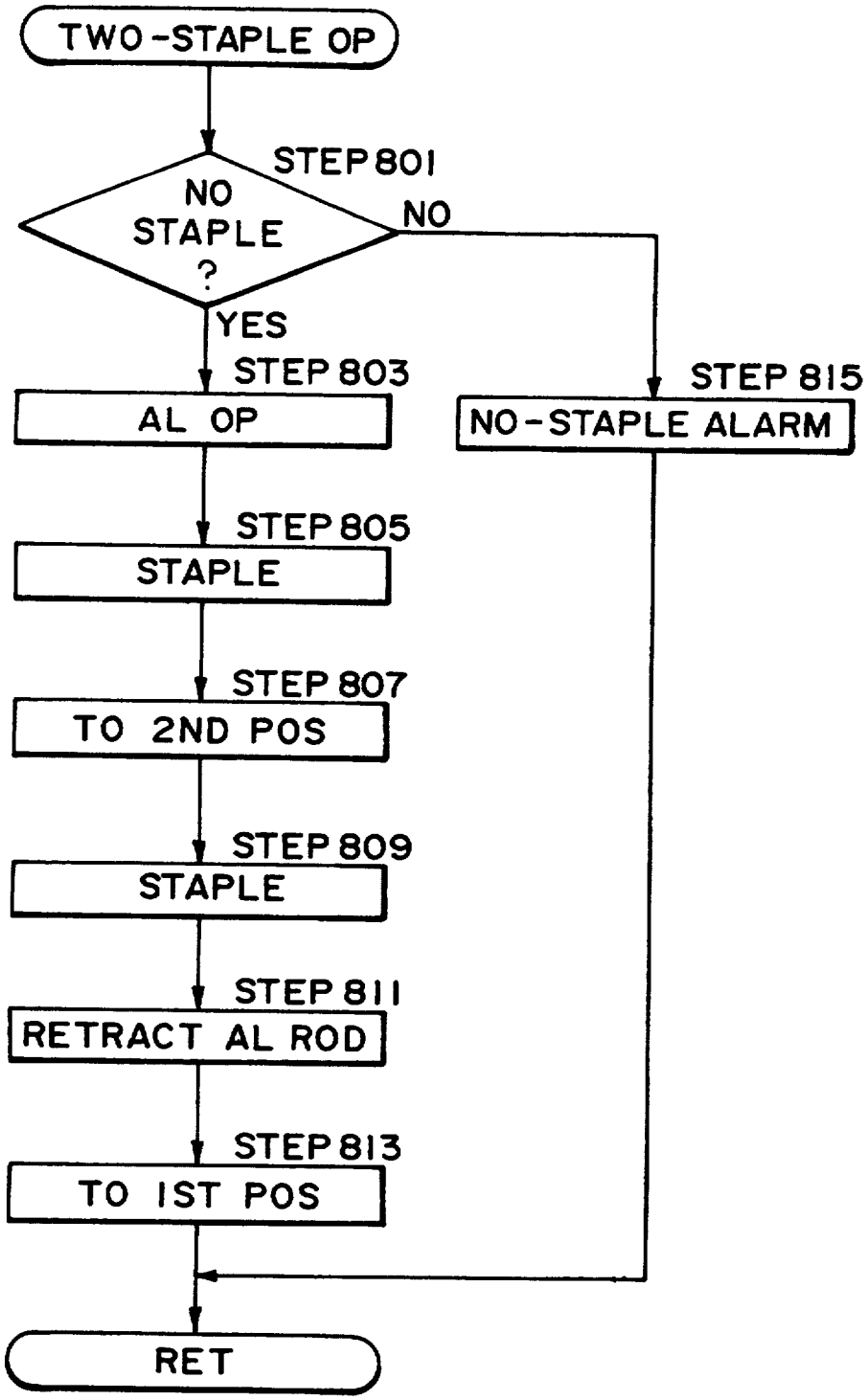
FIG. 40 is a flow chart for stapling the sheets at two places.

Next, the details of the two point stapling operation are as depicted by a flowchart in FIG. 40. First, in Step 801, it is detected whether or not there are staples in the stapler. When there are, the program proceeds to Step 803, where the bundle of sheets is held by the jogging rod to prevent the sheet from becoming misaligned. Then, Step 805 is followed, where the bundle of sheets is stapled at the first stapling point. After stapling at this point, the stapler is moved to the other stapling point where the bundle of sheets is to be stapled for the second time (Step 807). There, the bundle of sheets is stapled for the second time, and the jogging rod is retracted (Step 809 and Step 811). Then, the stapler is moved to the first stapling point to prepare for the subsequent operations, which concludes two point stapling operation (Step 813). When it is detected in Step 801 that there is no staple in the stapler, Step 815 is followed, where the no-staple alarm is sent out, which concludes the operation.

Figure 41:
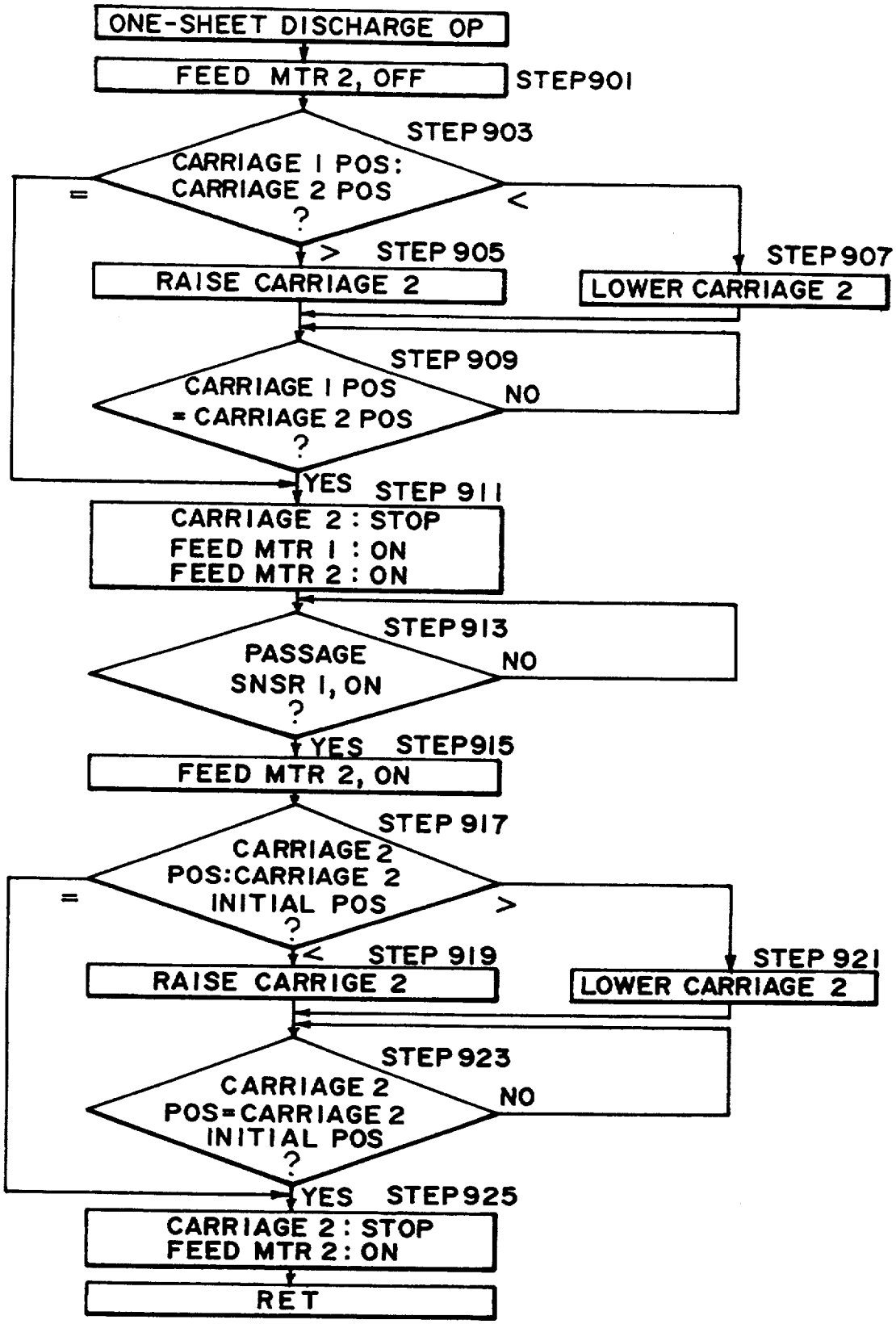
FIG. 41 is a flow chart for a sheet discharging operation.

Next, referring to FIG. 41, the single sheet discharge operation will be described. FIG. 41 is a flowchart showing the single sheet discharge operation. More particularly, the single sheet discharge operation refers to an operation in which a sheet discharged from the image forming apparatus is received and then, is discharged into a receiving bin. During this operation, a sheet enters the second carriage, which is detected by the sheet passage sensor 2. Then, the conveying motor 2 is stopped in Step 901, whereby the leading end of the sheet is held. Here, the positions of carriages 1 and 2 are compared. When they are at the same level, Step 911 is followed. When the position of the carrier 1 is higher, the carriage 2 is raised (Step 905). When the carriage 1 is located lower than the carriage 2, the carriage 2 is lowered (Step 907). At this time, the moving speed of the carriage 2 is substantially matched with the speed ($=v_0$) at which the sheet is discharged from the image forming apparatus, whereby unwanted effects such as pulling or buckling of the sheet can be avoided. As soon as they become aligned, the carriage 2 is stopped, and the conveying motor 2 of the carriage 2 and the conveying motor 1 of the carriage 1 are rotated at the sheet discharging speed ($=v_0$). Next, when the sheet is detected by the sheet passage sensor 1 in Step 913, the carriage 2 is moved to the initial position of the carriage 2 in Step 915 to Step 923. More particularly, due to the relation between the position of the carriage 2 at a specific time and its initial position, when the carriage 2 is located below its initial position, it is raised, and when the carriage 2 is located above its initial position, it is lowered (Step 917, Step 919 and Step 921). At this time, the conveying speed of the conveying motor 2 is set at $v_0+v_1$, where $v_1$ is the moving speed of the carriage 2. This arrangement is made to prevent the sheet from being subjected to an excessive load (Step 915). As soon as the carriage 2 is moved to the initial position, the carriage 2 is stopped and the conveying speed of the conveying motor 2 is restored to the original conveying speed, which concludes the single sheet discharge operation (Step 925).

Stacker discharge operation

Figure 42:
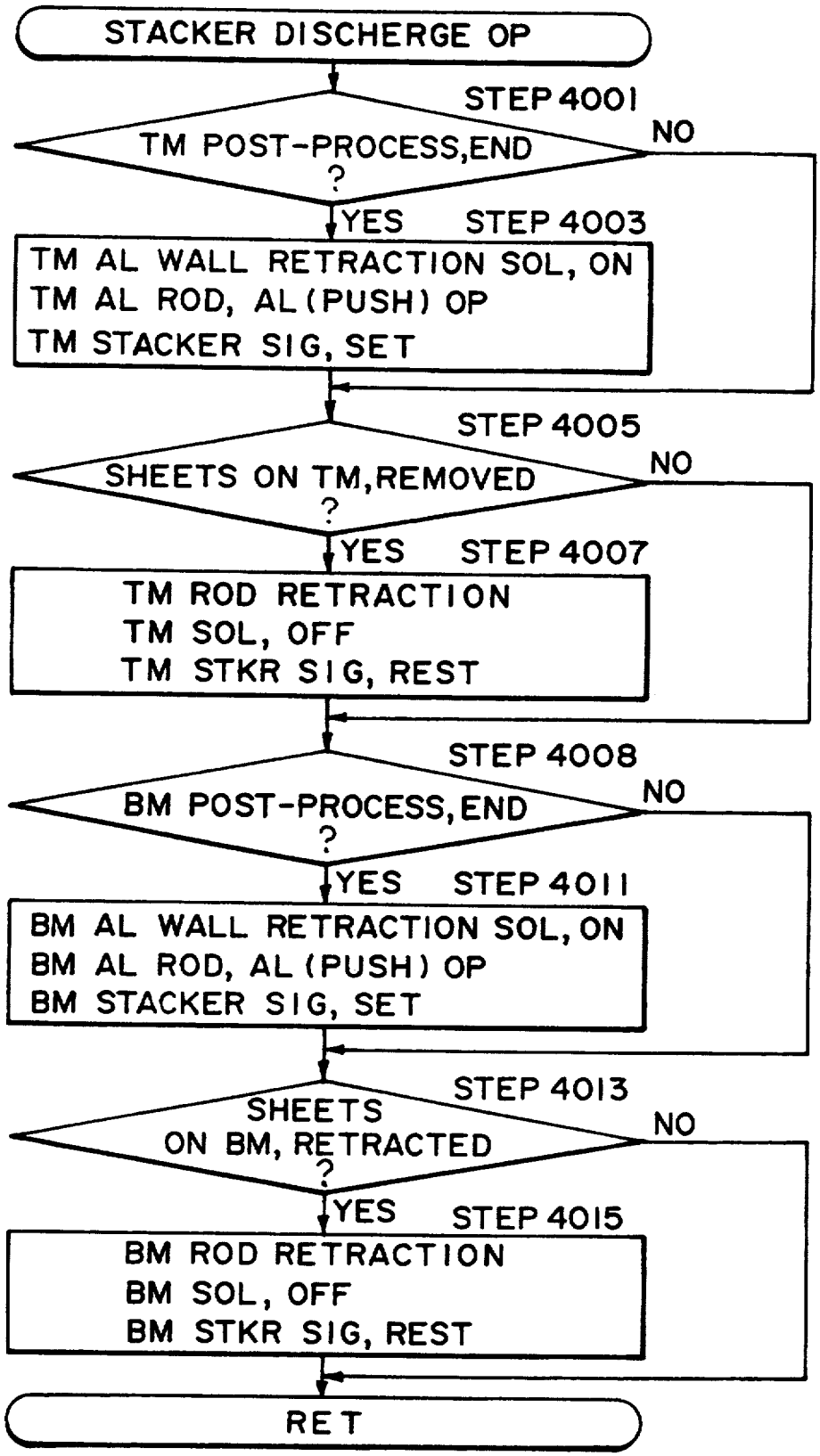
FIG. 42 is a flow chart for a stacker discharge operation.

Referring to FIG. 42, the stacker discharge operation will be described. First, in Step 401, it is detected whether or not the post-processing operations have been completed. When they have not been, Step 4005 is followed, and when they have been, Step 4003 is followed. Here, the post-processing operations refers to the sheets bundle handling operation including the stapling operation. In Step 4003, in order to allow the sheet bundles to be taken out from the front side, a solenoid for retracting the upper module jogging reference wall is turned on, and the upper module jogging rod is moved to the push-out position, whereby the sheet bundles are pushed out toward the front side. In addition, in order to signal the stacker that the sheet bundles have been pushed out toward the front side, the upper module stacker signal is set (Step 4003). Further, in Step 4005, it is detected whether or not the upper module sheet bundles have been pulled out. As soon as it is detected that they have been pulled out, the upper module jogging reference wall solenoid is turned off; the upper module jogging rod is retracted; and the upper module stacker signal is reset (Step 4007).

Next, in Step 4009, it is detected whether or not the post-processing operations in the lower module have been completed. When they have not been, Step 4013 is followed, and when they have been, Step 4011 is followed. In Step 4011, in order to allow the sheet bundles to be taken out from the front side, a solenoid for retracting the lower module jogging reference wall is turned on, and the lower module jogging rod is moved to the push-out position, whereby the sheet bundles are pushed out toward the front side. In addition, in order to signal the stacker that the sheet bundles have been pushed out toward the front side, the lower module stacker signal is set (Step 4011). Further, in Step 4013, it is detected whether or not the lower module sheet bundles have been pulled out. As soon as it is detected that they have been pulled out, the lower module jogging reference wall solenoid is turned off; the lower module jogging rod is retracted; and the lower module stacker signal is reset (Step 4015), which concludes the operation.

Push-out operation

Figure 43:
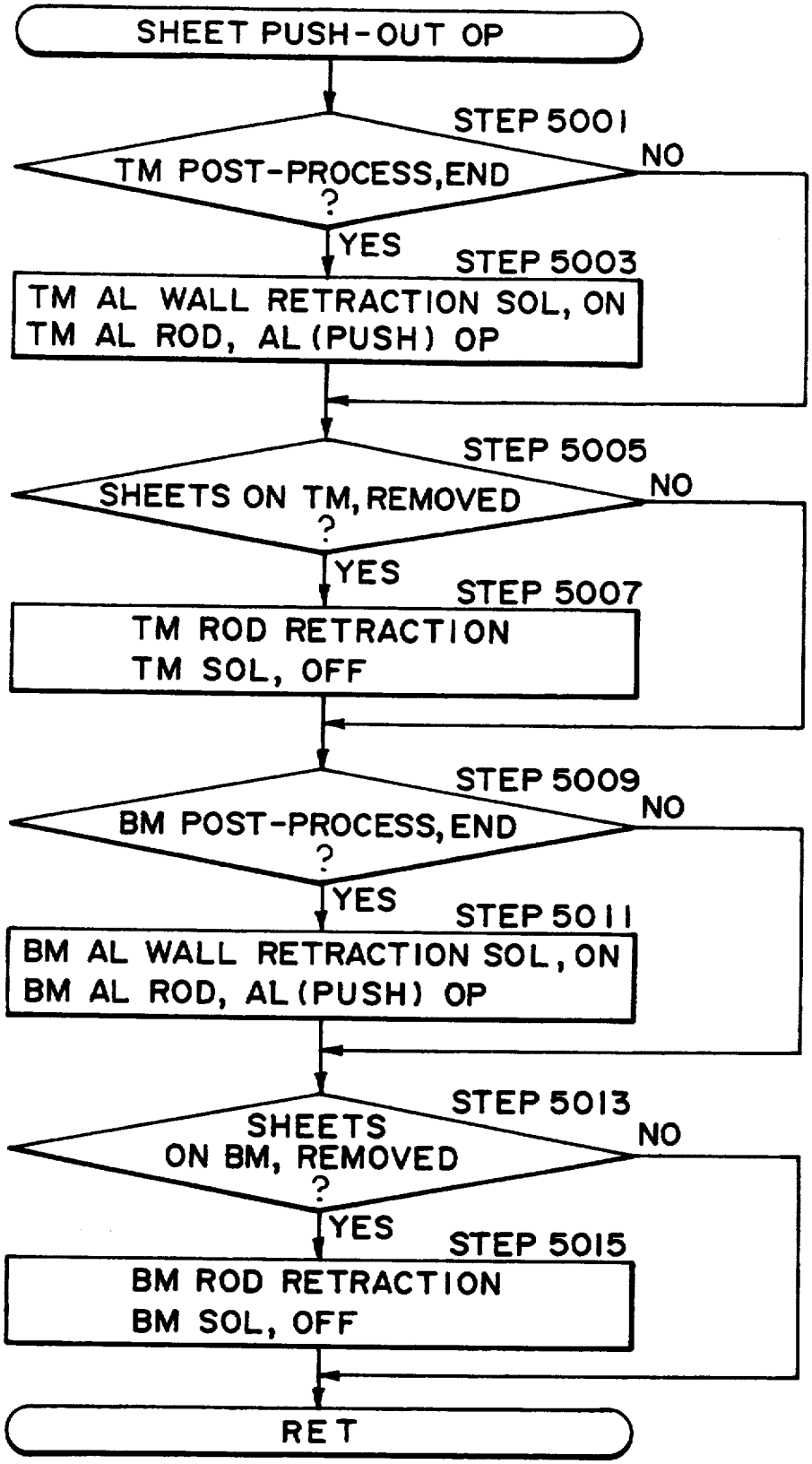
FIG. 43 is a flow chart for a sheet bundle discharge operation.
Figure 44:
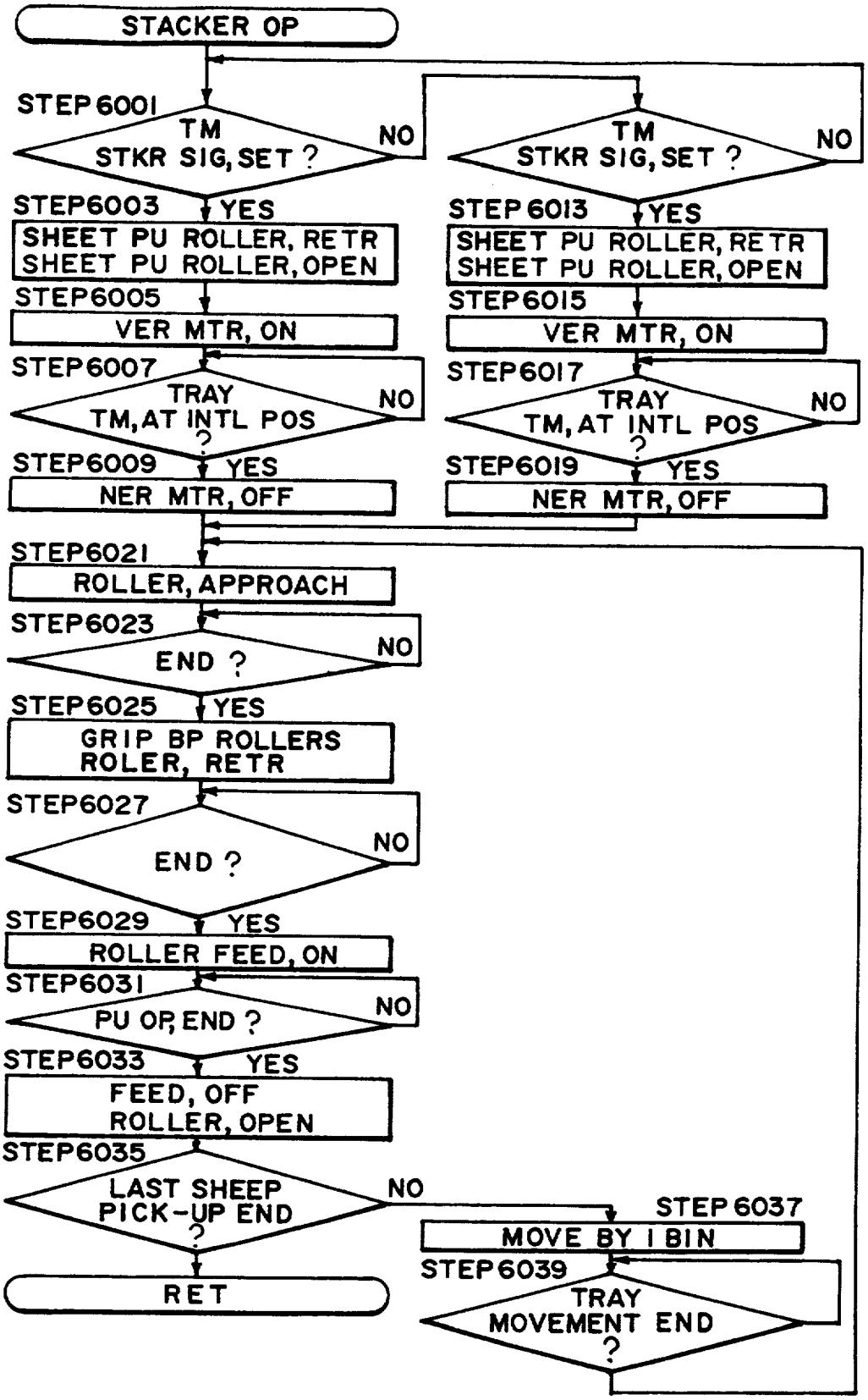
FIG. 44 is a flow chart for a stacker operation.
Figure 45:
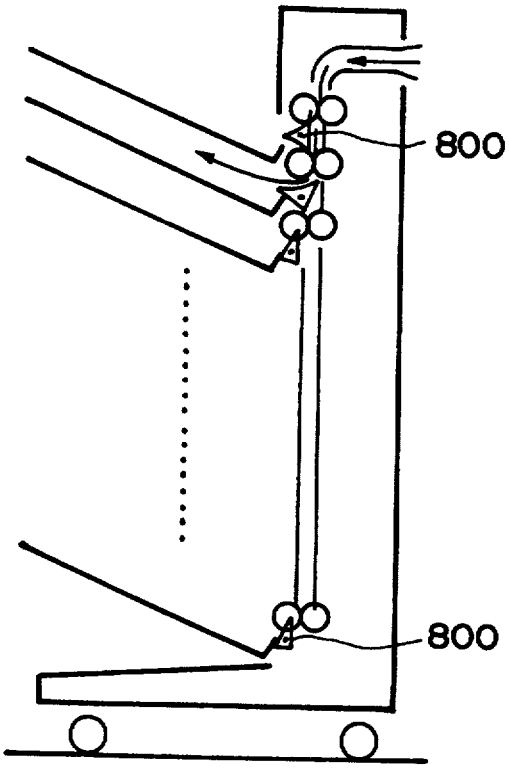
FIG. 45 PRIOR ART
FIG. 45 is a sectional front view of a sorter in accordance with the prior art.
Figure 46:
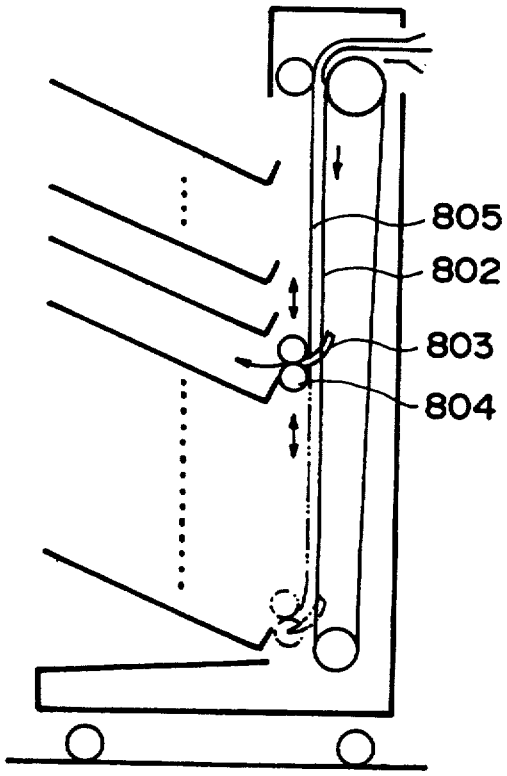
FIG. 46 PRIOR ART
FIG. 46 is a sectional front view of another sorter in accordance with the prior art.
Figure 47:
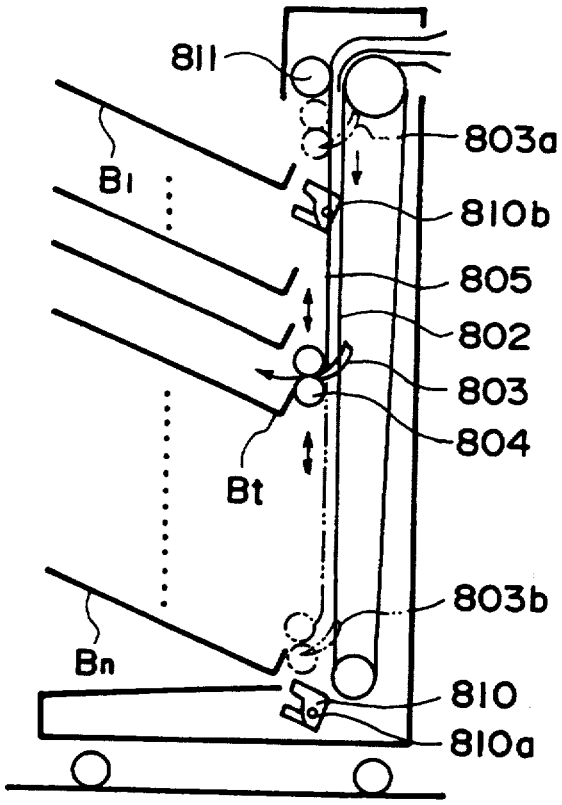
FIG. 47 PRIOR ART
FIG. 47 is a sectional front view of an additional sorter in accordance with the prior art.

Referring to FIG. 43, the push-out operation will be described. First, in Step 5001, it is detected whether or not the post-processing operations have been completed in the upper module. When they have not been, Step 5005 is followed, and when they have been, Step 5003 is followed. Here, so-called post-processing operations refer to processing of the sheet bundles, including stapling. In Step 5003, since the sheet bundles are taken out from the front side, the solenoid for retracting the upper module jogging reference wall is turned on and the upper module jogging rod is moved to the push-out position, whereby the sheet bundles are pushed out toward the front side (Step 5003). Next, it is detected in Step 5005 whether or not the upper module sheet bundles have been extracted. As soon as it is detected that they have been extracted, the upper module jogging reference wall solenoid is turned off and the upper module jogging rod is retracted (Step 5007). Then, it is detected in Step 5009 whether or not the post-processing operations in the lower module have been completed. When they have not been, Step 5013 is followed, and when they have been, Step 5011 is followed. In Step 5011, in order to allow the sheet bundles to be extracted from the front side, the solenoid for retracting the lower module jogging reference wall is turned on, and the lower module jogging rod is moved to the push-out position, whereby the sheet bundles are pushed out toward the front side. Next, in Step 5013, it is detected whether or not the lower module sheet bundles have been extracted. As soon as it is detected that they have been extracted, the lower module jogging reference wall solenoid is turned off and the lower module jogging rod is retracted (Step 5015), which concludes the operation.

Stacker operation

Referring to FIG. 44, the stacker operation will be described. In Step 6001, it is detected whether or not an upper module stacker signal is present. When the signal is not detected, Step 6011 is followed, and when the signal is present, Step 6003 is followed. In Step 6003, the sheet picking rollers are retracted, and at the same time, are opened to be prepared for gripping and extracting the sheet bundle. In this retracted state, the rollers do not come in contact with the sheet bundles sticking out from the front side of the sorter, even if the sheet receiving tray of the stacker is vertically moved. Then, in order to move the sheet receiving tray to the position of the uppermost bin, that is, the initial position in the upper module, a motor for moving vertically the sheet receiving tray is turned on (Step 6005). As soon as it arrives at the position, the motor is stopped (Step 6007, Step 6009). Then, the operation proceeds to Step 6021.

In the same manner, in Step 6011, it is detected whether or not a lower module stacker signal is present. When the signal is not detected, Step 6001 is followed, and when the signal is present, Step 6013 is followed. In Step 6013, the sheet picking rollers are retracted, and at the same time, are opened to be prepared for gripping and extracting the sheet bundle. Then, in order to move the sheet receiving tray to the position of the 11th bin, that is, the initial position in the lower module, a motor for moving vertically the sheet receiving tray is turned on (Step 6015). As soon as it arrives at the position, the motor is stopped (Step 6017, Step 6019). Then, the operation proceeds to Step 6021.

In Step 6021, the sheet rollers in the open state are advanced beyond the edge of the sheet bundle (Step 6021); closed to grip the bundle; and retracted (Step 6023 and Step 6025). As soon as the rollers are retracted, a conveying motor for the sheet picking rollers is turned on to convey the sheet bundle (Step 6027 and Step 6029). When the completion of the sheet transfer is detected by measuring the distance the sheet has been conveyed, which corresponds to the sheet size or the like (Step 6031), the sheet conveyance is stopped, and the sheet picking rollers are reopened (Step 6033). After the last sheet bundle is extracted (Step 6035), the operation is ended. When the last sheet bundle has not been extracted, the sheet receiving tray is moved by one bin to align the sheet receiving tray with the next sheet bundle to be picked (Step 6037), and then, as soon as the tray takes the position, the operation returns to Step 6021 (Step 6039).

As regards the sorting mode of this embodiment of the sorter in accordance with the present invention (FIG. 30), the operational flow is described referring to explanatory flowcharts. However, each of the branch operations is programmed for multitasking so that two or more jobs can be concurrently carried out. In other words, it is possible, for example, to receive the sheets in the lower module (11th bin to 20th bin) while stapling the sheets in the upper module (first bin to tenth bin). Also, it is possible to carry out the stacker discharge operation in the lower module (11th bin to 20th bin) while receiving the sheets in the upper module (first bin to 10th bin). Further, it is possible to match the number of receiving module to the number of bin, by providing each bin with the jogging member. This control method of dividing the sorter into two or more independently operable modules enables multiple operations to be concurrently carried out, and further, addition of the stacker or the like which is operated in coordination with the sorter can realize a system with the last amount of waiting time.

Further, in this embodiment, the control is executed by dividing the sorter bins into two modules (first to 10th bins and 11th to 20th bins). However, the module configuration is optional. In other words, the bins may be dynamically grouped into any number, or combination, of modules. For example, the bins may be grouped into the first module comprising the first to eighth bins, second module comprising ninth to 16th bins, and third module comprising 17th to 20th bins, wherein the sheet processing operation such as the sheet delivery or sheet binding may be concurrently carried out in different modules, independently from other modules. Further, it is possible to match the number of receiving module to the number of bin, by providing each bin with the jogging member. This control method of dividing the sorter into two or more independently operable modules enables multiple operations to be concurrently carried out, and further, addition of the stacker or the like which is operated in coordination with sorter can realize a system with the least amount of waiting time.

Next, the stapling procedure will be described, just for reference.

I. For example, a case in which ten sets of copies are made from a set of eight originals; are collated, using a sorter having a total of 20 bins; and are bound (for example, single point binding).

(1) Let it be that the time it takes for the copying machine to process one sheet (from when a sheet is received in the first bin to when next sheet is received in the second bin) is one second, and the sum of the time it takes for the stapler 200 to move vertically and the time it takes for the stapling operation is two seconds. Then, a total processing time required to feed, one rotation, the set of originals by the automatic original feeding apparatus, to sort ten sets of copies, and to staple them is:

$$8(\text{sheet})\times 10(\text{sets})\times 10(\text{sec})+1(\text{set})\times 2(\text{sec})=100(\text{sec})$$

In this length of time, the time required for stapling after the completion of the copying operation is:

$$10(\text{set})\times 2(\text{set})=20(\text{sec})$$

during which an operator has to wait (20 seconds).

(2) However, in this embodiment, the stapling operation can be concurrently carried out while the sorting it going on, at a location where the stapling unit does not interferes with the second delivery unit 4. Therefore, the following operations are possible. The descriptions of these examples are given with reference to the same case as the aforementioned one in which ten sets of copies are made from a set of eight originals; are collated, using a sorter having a total of 20 bins; and are bound.

(1) First, the set of originals is fed one rotation by the automatic original feeding apparatus, wherein eight sets out of ten sets of copies are made and sorted using the upper bins $B_1$–$B_8$.

(2) Through one more rotation of the set of originals, two sets of copies, that is, the rest, are made and sorted into bins $B_9$ and $B_{10}$.

(3) Concurrently with Step (2), wherein two sets of copies, the rest, are sorted after eight sets of copies is completely sorted in Step (1), these top eight sets of copies (bins $B_1$ to $B_8$) are stapled.

(4) Two sets at the bottom (bins $B_9$ and $B_{10}$) are stapled after all of the upper eight sets are stapled.

The processing time for the upper eight bins (bins $B_1$ to $B_8$) is:

$$\underbrace{8(\text{sheets}) \times 8(\text{sets}) \times 1(\text{sec})}_{(1)} + \underbrace{8(\text{sets}) \times 2(\text{sec})}_{(3)} = 80(\text{sec})$$

The processing time for the lower two bins (bins $B_9$ to $B_{10}$) is:

$$\underbrace{8(\text{sheets}) \times 2(\text{sets}) \times 1(\text{sec})}_{(2)} + \underbrace{2(\text{sets}) \times 2(\text{sec})}_{(4)} = 20(\text{sec})$$

However, as was stated above, Step (2) in which the sorting operation for the bottom bins is concurrently carried out with Step (3) in which the stapling operation for upper bins is carried out. As a result, the total processing time is as follows.

$$\underbrace{8(\text{sheets}) \times 8(\text{sets}) \times 1(\text{sec})}_{(1)} + \underbrace{8(\text{sets}) \times 2(\text{sec})}_{(3)=(2)} + \underbrace{2(\text{sets}) \times 2(\text{sec})}_{(4)} = 84(\text{sec})$$

In this total processing time, the time it takes for the stapling operation after the completion of the copying operation is:

$$\underbrace{2(\text{sets}) \times 2(\text{sec})}_{(4)} = 4(\text{sec})$$

Therefore, it is possible to reduce substantially the waiting time after the main assembly of the copying machine stops its operation.

In other words, the waiting time between when the main assembly of the copying machine stops and when the stapling operation is completed can be reduced by means of making substantially the same, the stapling time $T_1$ n Step (3) in which the stapling operation is carried out in the bins into which the copies are sorted through the first original feeding rotation, and the sorting time $T_2$ in Step (2) in which the sorting operation is carried out in the bins into which the copies are sorted through the second original feeding rotation.

The description given above can be summarized into a simple equation given below.

a. sheet count/one set b. total set count c. set count for first original feeding rotation Copy processing time (sorting time for one sheet): $t_1$ Stapling time (stapling time for one set): $t_2$ $$c \times t_2 \approx a \times (b-c) \times t_1$$

When the control is executed to satisfy this condition, the aforementioned waiting time can be shortened.

In the above mentioned embodiment, the stapling corresponding to the first original feeding rotation and the sorting corresponding to the second original feeding rotation are started immediately after the completion of the sorting corresponding the first original feeding rotation. However, the aforementioned time saving operation can be carried out with added efficiency by starting the stapling operation from the bin into which the first copy from the last original (a-th copy in a set of copies) is sorted (stapling begins while the rest of the copies from the last original are received).

II. Next, the sheet extracting operation will be described (referring to a case in which the stacker 600 is used).

Let it be that 20 sets of copies, each set comprising eight copies, are made, and sorted by a sorter comprising a total of ten bins.

Extracting operation for unbound copies (1) Let it be that the time it takes for the copying machine to process one sheet is one second, and the time it takes for extracting the copies (the time it takes, per bin, for the tray and the pair of rollers to move to a bin position and transfer the copies onto the tray) is two seconds; wherein the set of originals are rotated twice since the total number of bins are ten. Then, the time it takes for the copies to be extracted after the first rotation of the original feeding is:

$$\underbrace{8(\text{sheets}) \times 10(\text{sets}) \times 1(\text{sec})}_{(1)} + \underbrace{10(\text{sets}) \times 2(\text{sec})}_{(3)} = 100(\text{sec})$$

Therefore, in order to obtain 20 sets of copies, it takes:

$$2 \times 100(\text{sec}) = 200(\text{sec})$$

In these 200 seconds, the time required for extracting the copies after the first round of copy making operation in which the set of originals is fed one rotation is:

$$10(\text{sec}) \times 2(\text{sec}) = 20(\text{sec}) \qquad (2)$$

Meanwhile, the copying operation in the main assembly of the copying machine must be halted, waiting till the bins are emptied. Since there are 20 sets, the waiting time becomes $2 \times 20(\text{sec}) = 40(\text{sec})$, for 20 sets.

(2) In this embodiment, the sorting and the extracting can be concurrently carried out: therefore, there will be a possibility for such an approach as described below. The description will be given referring to the same case as the above in which 20 sets of copies, each set comprising eight copies, are extracted (from the sorter comprising ten bins).

(1) First, five sets of copies are made while the set of originals are fed one rotation by the automatic original feeding apparatus, and are sorted into, for example, bins ($B_1$–$B_5$), and (2) Five more sets are made and sorted into bins ($B_6$–$B_{10}$), by feeding the set of originals for the second time.

(3) Concurrently with Step (2) in which the second five sets, the rest, are sorted after the completion of Step (1) in which the first five sets are sorted, the copies in the upper five bins ($B_1$–$B_5$) are extracted;

(4) After the extraction of the first five sets is completed, the five sets in the lower bins are extracted.

In this approach, the processing time involving the upper five bins ($B_1$–$B_5$) is:

$$\underbrace{8(\text{sheets}) \times 5(\text{sets}) \times 1(\text{sec})}_{(1)} + \underbrace{5(\text{sets}) \times 2(\text{sec})}_{(3)} = 50(\text{sec})$$

The processing time involving the lower five bins ($B_6$–$B_{10}$) is:

$$\underbrace{8(\text{sheets}) \times 5(\text{sets}) \times 1(\text{sec})}_{(2)} + \underbrace{5(\text{sets}) \times 2(\text{sec})}_{(4)} = 50(\text{sec})$$

As is evident from the above description, the time $T_{(3)}$ it takes to extract the copies from the first five bins ($B_1$–$B_5$) is shorter than the time $T_{(2)}$ it takes to sort the copies into the bottom five bins ($B_6$–$B_{10}$), that is, $T_{(3)} < T_{(2)}$; therefore, the operation of the main assembly does not need to stop while the copies are extracted from the first five bins ($B_1$–$B_5$).

(5) Next, the set of original is fed for the third time, and the copies are sorted into the bins ($B_1$–$B_5$) emptied by the above described extracting operation.

(6) Concurrently with Step (5), the copies sorted through Step (2) are extracted.

(7) In the same manner, after the completion of sorting into the bins ($B_1$–$B_5$), the copies are taken out of the bins ($B_1$–$B_5$);

(8) Concurrently, the copies are sorted into the lower bins ($B_6$–$B_{10}$) emptied through the step (6); and (9) Lastly, the sheet bundles sorted into these lower bins ($B_6$–$B_{10}$) are extracted, concluding the operation for extracting 20 set of copies.

The processing time can be diagrammed as follows.

CYCLE 1 $\underbrace{8(\text{sht}) \times 5(\text{st}) \times 1(\text{s})}_{(1)} + \underbrace{5(\text{st}) \times 2(\text{s})}_{(3)}$ CYCLE 2 $\underbrace{8(\text{sht}) \times 5(\text{st}) \times 1(\text{s})}_{(2)} + \underbrace{5(\text{st}) \times 2(\text{s})}_{(4)}$ CYCLE 3 $\underbrace{8(\text{sht}) \times 5(\text{st}) \times 1(\text{s})}_{(5)} + \underbrace{5(\text{st}) \times 2(\text{s})}_{(6)}$ CYCLE 4 $\underbrace{8(\text{sht}) \times 5(\text{st}) \times 1(\text{s})}_{(7)} + \underbrace{5(\text{st}) \times 2(\text{s})}_{(8)}$ sht: sheets
st: sets
s: sec.

As is clear from the above diagram, (3) and (2), (4) and (5), and (6) and (7) are carried out at the same time, and their relations are:

$$T_{(2)} \geqq T_{(3)},\ T_{(4)} \leqq T_{(5)},\ \text{and}\ T_{(6)} \leqq T_{(7)}.$$

Therefore, the sorting and extracting operations are concurrently carried out while the main assembly of the copying machine continues its operation. In this way, the time required for (8) is the only waiting time after the copying operation ends.

Thus, the total processing time is:

$$T_{(1)} + T_{(2)} + T_{(5)} + T_{(7)} + T_{(8)} = 170\ (\text{sec})$$

and, the waiting time is $T_{(8)} = 10$ (sec); therefore, the processing speed can be substantially reduced.

In this embodiment, the sorting and extracting operations are carried out by dividing the bins into two groups comprising five bins. However, it is needless to say that the bins may be differently divided so that the number of sets to be extracted during the last round of extraction step becomes as small as possible ($T_{(8)}$ is reduced).

Extracting operation for bound sheet bundles (1) Let it be that the time (1) it takes for the copying machine to process one sheet is one second; the time (2) it takes for the stapling operation is two seconds; and the time (3) it takes for extracting the sheet bundle is two seconds. The description of this embodiment is given with reference to a case in which 20 sets of copies, each set comprising eight copies, are sorted, bound, and extracted, using a sorter comprising ten bins.

Generally speaking, when 20 set of copies are sorted using the sorter with ten bins, a set of originals is fed two cycles.

The time it takes for the copies generated by the first original feeding cycle to be completely extracted is:

$$\underbrace{8(\text{sheets}) \times 10(\text{sets}) \times 1(\text{sec})}_{(1)} + \underbrace{10(\text{sets}) \times 2(\text{sec})}_{(2)} + \underbrace{10(\text{sets}) \times 2(\text{sec})}_{(3)} = 120(\text{sec})$$

Therefore, it takes 240 sec ($=2\times120$ sec) to obtain 20 sets of copies.

In these 240 seconds, the time it takes for the stapled sheet bundles to be extracted after the copying operation ends is:

$$10(\text{sets}) \times 2(\text{sec}) \times 2 = 40(\text{sec})\ (T_{(2)} + T_{(3)})$$

For the length of this 40 seconds, the copying operation by the main assembly of the copying machine must be ceased, waiting till the bins become empty. This translates into a waiting time of 80 seconds ($=2\times40$ sec).

(3) In this embodiment, the sorting, stapling, and extracting operations can be concurrently carried out; therefore, such an approach as described below is possible.

The description of this approach is given with reference to the same case as the above in which 20 sets of copies, each set comprising eight copies, are sorted, stapled, and extracted, using a sorter with ten bins.

(1) First, through the first feeding rotation of the set of originals, the first five sets of copies are sorted into the upper bins ($B_1$–$B_5$).

(2) Through the second feeding rotation of the set of originals, the second five sets of copies are sorted into the lower bins ($B_6$–$B_{10}$).

(3) Concurrently with Step (2); (3)-1 the stapling operation is carried out in the bins ($B_1$–$B_5$); and (3)-2 the bound sheet bundles are extracted from the bins ($B_1$–$B_5$).

(4) Through the third feeding rotation of the set of originals, the copies are sorted into the bins ($B_1$–$B_5$) which are emptied in Step (3)-2.

(5) Concurrently with Step (4); (5)-1 the stapling operation is carried out in the bins ($B_6$–$B_{10}$); and (5)-2 the bound copies are extracted from the bins ($B_1$–$B_5$).

(6) Through the fourth feeding rotation of the set of originals, the copies are sorted into the bins ($B_6$–$B_{10}$) which are emptied in Step (5)-2.

(7) Concurrently with Step (6); (7)-1 the stapling operation is carried out in the bins ($B_1$–$B_5$); and (7)-2 the bound copies are extracted from the bins ($B_1$–$B_5$).

(8) Lastly, (8)-1 the stapling operation is carried out in the bins $B_6$–$B_{10}$; and (8)-2 the bound copies are extracted from the bins $B_6$–$B_{10}$.

The above sequence can be diagrammed as given below.

$$\overbrace{\text{Sheets} \times \text{Sets} \times \text{Sec.}} + \overbrace{\text{Sets} \times \text{Sec. Sets} \times \text{Sec.}}$$

CYCLE 1 $\quad \overbrace{T_{(1)}}^{8 \times 5 \times 1} + \overbrace{(T_{(3)-1} + T_{(3)-2})}^{5 \times 2 \quad 5 \times 2}$ CYCLE 2 $\quad \overbrace{T_{(2)}}^{8 \times 5 \times 1} + \overbrace{(T_{(5)-1} + T_{(5)-2})}^{5 \times 2 \quad 5 \times 2}$ CYCLE 3 $\quad \overbrace{T_{(4)}}^{8 \times 5 \times 1} \quad \overbrace{(T_{(7)-1} + T_{(7)-2})}^{5 \times 2 \quad 5 \times 2}$ CYCLE 4 $\quad \overbrace{T_{(6)}}^{8 \times 5 \times 1} \quad \overbrace{(T_{(8)-1} + T_{(8)-2})}^{5 \times 2 \quad 5 \times 2}$ In the above diagram, the steps overlapping in the vertical direction are concurrently carried out.

Further, there are the following relations:

$$T_{(2)} \geqq (T_{(3)-1} + T_{(3)-2})$$

$$T_{(4)} \geqq (T_{(5)-1} + T_{(5)-2})$$

$$T_{(6)} \geqq (T_{(7)-1} + T_{(7)-2})$$

$$T_{(8)} \geqq (T_{(8)-1} + T_{(8)-2})$$

Therefore, the stapling and extracting operations can be carried out without stopping the operation of the main assembly of the copying machine, and only the time it takes to extracting the bound copies from the last five bins becomes the waiting time.

Thus, the total processing time is:

$$T_{(1)} + T_{(2)} + T_{(4)} + T_{(6)} + (T_{(8-1)} + T_{(8)-2}) = 180 \text{ (sec)}$$

The waiting time is:

$$T_{(8-1)} + T_{(8)-2} = 20 \text{ (sec)}$$

As is evident from the above, the processing speed can be substantially reduced.

Further, in this embodiment, the bins are divided into two bin groups comprising an equal number of bins, that is, five bins, for the sorting operation and the stapling-extracting operations. However, it is needless to say that depending on the sheet processing speed, stapling time, and extracting time, the bins may be optimally grouped to minimize the last processing time ($T_{(8-1)} + T_{(8)-2}$) (for example, upper eight bins and lower two bins in a sorter with ten bins, or the like).

III. Next, a concurrent operation of the sorting, stapling, and extracting operation will be described, wherein the bins are divided into three groups.

In this embodiment, 18 sets of copies, each set comprising eight copies, are sorted, stapled, and extracted, using a sorter with nine bins.

(1) First, through the first feeding rotation of a set of eight originals, three sets of copies are sorted into the upper bins $B_1$–$B_3$.

(2) Through the second rotation of the originals, the copies are sorted into the middle bins ($B_4$–$B_6$).

(3) Concurrently with Step (2), the stapling operation is carried out in the bins ($B_1$–$B_3$).

(4) Through the third rotation of the originals, the copies are sorted into the bins ($B_7$–$B_9$).

(5) Concurrently with Step (4), the bound copies are extracted from the bins ($B_1$–$B_3$).

(6) Also, concurrently with Step (4), the stapling operation is carried out in the bins ($B_4$–$B_6$).

(7) Through the fourth rotation of the original, the copies are sorted into the bins ($B_1$–$B_3$) emptied in Step (5).

(8) Concurrently with Step (7), the bound copies are extracted from the bins ($B_4$–$B_6$).

(9) Also, concurrently with Step (7), the stapling operation is carried out in the bins ($B_7$–$B_9$).

(10) Through the fifth rotation of the originals, the copies are sorted into the bins ($B_4$–$B_6$) emptied in Step (8).

(11) Concurrently with Step (10), the bound copies are extracted from the bins ($B_7$–$B_9$).

(12) Also, concurrently with Step (10), the stapling operation is carried out in the bins ($B_1$–$B_3$).

(13) Through the sixth rotation of the originals, the copies are sorted into the bins ($B_7$–$B_9$) emptied in Step (11).

(14) Concurrently with Step (13), the bound copies are extracted from the bins ($B_1$–B3).

(15) Also, concurrently with Step (13), the stapling operation is carried out in the bins ($B_4$–$B_6$).

(16) Next, the bound copies are extracted from the bins ($B_4$–$B_6$).

(17) Concurrently with Step (16), the stapling operation is carried out in the bins ($B_7$–$B_9$).

(18) Lastly, the bound copies are extracted from the bins ($B_7$–$B_9$).

The above sequence is diagrammed as follows.

| | | | | | | | | | | | | | | | | | |
|---|---|---|---|---|---|---|---|---|---|---|---|---|---|---|---|---|---|
| CYCLE 1 | $T_{(1)}$ | + | $T_{(3)}$ | + | $T_{(5)}$ | | | | | | | | | | | | |
| CYCLE 2 | | | | | | $T_{(2)}$ | + | $T_{(6)}$ | + | $T_{(8)}$ | | | | | | | |
| CYCLE 3 | | | | | | | | | | | $T_{(4)}$ | + | $T_{(9)}$ | + | $T_{(11)}$ | | |
| CYCLE 4 | | | | | | | | | | | | | | | | $T_{(7)}$ + $T_{(12)}$ + $T_{(14)}$ | |
| CYCLE 5 | | | | | | | | | | | | | | | | | $T_{(10)}$ + $T_{(15)}$ + $T_{(16)}$ |
| CYCLE 6 | | | | | | | | | | | | | | | | | $T_{(13)}$ + $T_{(17)}$ + $T_{(18)}$ |

When the following conditions are satisfied, the processing time after the copying operation ends is $T_{(17)}+T_{(18)}$.

$$T_{(2)}>T_{(3)},\ T_{(4)}>T_{(6)},\ T_{(5)},\ T_{(7)}>T_{(9)},\ T_{(8)}$$
$$T_{(10)}>T_{(12)},\ T_{(11)},\ T_{(13)}>T_{(15)},\ T_{(14)}$$

Depending on the copying-sorting time, stapling time, and extracting time, or the like, the bins may be divided into the above mentioned three groups, and the different operations may be concurrently carried out in different groups.

In this embodiment, the bins are divided into three groups, wherein different operations are independently and concurrently carried out. However, the bins may be divided four or more groups depending on the involved condition, wherein, needless to say, it is necessary to divide the bins into groups comprising an equal number of bins.

Further, in this embodiment, the bound copies are extracted using the stacker 600. However, the same effects can e enjoyed even when the copies are manually taken out by an operator. This can be easily understood by assuming that the manual extraction time by the operator is the same two seconds as the above embodiment. In other words, the same effects can be obtained (limitless sorter without the stacker).

Further, it is needless to say that the operations described in I to III are applicable to any fixed bin sorter regardless of provision of the delivery unit.

Also, in the operations described in I to III, when two or more operations are concurrently carried out (for example, sorting and stapling), the second operation is started after the operation in each module is completed (in the above embodiment, the sorting in the lower bins ($B_9$ and $B_{10}$) is carried out after the completion of the sorting in the upper eight bins ($B_1$–$B_8$), and the stapling in the upper bins is carried out while the sorting is carried out in the lower bins). However, even while the sorting is going on in the upper bins, the stapling operation is possible in the bins into which the eight copy (the last of eight copies to be delivered in the bin) has been delivered. Therefore, if the stapling operation is started without waiting until the sorting operations is completed in all of the upper bins, the processing time can be further reduced. This offers a possibility of dividing the bins into an upper group of bins ($B_1$–$B_9$) and a lower bin $B_{10}$), wherein the operator has to wait only for the duration of the stapling operation for the bin $B_{10}$ after the sorting ends.

In the preceding embodiment, the uppermost bin is selected to the non-sorting bin, and is placed in alignment with the upper pair of discharge rollers 13. However, it is not important for the non-sorting bin to be the uppermost bin. For example, referring to FIG. 2, the bin Bg, which is in alignment with the lower pair of discharge rollers 15, may be selected as the non-sorting bin. However, in this case, the home positions for the delivery units 2 and 4 become the positions where they become aligned with the pair of rollers 15 an the bin Bg, respective, and in the non-sorting mode, the deflector 17 is activated upward, whereby the sheet material is conveyed downward through the sheet passage 12.

Further, in the preceding embodiment, the uppermost bin is selected as the dedicated non-sorting bin, and below it, a group of two or more bins are arranged as the sorting bins. However, the non-sorting bin does not need to be a dedicated one, but instead, one of the sorting bins may be called for the non-sorting operation.

Also, in the preceding embodiment, only one location is designated for the non-sorting bin. However, when transferring-conveying means are provided at two or more locations, the non-sorting bin location may be optionally selected to be one of the locations where the non-sorting bin can become aligned with one of the transferring-conveying means.

While the invention has been described with reference to the structures disclosed herein, it is not confined to the details set forth and this application is intended to cover such modifications or changes as may come within the purposes of the improvements or the scope of the following claims.

What is claimed is:

1. A sorting apparatus comprising:

a plurality of bin trays arranged in a direction with clearances between adjacent ones to accommodate sheet materials;

a plurality of sheet introducing means disposed at a plurality of positions along the direction;

first sheet holding means, movable in said direction, for receiving the sheet materials from at least one of said sheet introducing means and holding the sheet materials; and second sheet holding means, movable in said direction, for receiving sheet from said first sheet holding means and for discharging the sheet material to said bin trays;

wherein said first sheet holding means selects such one of said sheet introducing means as is closer to a position of said second sheet holding means, and said first sheet holding means receives the sheet material from the selected sheet introducing means and moves in said direction to feed the sheet material to said second sheet holding means.

2. An apparatus according to claim 1, further comprising a deflector provided between a first and second of said plurality of sheet introducing means, wherein a distance between said first sheet introducing means and said deflector is substantially equal to a distance between said second sheet introducing means and said deflector.

3. An apparatus according to claim 1, wherein said first sheet introducing means is disposed opposed to an upper bin tray, and said second sheet introducing means is disposed opposed to a lower bin tray.

4. An image forming apparatus comprising:

image forming means for forming images on sheet materials;

a plurality of bin trays arranged in a direction with clearances between adjacent ones to accommodate the sheet materials on which images have been formed;

a plurality of sheet introducing means disposed at a plurality of positions along the direction;

first sheet holding means, movable in said direction, for receiving the sheet materials from said sheet introducing means and holding the sheet materials; and second sheet holding means, movable in said direction, for receiving sheet from said first sheet holding means and for discharging the sheet material to said bin trays, wherein said first sheet holding means selects such one of said sheet introducing means as is closer to a position of said second sheet holding means, and said first sheet holding means receives the sheet material from the selected sheet introducing means and moves in said direction to feed the sheet material to said second sheet holding means.

5. An apparatus according to claim 3, wherein each of said first and second sheet holding means is provided with a pair of rotatable members, and wherein said first rotatable member moves while nipping the sheet material, and rotates at a position opposed to the rotatable members of said second holding means to transfer the sheet material to said second holding means, and moves toward said sheet introducing means.

6. An apparatus according to claim 3, further comprising moving means for moving said second sheet holding means step by step to oppose said bin trays and for moving said first sheet holding means step by step oppose to said second sheet holding means.

7. An apparatus according to claim 6, further comprising control means for controlling said first sheet holding means to another one of said sheet introducing means after transferring the sheet material to said second sheet holding means, when said second sheet holding means is closer to another one of said sheet introducing means.

* * * * *

UNITED STATES PATENT AND TRADEMARK OFFICE

CERTIFICATE OF CORRECTION

PATENT NO. : 5,417,417

DATED : May 23, 1995

INVENTOR(S) : YOSHIFUMI TAKEHARA, ET AL.

It is certified that error appears in the above-indentified patent and that said Letters Patent is hereby corrected as shown below:

Title page, item [56] col, 2, line 1, under Foreign Patent Documents insert-- "0127556 5/1989 Japan" should read --1-127556 5/1989 Japan";
"0197279 8/1989 Japan" should read --1-197279 8/1989 Japan;
"4059563 2/1992 Japan" should read --4-59563 2/1992 Japan; and
"4242768 8/1992 Japan" should read --4-243768 8/1992 Japan--.

line 14, "device" should read --devices--; and
line 15, "receive" should read --receives--.

Figure 27,
"INITAL" (both occurrences) should read --INITIAL--.

Figure 37,
"CARRIGH" should read --CARRIAGE--.

Figure 38A,
"VETICAL" should read --VERTICAL--.

Figure 38,
"VETICAL" should read --VERTICAL--.

UNITED STATES PATENT AND TRADEMARK OFFICE

CERTIFICATE OF CORRECTION

PATENT NO. : 5,417,417

DATED : May 23, 1995

INVENTOR(S) : YOSHIFUMI TAKEHARA, ET AL.

It is certified that error appears in the above-indentified patent and that said Letters Patent is hereby corrected as shown below:

Column 1,
line 24, "refers" should read --refer--.

Column 9,
line 59, "to" should read --into--.

Column 10,
line 47, "return" should read --returned--.

Column 11,
line 9, "an" should read --a--.

Column 18,
line 34, "descends" should read --descend--.

Column 21,
line 26, "shows" should read --show--.

Column 23,
line 41, "will" should read --till--.

Column 24,
line 28, "completion" should read --completion of--.

Column 25,
line 62, "is" (second occurrence) should be deleted.

Column 26,
line 42, "is" (first occurrence) should read --in--.

UNITED STATES PATENT AND TRADEMARK OFFICE

CERTIFICATE OF CORRECTION

PATENT NO. : 5,417,417

DATED : May 23, 1995

INVENTOR(S) : YOSHIFUMI TAKEHARA, ET AL.

It is certified that error appears in the above-indentified patent and that said Letters Patent is hereby corrected as shown below:

Column 32,
line 64, "interferes" should read --interfere--.

Column 34,
line 12, "corresponding" should read --corresponding to--.

Column 39,
line 53, "e" should read --be--.

Column 40,
line 7, "operations" should read --operations--; and
line 48, "respective," should read --respectively,--.

Column 41,
line 4, "sheet" should read --the sheet--.

Column 42,
line 4, "sheet" should read --the sheet--.

Signed and Sealed this

Twenty-sixth Day of September, 1995

Bruce Lehman

*Attest:*

BRUCE LEHMAN

*Attesting Officer*

*Commissioner of Patents and Trademarks*